US012686545B2

(12) United States Patent
Merzeau et al.

(10) Patent No.: US 12,686,545 B2
(45) Date of Patent: Jul. 21, 2026

(54) ARTICLE CARRIER AND BLANK THEREFOR

(71) Applicant: WestRock Packaging Systems, LLC, Atlanta, GA (US)

(72) Inventors: Julien D. Merzeau, Chateauroux (FR); Alexandre Therond, Chateauroux (FR); Nicolas Teillol, Diors (FR); Arnaud Demange, Bristol (GB); Nathaniel B. Ball, Richmond, VA (US); Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 111 days.

(21) Appl. No.: 18/023,143

(22) PCT Filed: Aug. 24, 2021

(86) PCT No.: PCT/US2021/047373
§ 371 (c)(1),
(2) Date: Feb. 24, 2023

(87) PCT Pub. No.: WO2022/046786
PCT Pub. Date: Mar. 3, 2022

(65) Prior Publication Data

US 2023/0339665 A1 Oct. 26, 2023

Related U.S. Application Data

(60) Provisional application No. 63/190,891, filed on May 20, 2021, provisional application No. 63/141,562, (Continued)

(51) Int. Cl.
*B65D 71/46* (2006.01)

(52) U.S. Cl.
CPC .... *B65D 71/46* (2013.01); *B65D 2571/00197* (2013.01); *B65D 2571/00314* (2013.01); (Continued)

(58) Field of Classification Search
CPC ..... B65D 5/50; B65D 5/5059; B65D 5/5061; B65D 5/5038; B65D 71/42; B65D 71/48; (Continued)

(56) References Cited

U.S. PATENT DOCUMENTS 3,612,266 A * 10/1971 Graser ..... B65D 71/48 206/161
3,767,041 A 10/1973 Graser
(Continued)

FOREIGN PATENT DOCUMENTS

EP 1015347 B1 2/2003
EP 1910187 B1 3/2009
(Continued)

OTHER PUBLICATIONS

International Search Report issued in PCT/US2021/047373 dated Mar. 22, 2022.
JP Office Action dtd Jun. 24, 2025, 9 pages.

*Primary Examiner* — Anthony D Stashick
*Assistant Examiner* — Raven Collins
(74) *Attorney, Agent, or Firm* — Brian J. Goldberg; Rohini K. Garg; Tsugihiko Suzuki

(57) ABSTRACT

Aspects of the disclosure relate to a package, an article carrier for packaging one or more articles and a blank for forming the carrier. The article carrier 90; 290 comprises a pair of spaced panels including a cover panel 18/20; 118/120; 254 and an engaging panel 12; 112; 212. A male locking tab 80; 180; 280; 380; 480; 580; 680; 580 formed from the cover panel 18/20; 118/120; 254 connects the cover panel 18/20; 118/120; 254 with the engaging panel 12; 112; 212.
(Continued)

The locking tab 80; 180; 280; 380; 480; 580; 680; 580 is hingedly connected to the cover panel 18/20; 118/120; 254 along a fold line 81; 181; 281; 381; 481; 581. The fold line 81; 181; 281; 381; 481; 581 lies upon a notional line n-n which extends obliquely with respect to at least one of an end edge M1, M2 and a side edge 19; 119 of the cover panel 18/20; 118/120; 254.

21 Claims, 33 Drawing Sheets

Related U.S. Application Data filed on Jan. 26, 2021, provisional application No. 63/077,310, filed on Sep. 11, 2020, provisional application No. 63/070,662, filed on Aug. 26, 2020.

(52) U.S. Cl.
CPC ..... *B65D 2571/00444* (2013.01); *B65D 2571/00666* (2013.01)

(58) Field of Classification Search
CPC ..... B65D 71/46; B65D 2571/00314; B65D 2571/00666
USPC ..... 206/147
See application file for complete search history.

(56) References Cited

U.S. PATENT DOCUMENTS

| | | | | | |
|---|---|---|---|---|---|
| 5,485,915 | A * | 1/1996 | Harris | B65D 71/16 206/464 |
| 5,503,267 | A | 4/1996 | Sutherland | |
| 5,609,251 | A * | 3/1997 | Harris | B65D 71/34 206/141 |
| 6,021,898 | A * | 2/2000 | Sutherland | B65D 71/36 206/427 |
| 11,932,472 | B2 * | 3/2024 | Blin | B65D 71/32 |
| 2010/0127058 | A1 * | 5/2010 | Bates | B65D 71/004 229/117.13 |

FOREIGN PATENT DOCUMENTS

| | | | | |
|---|---|---|---|---|
| JP | 1973037294 | A | 6/1973 | |
| JP | H10502039 | A | 2/1998 | |
| JP | H11193059 | A | 7/1999 | |
| WO | WO9849071 | * | 4/1998 | B65D 71/46 |

* cited by examiner

ARTICLE CARRIER AND BLANK THEREFOR

TECHNICAL FIELD

The present invention relates to article carriers and to blanks for forming the same. More specifically, but not exclusively, the invention relates to a carrier of the top-gripping type having one or more apertures for receiving and retaining an article therein and a top cover affixed thereto.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides an article carrier for engaging at least one article. The article carrier comprises a pair of spaced apart panels including a cover panel and an engaging panel. The article carrier comprises a male locking tab, formed from the cover panel, for connecting the cover panel with the engaging panel. The locking tab is hingedly connected to the cover panel along a notional fold line which may extend obliquely with respect to at least one of an end edge and a side edge of the cover panel. The locking tab provides a retaining device securing the cover panel in position above the engaging panel. At least a portion of the locking tab is disposed between the upper panel and the lower panel to maintain a spacing therebetween.

Optionally, the engaging panel has at least one article-engaging structure for engaging a part of the at least one article.

Optionally, the locking tab comprises opposed shoulders spaced apart from the hinged connection between the locking tab and the cover panel.

Optionally, the locking tab forms a cushioning flap of a handle structure.

Optionally, the locking tab defines a first opening in the cover panel to which it is hinged, the first opening is disposed in registry with a second opening in the engaging panel.

Optionally, the first and second openings together define a passage through the pair of spaced apart panels.

Optionally, the second panel limits travel of the locking tab.

Optionally, an edge of the engaging panel provided by the second opening provides an end stop with which the locking tab is engageable.

Optionally, the locking tab comprises a bridging region extending across a gap or void between the cover panel and the engaging panel.

Optionally, the bridging region is defined between the notional fold line and shoulders provided by the locking tab.

Optionally, the cover panel comprises a pair of covering flaps each of which is hingedly connected to the engaging panel by a respective side panel.

Optionally, the locking tab comprises one or more separation elements defining an engaging edge of an engaging portion, the engaging edge being arranged to engage a first surface of the lower panel.

Optionally, the one or more separation elements define a support edge of a wing portion, the support edge being arranged to engage a second surface of the lower panel, the second surface of the lower panel opposes the first surface of the lower panel.

Optionally, the one or more separation elements are provided by a cut line.

Optionally, the cut line is obliquely oriented with respect to the hinged connection between locking tab and the upper panel.

Optionally, the locking tab is obliquely oriented with respect to the upper and lower panels.

Optionally, the upper panel comprises a composite cover panel formed from an upper covering flap and a lower covering flap, the upper covering flap and the lower covering flap at least partially overlapping, wherein the upper covering flap comprises a first male locking tab and the lower covering flap comprises an opening defined by a second male locking tab.

Optionally, the second male locking tab is equal to or greater in dimension than the first male locking tab.

Optionally, the locking tab asymmetric about a notional line bisecting the hinged connection between the locking tab and the panel to which it is hinged.

Optionally, the locking tab comprises a pair of shoulders providing engaging edges, a first one of the engaging edges being disposed in closer proximity to the hinged connection than the second one of the engaging edges.

Optionally, the first male locking tab is hingedly connected to the upper covering flap by a first hinged connection having a first fold resistance and the second male locking tab is hingedly connected to the lower covering flap by a second hinged connection having a second fold resistance, the second fold resistance being smaller in magnitude than the first fold resistance.

A second aspect of the invention provides an article carrier for engaging at least one article. The article carrier comprises an engaging panel having article engaging apertures for receiving upper portions of articles. A cover panel is disposed at a position spaced above the engaging panel. A connecting structure is provided for connecting the cover panel with the engaging panel. The engaging panel and the cover panel may be formed from separate blanks respectively.

Optionally, the connecting structure comprises a first connecting element for securing at least one first region of the cover panel to the articles.

Optionally, the connecting structure comprises a second connecting element for securing at least one second region of the cover panel to the engaging panel.

Optionally, the connecting structure comprises a first connecting element for securing marginal regions of the cover panel to the articles.

Optionally, the connecting structure comprises a second connecting element for securing a medial region of the cover panel to the engaging panel.

Optionally, the article carrier further comprises an article stabilizing structure extending downward from the engaging panel.

Optionally, the article stabilizing structure is hingedly connected to the engaging panel.

Optionally, the article stabilizing structure encircles a group of articles being packaged.

Optionally, the article carrier further comprises an article stabilizing structure connected to the engaging panel and extending from the engaging panel in a direction away from the cover panel.

Optionally, the article stabilizing structure encircles a group of articles being packaged.

Optionally, the connecting structure comprises a locking tab having shoulders spaced apart from a hinged connection between the locking tab and the panel to which it is hinged, in this way the shoulders engage a second panel spaced apart from said panel to which it is hinged.

Optionally, the cover panel comprises marginal regions folded about shoulders of the articles forming an article group being packaged.

Optionally, the second end flap comprises an end panel portion hingedly connected to the engaging panel and a top flap portion hingedly connected to the end panel portion.

Optionally, one of the pair of hinged panels is hingedly connected to the top flap portion.

Optionally, the other one of the pair of hinged panels is hingedly connected to the first end flap and wherein the first end flap is arranged to be disposed in face contacting relationship with the cover panel.

Optionally, at least one of the pair of hinged panels is defined, at least in part, by a pair of divergently arranged fold lines.

Optionally, at least one of the pair of hinged panels is defined, at least in part, by a pair of parallel fold lines.

Optionally, the other one of the pair of hinged panels is defined, at least in part, by a pair of parallel first fold lines, and wherein the first fold lines are obliquely oriented with respect to at least one second fold line hingedly connecting the cover panel to the engaging panel.

Optionally, the other one of the pair of hinged panels is defined, at least in part, by a pair of parallel first fold lines, and wherein the first fold lines are obliquely oriented with respect to at least one third fold line hingedly connecting the second end flap to the engaging panel.

Optionally, the first end flap is hingedly connected to the cover panel by a fourth fold line, the fourth fold line being divergently arranged with respect to a fifth fold line hingedly connecting the second end flap to the engaging panel.

Optionally, the first end flap is hingedly connected to the cover panel by a fourth fold line, the fourth fold line being obliquely oriented with respect to at least one second fold line hingedly connecting the cover panel to the engaging panel.

A third aspect of the invention provides an article carrier for engaging at least one article. The article carrier comprises a pair of spaced panels including a cover panel and an engaging panel. The article carrier comprises a male locking tab formed from the cover panel for connecting the cover panel with the engaging panel. The locking tab is hingedly connected to the cover panel along a fold line. The fold line lies upon a notional line which extends obliquely with respect to at least one of an end edge and a side edge of the cover panel.

A fourth aspect of the invention provides a blank for forming an article carrier. The blank comprises a pair of panels arranged to be spaced apart in a setup carrier. The pair of panels includes a cover panel and an engaging panel. The blank further comprises a male locking tab formed from the cover panel for connecting the cover panel and the engaging panel. The locking tab is hingedly connected to the cover panel along a notional fold line which extends obliquely with respect to at least one of an end edge and a side edge of the cover panel.

A fifth aspect of the invention provides a blank for forming an article carrier. The blank comprises a pair of panels arranged to be spaced apart in a setup carrier. The pair of panels includes a cover panel and an engaging panel. The blank further comprises a male locking tab formed from the cover panel for connecting the cover panel and the engaging panel. The locking tab is hingedly connected to the cover panel along a fold line. The fold line lies upon a notional line which extends obliquely with respect to at least one of an end edge and a side edge of the cover panel.

A sixth aspect of the invention provides a pair of blanks for forming an article carrier. The pair of blanks comprises a first blank having an engaging panel comprising article engaging apertures for receiving upper portions of articles, and a second blank separate from the first blank. The second blank comprises a cover panel configured to be disposed at a position spaced above the engaging panel in a set up condition. The pair of blanks comprises a connecting structure for connecting the cover panel and the engaging panel.

Optionally, the second blank comprises a second connecting structure for connecting the cover panel to the articles.

A seventh aspect of the invention provides an article carrier for engaging at least one article. The article carrier comprises spaced apart panels including an upper panel and a lower panel. The article carrier comprises a locking tab formed from the upper panel. The locking tab provides a retaining device securing the upper panel in position above the lower panel. The locking tab serves as a spacer between the upper panel and the lower panel.

Optionally, the locking tab protrudes downward through an opening in the lower panel such that the locking tab engages the perimeter of the opening in the lower panel.

Optionally, the upper panel comprises a composite cover panel formed from two overlapping panels, an upper covering flap comprising the locking tab and a lower covering flap comprising an opening, wherein the opening is defined by one or more female tabs.

Optionally, the locking tab engages with at least one of the female tabs.

Optionally, at least one of the female tabs protrudes downward through an opening in the lower panel.

Optionally, the locking tab engages the perimeter of the opening in the lower panel and engages a recessed portion of at least one of the female tabs.

Optionally, the locking tab comprises one or more separation elements defining an engaging edge of an engaging portion, the engaging edge being arranged to engage a first surface of the lower panel.

Optionally, the one or more separation elements define a support edge of a wing portion, the support edge being arranged to engage a second surface of the lower panel, the second surface of the lower panel opposes the first surface of the lower panel.

Optionally, the one or more separation elements are provided by a cut line.

An eighth aspect of the invention provides an article carrier for engaging at least one article. The article carrier comprises a tubular structure formed in part by a cover panel, an engaging panel and opposed side panels. The carrier comprises a gusseted end closure structure for forming a rigid hinged connection along at least one of upper and lower end edges of the tubular structure.

A ninth aspect of the invention provides an article carrier for engaging at least one article. The article carrier comprises a tubular structure formed in part by a cover panel, an engaging panel and opposed side panels. The carrier comprises a gusseted end closure structure for forming a beam structure along at least one end of the tubular structure.

Optionally, the carrier comprises a gusset provided by a pair of hinged panels connecting between a first end flap hingedly connected to the cover panel and second end flap hingedly connected to the engaging panel.

A tenth aspect of the invention provides an article carrier for engaging at least one article. The article carrier comprises a plurality of panels forming a tubular structure including a top panel and a bottom panel. The carrier comprises a first end flap hingedly connected to the top panel and second end flap hingedly connected to the bottom panel. A gusset, provided by a pair of hinged panels, connects between the first end flap and the second end flap.

Optionally, the pair of hinged panels is hingedly connected to a first portion of the second end flap arranged substantially parallel to the top panel.

Optionally, the first portion of the second end flap is hingedly connected to a second portion of the second end flap, the second portion of the second end flap extending between the top panel and the bottom panel.

An eleventh aspect of the invention provides an article carrier for engaging at least one article. The article carrier comprises a main panel having an article retention structure and a second panel hingedly connected to the main panel by a fold line. The article retention structure comprises an engaging tab located proximate the fold line between the main panel and the second panel. The engaging tab comprises a pair of non-linear side edges defined by cuts each having a first end on the distal end edge of the engaging tab. The cuts extend from their respective first ends toward the fold line and turn away from each other. The cuts maintain a spaced apart relationship from the fold line. The cuts terminate at respective second ends which are spaced apart from the fold line.

A twelfth aspect of the invention provides a blank for forming an article carrier. The blank comprises a pair of panels arranged to be spaced apart in a setup carrier. The pair of panels includes an upper panel and a lower panel. The blank comprising a locking tab formed from the upper panel. The locking tab provides a retaining device for securing the upper panel in position above the lower panel. The locking tab serves as a spacer between the upper panel and the lower panel.

A thirteenth aspect of the invention provides a blank for forming an article carrier. The blank comprises a cover panel, an engaging panel and opposed side panels for forming a tubular structure. The blank comprises a gusseted end closure structure for forming a rigid hinged connection along at least one of upper and lower end edges of the tubular structure in set up carrier.

A fourteenth aspect of the invention provides a blank for forming an article carrier. The blank comprises a cover panel, an engaging panel and opposed side panels for forming a tubular structure. The blank comprises a gusseted end closure structure for forming a beam structure along at least one end of the tubular structure in set up carrier.

A fifteenth aspect of the invention provides a blank for forming an article carrier. The blank comprises a plurality of panels for forming a tubular structure including a top panel and a bottom panel. The blank comprises a first end flap hingedly connected to the top panel and second end flap hingedly connected to the bottom panel. A gusset, provided by a pair of hinged panels, hingedly connects between the first end flap and the second end flap.

A sixteenth aspect of the invention provides a blank for forming an article carrier. The blank comprises a main panel having an article retention structure and a second panel hingedly connected to the main panel by a fold line. The article retention structure comprises an engaging tab located proximate the fold line between the main panel and the second panel. The engaging tab is defined, at least in part, by a pair of non-linear side edges defined by cuts. Each cut having a first end on the distal end edge of the engaging tab. The cuts extend from their respective first ends toward the fold line and turn away from each other. The cuts maintain a spaced apart relationship from the fold line. The cuts terminate at respective second ends which are spaced apart from the fold line.

Further aspects of the invention provide an article carrier for engaging at least one article and a blank for forming the article carrier. The article carrier comprises spaced apart panels including an upper panel and a lower panel. The article carrier comprises a handle structure formed in part from the upper panel and in part from the lower panel. The handle structure comprises a cushioning flap, formed from the upper panel and folded into a gap between the upper and lower panels, the cushioning flap provides a locking tab. The locking tab provides a retaining device securing the upper panel in position above the lower panel.

Optionally, the locking tab is hingedly connected to the cushioning flap by a fold line.

Optionally, the locking tab comprises one or more separation elements defining an engaging edge of an engaging portion, the engaging edge being arranged to engage a first surface of the lower panel.

Optionally, the one or more separation elements define a support edge of a wing portion of the cushioning flap, the support edge being arranged to engage a second surface of the lower panel, the second surface of the lower panel opposes the first surface of the lower panel. The second surface faces towards the upper panel.

Optionally, the one or more separation elements are provided by a cut line.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1A:
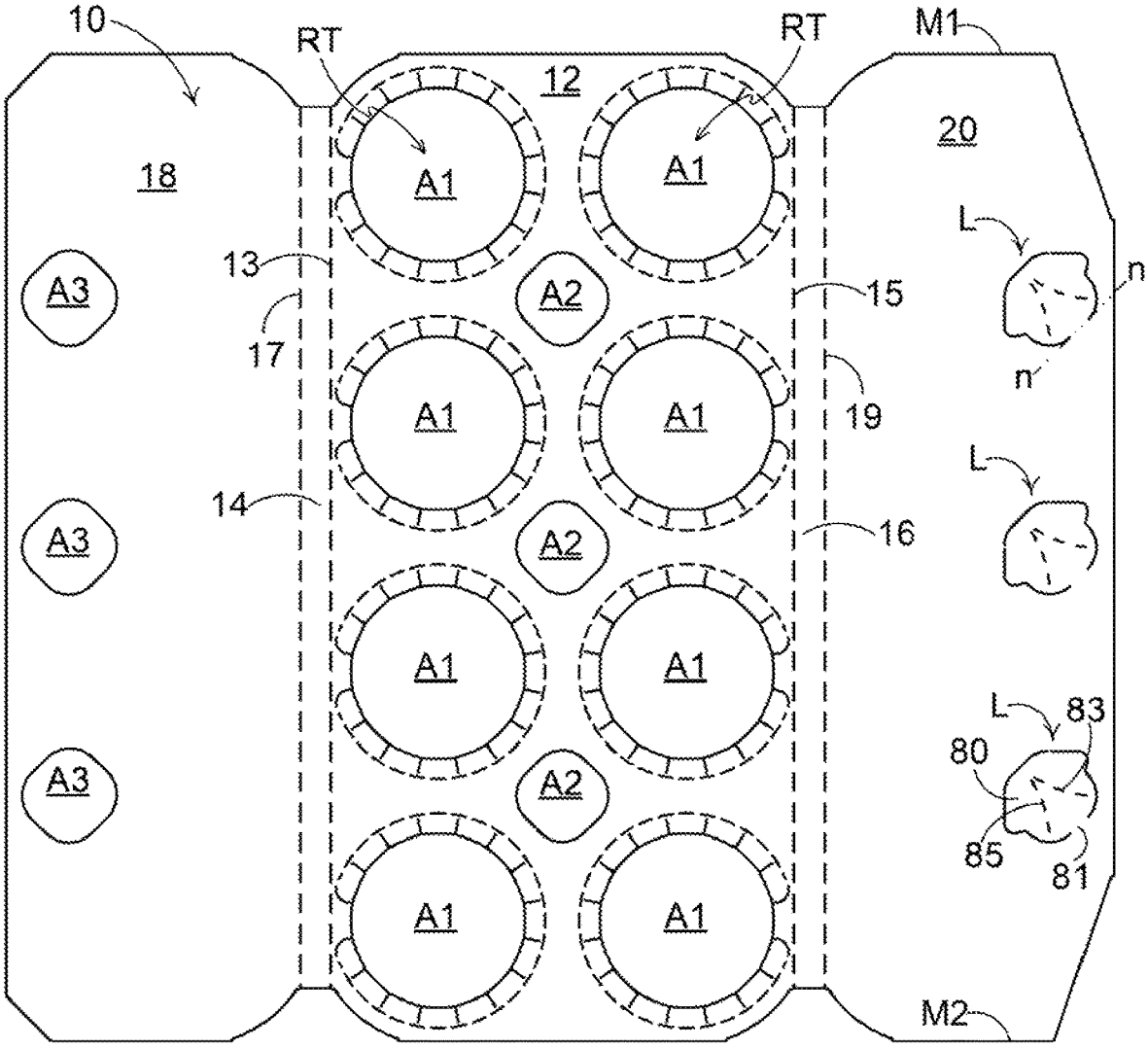
FIG. 1A is a plan view from above of a blank for forming a carrier according to a first embodiment.
Figure 1B:
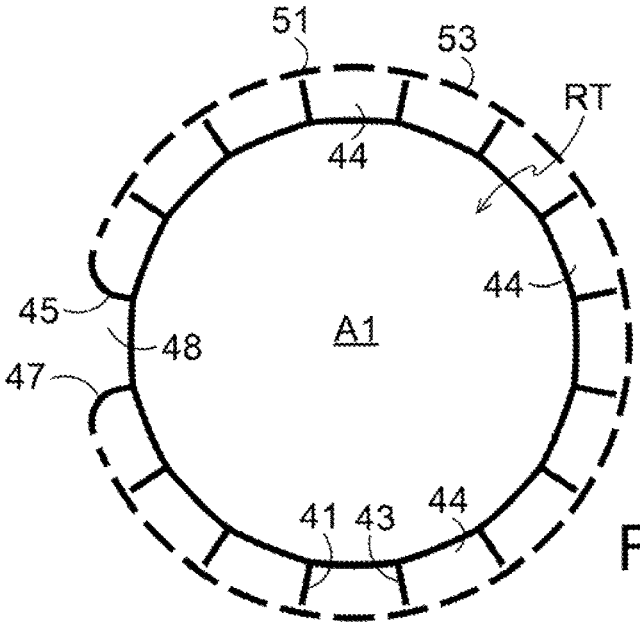
FIG. 1B is an enlarged view of an article retention device according to the first embodiment.
Figure 3:
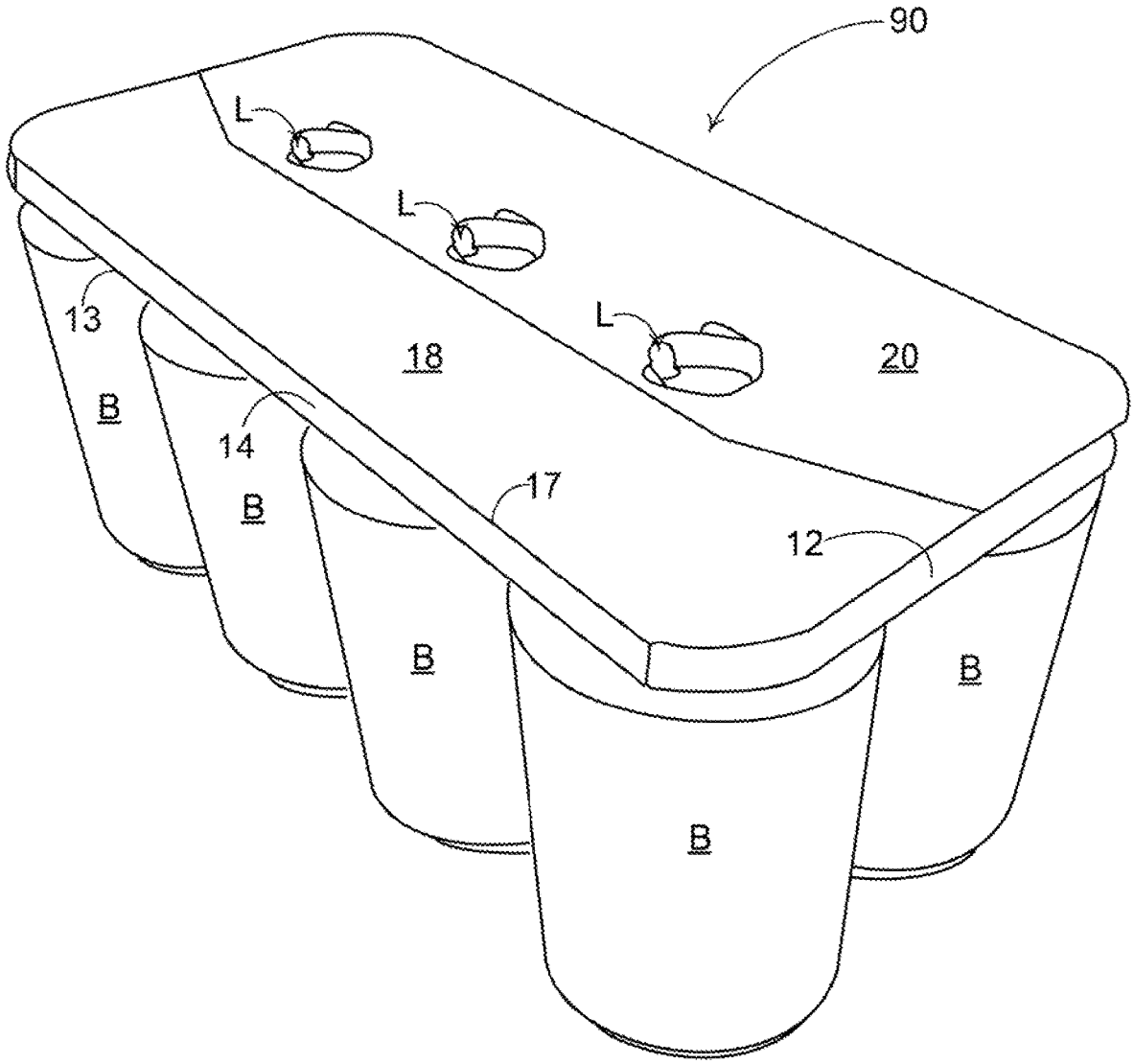
FIG. 3 is a perspective view from above of a carrier formed from the blank of FIG. 1A.
Figure 4:
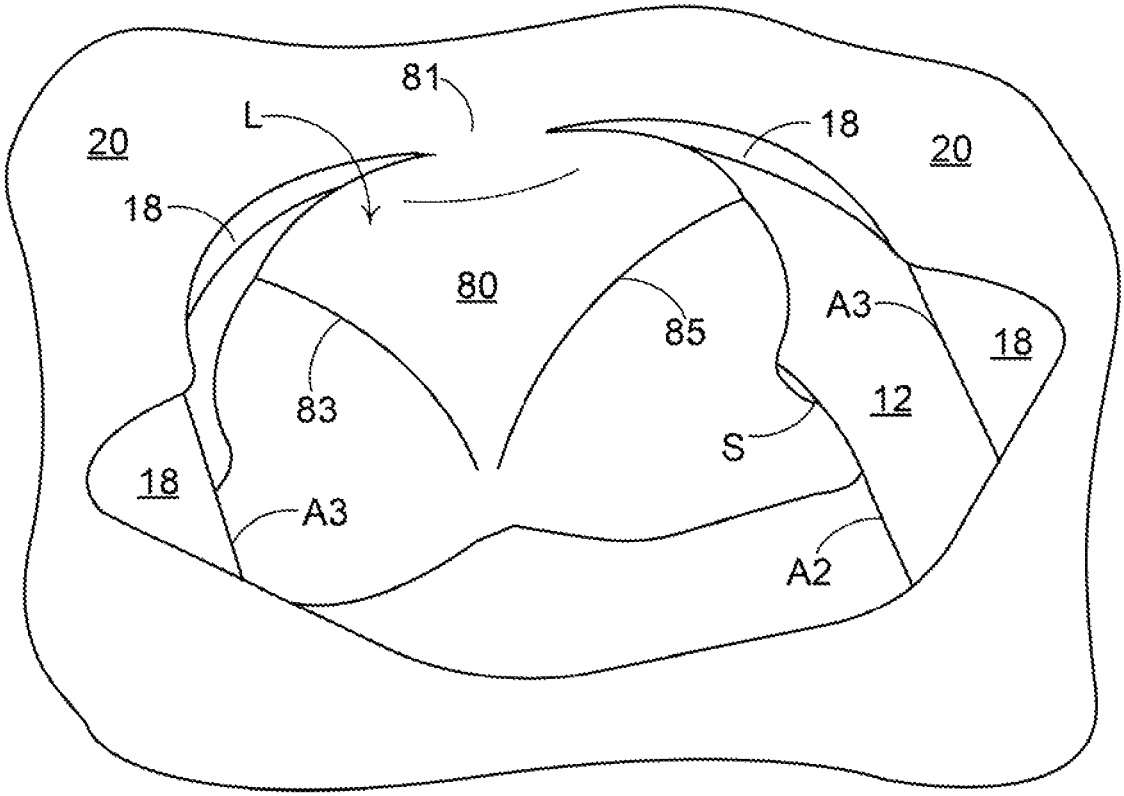
FIG. 4 is a perspective view from above of a portion of the carrier of FIG. 3.

Referring to FIG. 1, there is shown a plan view of a blank 10 which is capable of forming a carton or carrier 90, as shown in FIG. 3, for containing and carrying a group of primary products such as, but not limited to, bottles or cans, hereinafter referred to as articles B. The blank 10 forms a secondary package for packaging at least one primary product container or package.

Alternative blanks 110; 210A, 210B, 310; 410; 510; 610; 710; 810 are shown in FIGS. 5, 6, 7, 12, 20, 21, 26, 29, and 30A for forming carton or carrier 290; 390; 590; 690; 890, as shown in FIGS. 9, 18, 21, 28A, and 32, for containing and carrying a group of primary products such as, but not limited to, bottles or cans, hereinafter referred to as articles B.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 210A, 210B, 310; 410; 510; 610; 710; 810 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons 90; 290; 390; 590; 690; 890 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210A, 210A; 310; 410; 510; 710; 810 are configured to form a carton or carrier 90; 290; 390; 590; 690; 890 for packaging an exemplary arrangement of exemplary articles B. In the embodiments illustrated in FIGS. 1 to 19 and FIGS. 29 to 33, the arrangement is a 2×4 matrix or array. In the embodiment illustrated in FIGS. 1 to 4 two rows of four articles B are provided, and the articles B are 330 ml beverage cans. In the embodiments illustrated in FIGS. 5 to 19 and FIGS. 29 to 33, two rows of four articles B are provided, and the articles B are 330 ml beverage cans of a sleek or slim design. In the embodiment illustrated in FIG. 20 the blank 410 is arranged to accommodate four articles arrange in two rows of two articles and is configured to receive articles in the form of 330 ml beverage cans. In the embodiments illustrated in FIGS. 21 to 28B the blanks 510, 610 are arranged to accommodate six articles arrange in two rows of three articles and are configured to receive articles in the form of 330 ml beverage cans.

Alternatively, the blanks 10; 110; 210A, 2106; 310; 410; 510; 610 can be configured to form a carrier for packaging other types, number and size of articles and/or for packaging articles in a different arrangement or configuration.

Figure 2:
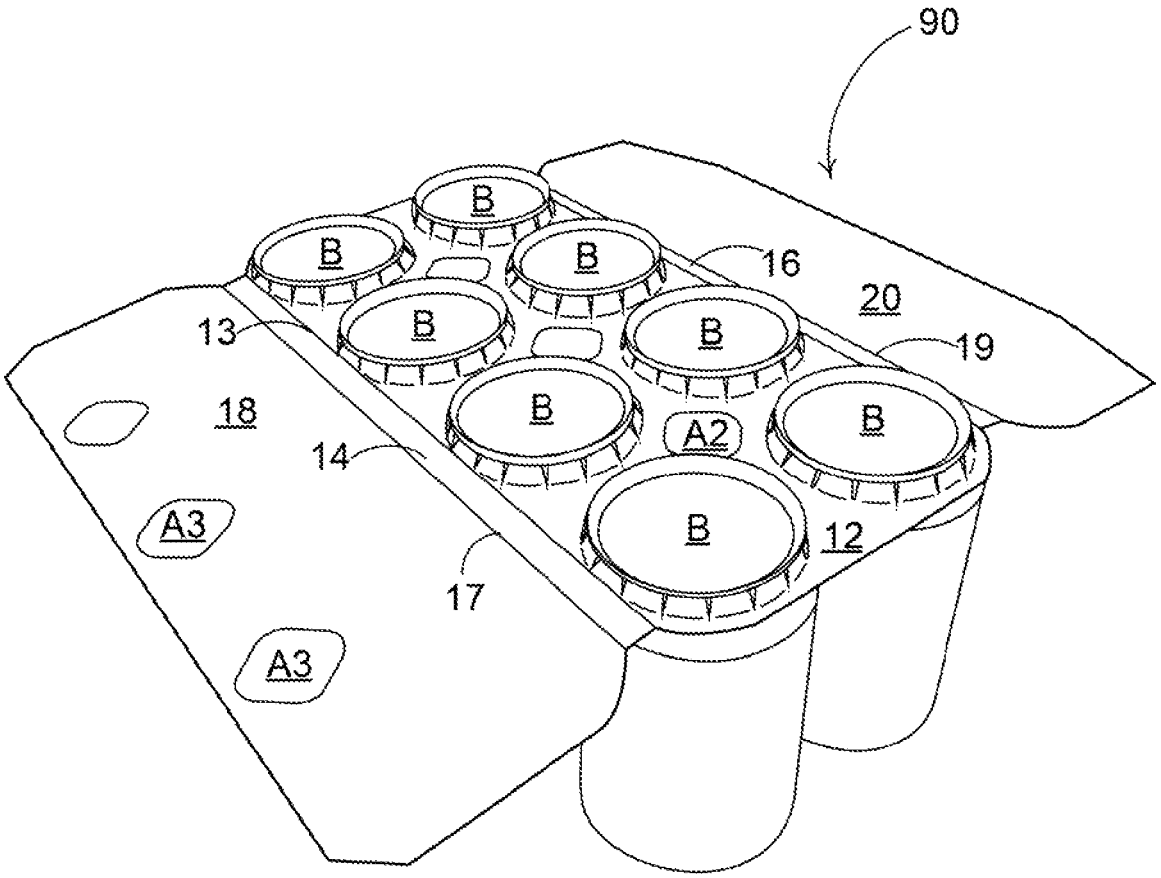
FIG. 2 illustrates a stage of construction of a carrier from the blank of FIG. 1A.

Referring to FIG. 1 there is shown a blank 10 comprising a plurality of panels 12, 14, 16, 18, 20, including a main panel (or lower/engaging panel) 12 for forming a lower wall or engaging panel of a carrier 90 (see FIG. 2).

A first side panel 14 is hingedly connected to a first side of the main panel 12 by a hinged connection in the form of a fold line 13. A first top or cover panel 18 is hingedly connected to the first side panel 14 by a hinged connection in the form of a fold line 17.

A second side panel 16 is hingedly connected to a second side of the main panel 12 by a hinged connection in the form of a fold line 15. A second top or cover panel 20 is hingedly connected to the second side panel 16 by a hinged connection in the form of a fold line 19.

The main panel 12 of the blank 10 includes at least one article retention structure RT. The main panel 12 comprises a plurality of article retention structures RT, specifically eight article retention structures RT arranged in 2×4 matrix or array. Each of the article retention structures RT comprises an opening or aperture A1.

The article retention structures RT of the embodiment of FIG. 1 takes the form of a plurality of teeth or tabs 44, 48 arranged in an annular series about an aperture A1 to form part of an article receiving opening. In other embodiments the article retention structures RT may take a different form, for example but not limited to a pair of spaced apart opposing cuts which define a displaceable region forming a cover over an article and providing a pair of opposed engaging edges for engaging opposing sides of an article below a flange, chime or other projection.

The plurality of teeth 44, 48 are provided by the main panel 12. Each of the teeth 44, 48 is hingedly connected to the main panel 12, by a hinged connection. The hinged connection may be defined by a plurality of cut lines 51, 53. The plurality of cut lines 51, 53 may be arranged as an annular series of cuts about the apertures A1.

The plurality of cut lines 51, 53 may define or approximate a portion of circle.

Each of the plurality of teeth 44, 48 comprises an engaging edge opposing a hinged edge. The engaging edges are defined by a linear portion of a cut line defining the first or second aperture A1. Each engaging edge may define a part of a polygon. The illustrated embodiment comprises sixteen teeth 44, 48 together defining a hexadecagon. Each tooth 44, 48 comprises a pair of side edges, the side edges are defined by cuts 41, 43, 45, 47 extending radially outward from respective vertices of the hexadecagon, that is to say, from a respective vertex between a pair of adjacent linear portions of the cut defining the portion of a hexadecagon. The cuts 41, 43, 45, 47 are divergently arranged with respect to each other and define an angle therebetween, the angle may be about 22.5°.

Each of the plurality of cut lines 51, 53 may be linear in shape.

In alternative embodiments, each of the plurality of cut lines 51, 53 may be arcuate or curved. The cut lines 51, 53 may comprise a radius of curvature which is equal to half the diameter of the article receiving openings. The cut lines 51, 53 may comprise a radius of curvature which is greater than half the diameter of article receiving openings.

The plurality of teeth 44, 48 may comprise a tab 48 which is disposed proximate the hinged connection between the engaging panel 12 and a respective one of the first and second side panels 14, 16. The tab 48 may be integral with the engaging panel 12, that is to say it is free from any cut lines 51, 53 or hinged connection to the engaging panel 12. The tab 48 is in sufficiently close proximity to one of the fold lines 13, 15 hinging the first and second side panels 14, 16 to the engaging panel 12 that said one of the fold lines 13, 15 effectively serves as a hinged connection to the tab 48. The tab 48 may be defined by cuts 45, 47 which comprise a 'J' or 'C' shaped cut proximate said one of the fold lines 13, 15. A portion of the 'J' or 'C' shaped cut may lie upon a notional circle defined by the plurality of cut lines 51, 53.

The main panel 12 comprises a handle structure. The handle structure may comprise at least one handle opening A2. In the illustrated embodiment, the blank 10 comprises three handle openings A2. Each handle opening A2 is defined in, or struck from, a region of the main panel 12 disposed centrally between four apertures A1 arranged as two adjacent pairs of apertures A1.

The first and second top panels 18, 20 are arranged to be disposed in at least partially overlapping relationship with each other. The overlapping portions of the first and second top panels 18, 20 are provided with a locking structure for locking the first and second top panels 18, 20. The locking structure cooperates with the handle openings in the main panel 12 to secure the first and second top panels 18, 20 to the main panel 12.

The locking structure comprises at least one receiver in the form of an opening A3 in the first top panel 18. The first top panel 18 comprises a plurality of openings A3, more specifically three openings A3, although in other embodiments one, two or more than three openings may be provided. Each of the openings A3 is arranged to be in vertical registry or alignment with a handle opening A2 provided in the main panel 12.

The locking structure comprises at least one locking element L for being received in the receiver. The locking element L comprises a tab 80 struck from the second top panel 20, the illustrated embodiment comprises three tabs 80 each arranged to be engageable with one of the receiver openings A3 and a respective one of the handle openings A2. Each tab 80 is hinged to the second top panel 20 by a hinged connection 81. Each tab 80 may comprise at least one fold line 83, 85. In the illustrated embodiment, the tab 80 comprises a pair of fold lines 83, 85. The pair of fold lines 83, 85 may be divergently arranged with respect to each other. Each of the pair of fold lines 83, 85 may be non-linear in shape for example but not limited to arcuate or curvilinear in shape.

The nonlinear fold lines 83, 85 may encourage the tab 80 to return to a planar arrangement so as to increase security of the tab 80 within the receiver and the handle opening A2.

The tab 80 may be substantially 'arrow head' shaped so as to define a pair of opposing shoulders or detents S (see FIG. 4) for securely engaging the handle opening A2 and/or receiver opening A3.

Turning to the construction of the carrier 90 from the blank 10, the blank 10 may be formed into an assembled carrier 90, as shown in FIG. 3.

The blank 10 is applied to a group of articles B. The blank 10 is lowered with respect to a group of articles B. Each of the article retention structures RT of the blank 10 is aligned with a respective article B in the group. Portions of the articles B pass through the main panel 12. The toothed regions of the main panel 12 about each of the article retention structures RT may be folded out of the plane of the main panel 12.

Each toothed region of the main panel 12 may be folded about one of the articles B received in the respective one of the article retention structures RT. The main panel 12 may deform about the article B for example but not limited to a shoulder portion of the article B, where the article B is a can the shoulder portion may be provide by the neck-in, as shown in FIG. 2.

The engaging edges of the teeth 44, 48 engage beneath a projection. The projection may be located about the neck or chime of the article B (which may provide a flange) of an article B. When the article B is a can, the projection may be provided by a canner's end seam. In other embodiments it may be provided by a ridge or undercut shaping of the article B or by an end closure of the article B for example but not limited to a crown cork or closure. In this way, the engaging edges grip or hold the article B and prevent or inhibit the article B from unintentionally separating from the main panel 12.

The blank 10 is folded about fold lines 13, 15 to bring the first side panel 14 into substantially perpendicular relationship with the main panel 12 and to bring the second end panel 16 into substantially perpendicular relationship with the main panel 12.

The blank 10 is folded about fold line 17 to fold the first top panel 18 over the tops of the articles B. The blank 10 is folded about fold line 19 to fold the second top panel 20 over the tops of the articles B and into overlapping relationship with the first top panel 18 to form a composite top panel 18/20.

The locking tabs 80 are displaced out of the plane of the second top panel 20, downwardly so as to pass through a respective one of the receiver openings A3. The locking tabs 80 are engaged with the main panel 12, passing through a respective one of the handle openings A2, best shown in FIG. 4. Shoulders of the locking tab 80 engage with an underside of the main panel 12, the underside being a second side of the main panel 12 opposing a first side through which the locking tab 80 was received.

The fold lines 83, 85 may facilitate folding the locking tab 80 such that it may pass through the receiver opening A3 and the handle opening A2.

The locking tab 80 may also provide a cushioning tab improving comfort when the package 90 is carried by inserting one or more fingers into the openings in the composite top panel 18/20 and the main panel 12.

In some embodiments, not shown, the locking tabs 80 of two adjacently disposed locking elements L may be arranged so as to be hinged substantially in opposition to each other, such that a user may engage a pair of locking elements L simultaneously to carry the package 90.

Advantageously, the carrier 90 may be assembled or constructed without use of glue or adhesive to secure the panels 12, 14, 16, 18, 20 in an erected condition.

The carrier 90 may beneficially conceal a part of the articles B from view. The composite top panel 18/20 may conceal and/or protect a top or upper region of the articles B.

Figure 5A:
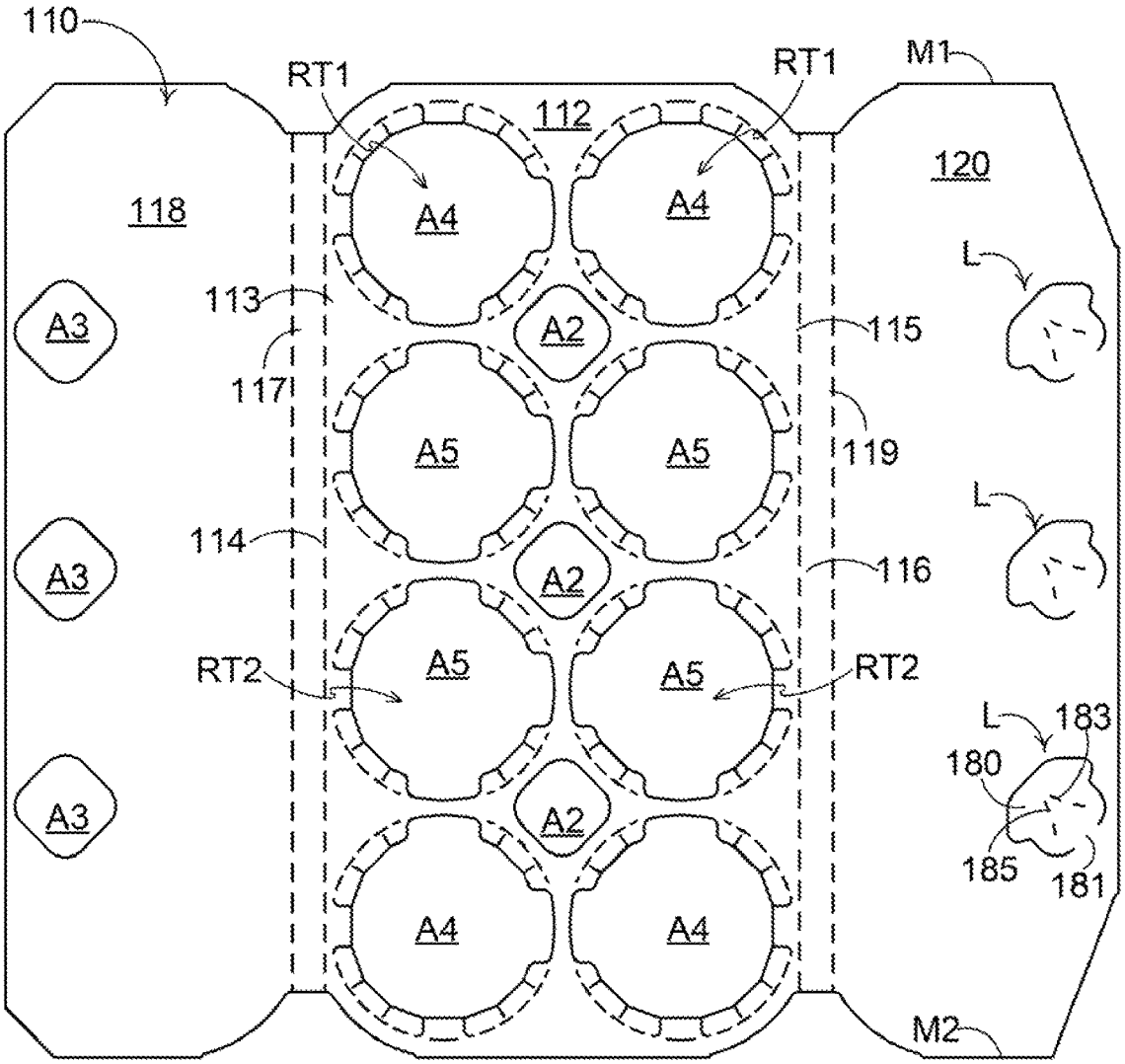
FIG. 5A is a plan view from above of a blank for forming a carrier according to a second embodiment.
Figure 5B:
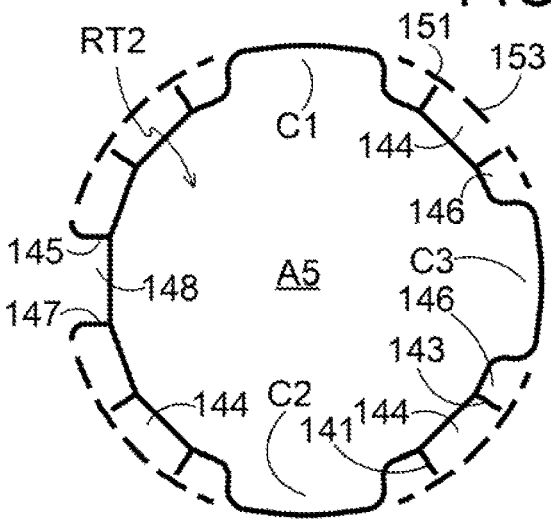
FIG. 5B is an enlarged view of a first article retention device according to the second embodiment.
Figure 5C:
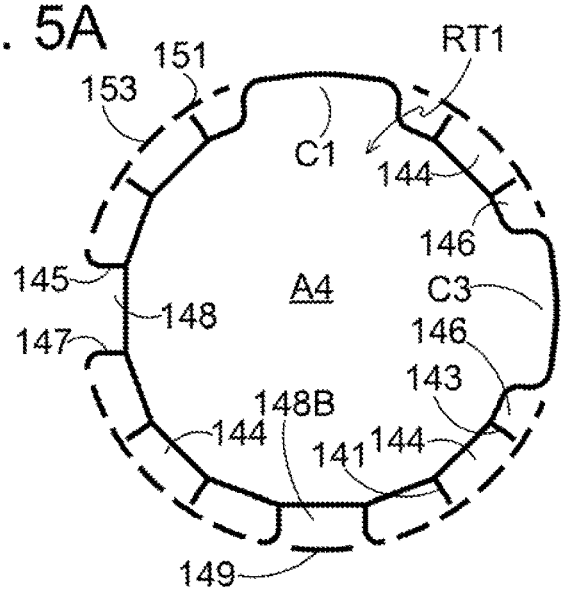
FIG. 5C is an enlarged view of a second article retention device according to the second embodiment.

Referring now to FIGS. 5A, 5B, and 5C there is shown an alternative embodiment of the present disclosure. In the second illustrated embodiment, like numerals have, where possible, been used to denote like parts, albeit with the addition of the prefix "100" to indicate that these features belong to the second embodiment. The alternative embodiment shares many common features with the embodiment of FIGS. 1 to 4, therefore only the differences from the embodiment illustrated in FIGS. 1 to 4 will be described in any greater detail.

In the embodiment shown in FIG. 5 the main panel 112 comprises alternative article retention structures RT1, RT2

The blank 110 comprises four endmost article retention structures RT1 each comprising a first opening or aperture A4. The blank 110 comprises four medial or intermediate article retention structures RT2 each comprising a second opening or aperture A5.

The endmost article retention structures RT1 comprises an article receiving opening defined in part by the first aperture A4 which is defined in, or struck from, the main panel 112.

The intermediate article retention structures RT2 comprises an article receiving opening defined in part by the second aperture A5 which is defined in, or struck from, the main panel 112.

The endmost article retention structures RT1 and the intermediate article retention structures RT2 each comprise a plurality of teeth or tabs 144, 146, 148, 148B disposed about the first or second aperture A1, A2 respectively.

The plurality of teeth 144, 146, 148, 148B of the endmost article retention structures RT1 are interrupted by a first recess or cutaway C1, best shown in FIG. 5C. The first recess C1 is provided at a location about the circumference of the first aperture A4 disposed in closest proximity to an adjacent intermediate article retention structure RT2. The first recess C1 extends from the first aperture A4 to towards the adjacent intermediate article retention structure RT2.

The plurality of teeth 144, 146, 148, 148B of the endmost article retention structures RT1 are interrupted by a second recess or cutaway C3. The second recess C3 is provided at a location about the circumference of the first aperture A4 disposed in closest proximity to an adjacent endmost article retention structure RT1. The second recess C3 extends from the first aperture A4 to towards the adjacent endmost article retention structure RT1.

The endmost article retention structures RT1 comprise a first tab 148 which is disposed proximate the hinged connection between the engaging panel 112 and a respective one of the first and second side panels 114, 116. The tab 148 may be integral with the engaging panel 112, that is to say it is free from any cut lines 151, 153 or hinged connection to the engaging panel 112. The tab 148 is in sufficiently close proximity to one of the fold lines 113, 115 hinging the first and second side panels 114, 116 to the engaging panel 112 that said one of the fold lines 113, 115 effectively serves as a hinged connection to the tab 148. The tab 148 may be defined by cuts 145, 147 which comprise a 'J' or 'C' shaped cut proximate said one of the fold lines 113, 115. A portion of the 'J' or 'C' shaped cut may lie upon a notional circle defined by the plurality of cut lines 151, 153.

The endmost article retention structures RT1 comprise a second tab 148B which is disposed proximate a free end edge of the engaging panel 112. The second tab 148 may be defined in part by a second cut lines 149. The second tab 148 may be defined by cuts 145, 147 which comprise a 'J' or 'C' shaped cut proximate said one of the fold lines 113, 115. The second cut 149 is disposed between cuts 145, 147. A portion of the 'J' or 'C' shaped cut may lie upon a notional circle defined by the plurality of cut lines 151, 153. The second cut 149 may be longer in length than the cut lines 151, 153.

The second tab 148B is disposed opposite the first recess C1. The tab 148 is disposed opposite the second recess C3.

The intermediate article retention structures RT2 are substantially similar in construction to the endmost article retention structures RT1, albeit the second tab 148B has been replaced with a third recess or cutaway C2. The third recess C2 is provided at a location about the circumference of the second aperture A2 disposed in closest proximity to an adjacent endmost article retention structure RT1. The third recess C2 extends from the second aperture A5 towards the adjacent endmost article retention structure RT1. The third recess C2 is disposed opposite the first recess C1, the second recess C3 is oriented perpendicular to the first and third recesses C1, C2.

Referring now to FIGS. 6 to 11 there is shown a further alternative embodiment of the present disclosure. In the third illustrated embodiment, like numerals have, where possible, been used to denote like parts, albeit with the addition of the prefix "200" to indicate that these features belong to the third embodiment. The alternative embodiment shares many common features with the embodiments of FIGS. 1 to 5, therefore only the differences from the embodiment illustrated in FIGS. 1 to 5 will be described in any greater detail.

Figure 6:
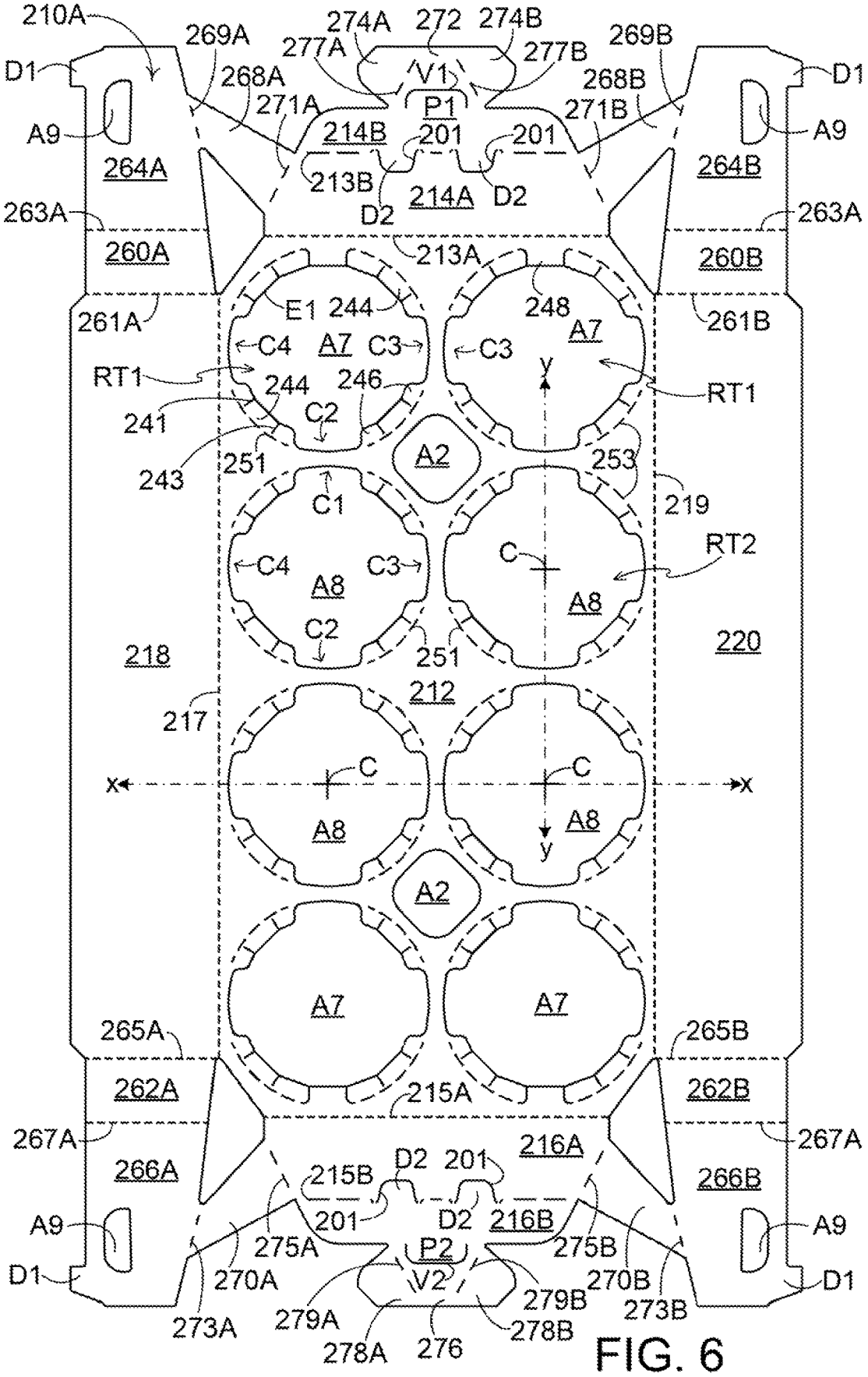
FIG. 6 is a plan view from above of a first blank for forming a package according to a third embodiment.
Figure 7:
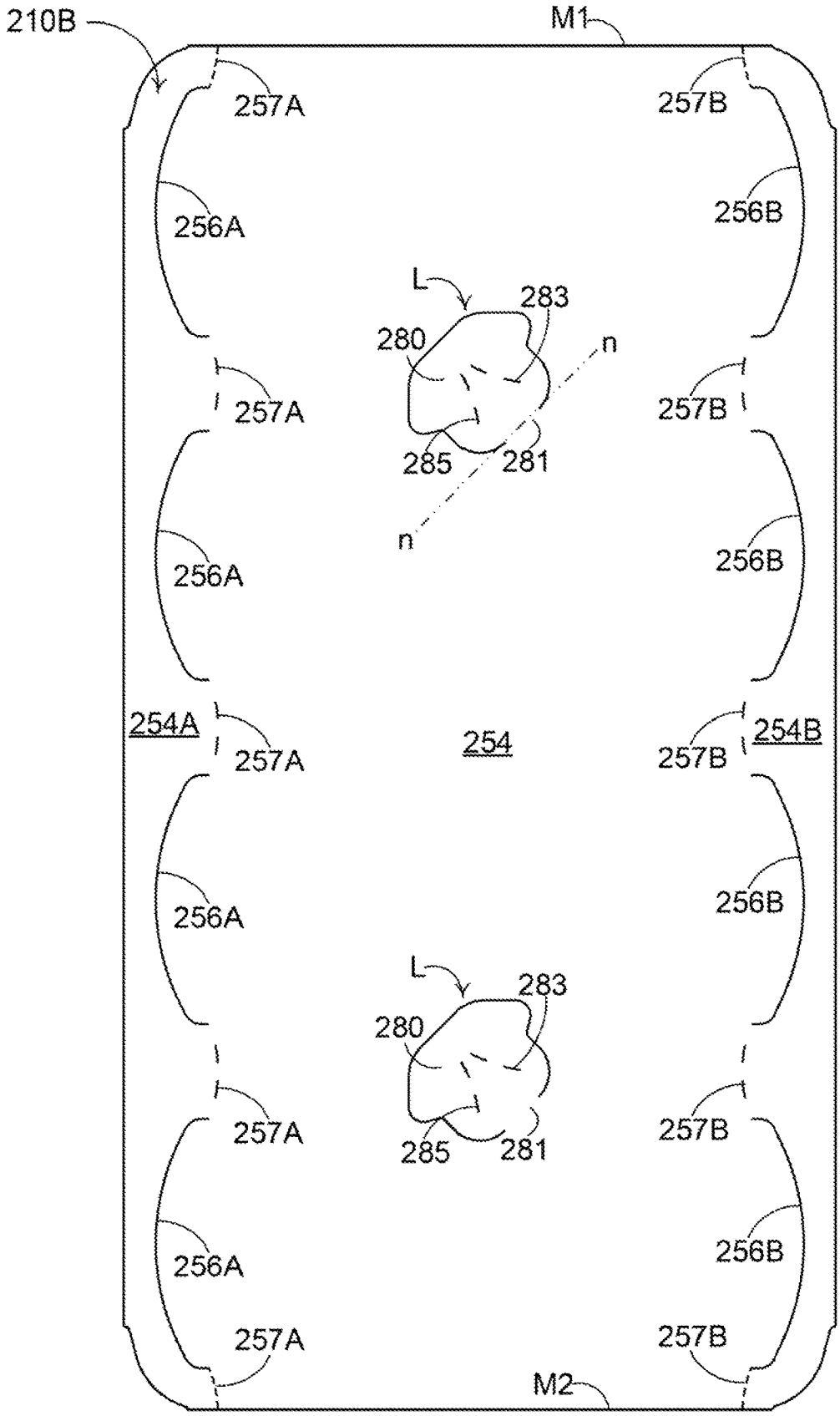
FIG. 7 is a plan view from above of a second blank for forming a package according to the third embodiment.
Figure 8:
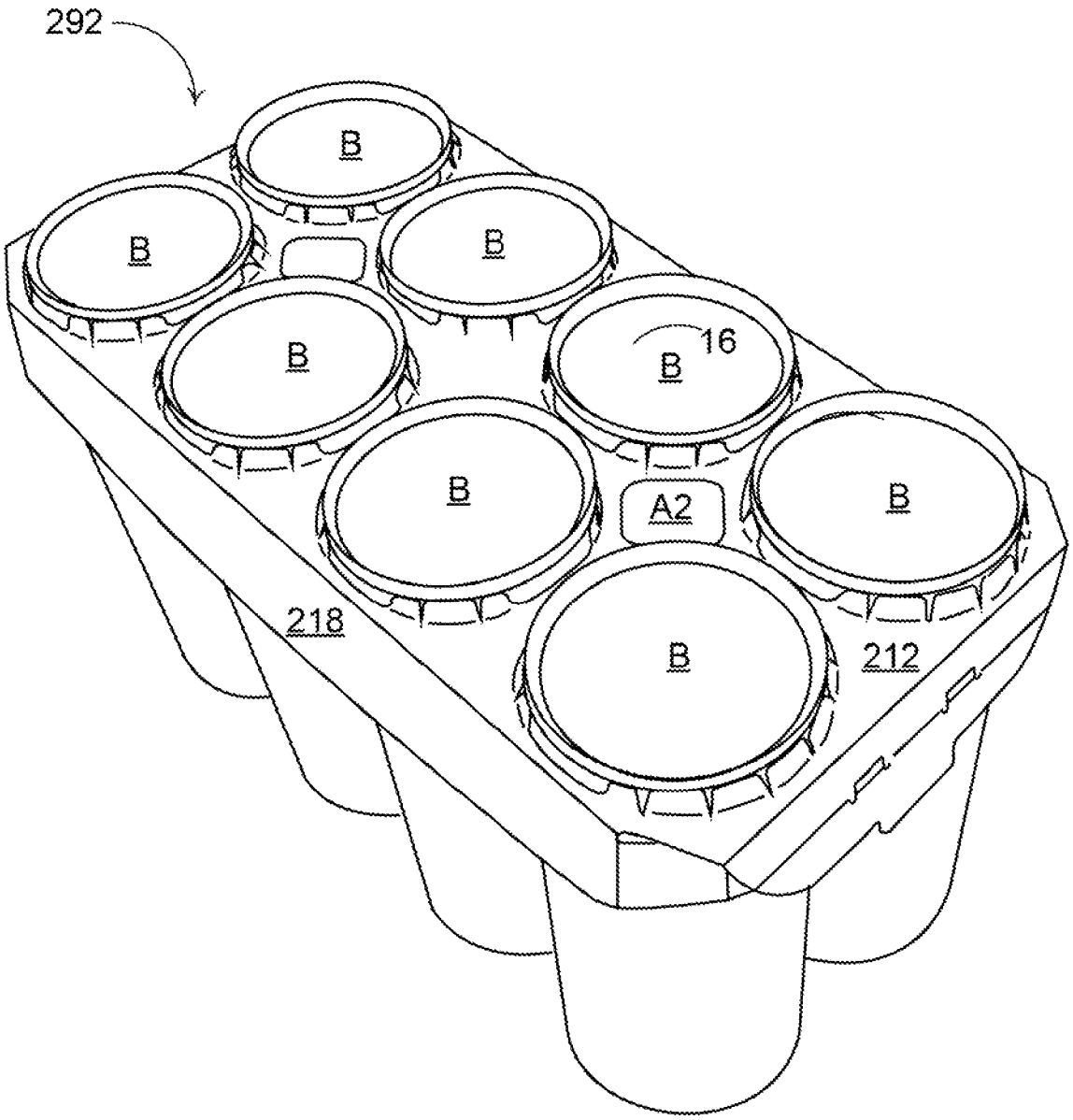
FIGS. 8 and 9 illustrate stages of construction of a package from the blanks of FIGS. 6 and 7.

FIG. 6 shows a first blank 210A comprising a plurality of panels 212, 214A, 214B, 216A, 216B, 218, 220, including a main panel (or lower/engaging panel) 212 for forming a top wall or engaging panel of a carrier 290 (see FIG. 8).

A first side panel 218 is hingedly connected to a first side of the main panel 212 by a hinged connection in the form of a fold line 217.

A second side panel 220 is hingedly connected to a second side of the main panel 212 by a hinged connection in the form of a fold line 219.

The first blank 210A comprises a first end structure. The first end structure comprises a first upper end panel 214A hingedly connected to a first end of the main panel 212 by a hinged connection in the form of a fold line 213A. A first lower end panel 214B is hingedly connected to the first upper end panel 214A by a hinged connection in the form of a fold line 213B.

The first end structure comprises a first corner panel 260A hingedly connected to a first end of the first side panel 218 by a hinged connection in the form of a fold line 261A. A second corner panel 260B is hingedly connected to a first end of the second side panel 220 by a hinged connection in the form of a fold line 261B.

The first end structure comprises a first securing panel 264A hingedly connected to the first corner panel 260A by a hinged connection in the form of a fold line 263A. A second securing panel 264B is hingedly connected to the second corner panel 260B by a hinged connection in the form of a fold line 263B.

A first web panel 268A is hingedly connected at one end to the first securing panel 264A by a hinged connection in the form of a fold line 269A and is hingedly connected at a second end to the first upper end panel 214A by a hinged connection in the form of a fold line 271A.

A second web panel 268B is hingedly connected at one end to the second securing panel 264B by a hinged connection in the form of a fold line 269B and is hingedly connected at a second end to the first upper end panel 214A by a hinged connection in the form of a fold line 271B.

The first blank 210A comprises a second end structure. The second end structure comprises a second upper end panel 216A hingedly connected to a second end of the main panel 212 by a hinged connection in the form of a fold line 215A. A second lower end panel 216B is hingedly connected to the second upper end panel 216A by a hinged connection in the form of a fold line 215B.

The second end structure comprises a third corner panel 262A hingedly connected to a second end of the first side panel 218 by a hinged connection in the form of a fold line 265A. A fourth corner panel 262B is hingedly connected to a second end of the second side panel 220 by a hinged connection in the form of a fold line 265B.

The first end structure comprises a third securing panel 266A hingedly connected to the third corner panel 262A by a hinged connection in the form of a fold line 267A. A fourth securing panel 266B is hingedly connected to the fourth corner panel 262B by a hinged connection in the form of a fold line 267B.

A third web panel 270A is hingedly connected at one end to the third securing panel 266A by a hinged connection in the form of a fold line 273A and is hingedly connected at a second end to the second upper end panel 216A by a hinged connection in the form of a fold line 275A.

A fourth web panel 270B is hingedly connected at one end to the fourth securing panel 266B by a hinged connection in the form of a fold line 273B and is hingedly connected at a second end to the second upper end panel 216A by a hinged connection in the form of a fold line 275B.

It will be appreciated that the first side panel 218, the first corner panel 260A, the first securing panel 264A, the third corner panel 262A, and the third securing panel 266A form a first strap 264A/260A/218/262A/266A along a first side of the main panel 212. The second side panel 220, the second corner panel 260B, the second securing panel 264B, the fourth corner panel 262B, and the fourth securing panel 266B form a second strap 264B/260B/220/262B/266B along a second side of the main panel 212.

The first blank 210A comprises first flap 272 hingedly connected to the first lower end panel 214B by a hinged connection. The hinged connection is defined, at least in part, by a cut line V1. Cut line V1 defines a tab P1 extending from an outer or lower edge of the first lower end panel 214B. The cut line V1 forms a receiver, in the form of an opening, slot or slit, for receiving a locking tab or detent D1. Each of the first and second securing panels 264A, 264B comprises a locking tab or detent D1 extending from a lower edge thereof.

The first flap 272 may comprise a pair of wing portions 274A, 274B hingedly connected by a respective fold line 277A, 277B to a central portion of the first flap 272. The fold lines 277A, 277B may be divergently arranged with respect to each other, the fold lines 277A, 277B diverge towards the first lower end panel 2146.

Each of the first and second securing panels 264A, 264B comprises a cutaway in the form of an aperture A9. Each aperture A9 forms a second receiver for receiving a respective second locking tab or detent D2. The first upper end panel 214A comprises a pair of cut lines 201, each of which is substantially "U" shaped, each cut line 201 defines a respective detent D2.

The first blank 210A comprises second flap 276 hingedly connected to the second lower end panel 2166 by a hinged connection. The hinged connection is defined, at least in part, by a cut line V2. Cut line V2 defines a second tab P2 extending from an outer or lower edge of the second lower end panel 216B. The cut line V2 forms a receiver, in the form of an opening, slot or slit, for receiving a locking tab or detent D2. Each of the third and fourth securing panels 266A, 266B comprises a locking tab or detent D2 extending from a lower edge thereof.

The second flap 276 may comprise a pair of wing portions 278A, 278B hingedly connected by a respective fold line 278A, 278B to a central portion of the second flap 276. The fold lines 279A, 279B may be divergently arranged with respect to each other, the fold lines 279A, 279B diverge towards the second lower end panel 216B.

Each of the third and fourth securing panels 266A, 266B comprises a cutaway in the form of an aperture A9. Each aperture A5 forms a second receiver for receiving a respective second locking tab or detent D2. The second upper end panel 216A comprises a pair of cut lines 201, each of which is substantially "U" shaped, each cut line 201 defines a respective detent D2.

The main panel 212 comprises at least one article retention structure RT1, RT2. The main panel 212 comprises a plurality of article retention structures RT1, RT2, specifically eight article retention structures RT1, RT2 arranged in 2×4 matrix or array. Each of the article retention structures RT1, RT2 comprises an opening or aperture A7, A8.

The article retention structures RT1, RT2 of the illustrated embodiment take the form of a plurality of teeth or tabs 244, 246 arranged in an annular series about an aperture A7, A8 to form part of an article receiving opening.

The first blank 210A comprises four first or endmost article retention structures RT1 each comprising a first opening or aperture A7. The first blank 210A comprises four second, medial or intermediate article retention structures RT2 each comprising a second opening or aperture A8.

The endmost article retention structures RT1 comprises an article receiving opening defined in part by the first aperture A7 which is defined in, or struck from, the main panel 212.

The intermediate article retention structures RT2 comprises an article receiving opening defined in part by the second aperture A8 which is defined in, or struck from, the main panel 212.

The endmost article retention structures RT1 and the intermediate article retention structures RT2 each comprise a plurality of teeth or tabs 244, 246 disposed about the first or second aperture A7, A8 respectively.

The plurality of teeth 244, 246 are provided by the main panel 212. Each of the teeth 244, 246 is hingedly connected to the main panel 212, by a hinged connection. The hinged connection may be defined by a plurality of cut lines 251, 253. The plurality of cut lines 251, 253 may be arranged as an annular series of cuts about the first or second apertures A7, A8. The plurality of cut lines 251, 253 may define or approximate a portion of circle.

Each of the first article retention structures RT1 is substantially similar in construction and will therefore be described in detail with reference to a first one of the first article retention structures RT1 located adjacent to a first end of the first blank 210A as shown in FIG. 6.

The first article retention structure RT1 comprises a plurality of first or full teeth 244 disposed about the aperture A1. Each of the plurality of first teeth 244 comprises an engaging edge E1 opposing a hinged edge. The engaging edges E1 are defined by a linear portion of a cut line defining the aperture A7. Each engaging edge E1 defines a part of a hexadecagon. The illustrated embodiment comprises six first teeth 244 together defining a portion of a hexadecagon. Each tooth 244 comprises a pair of side edges, the side edges are defined by cut lines 241, 243 extending radially outward from respective vertices of the hexadecagon. That is to say from a respective vertex between a pair of adjacent linear portions of the cut line defining the aperture A7. The cut lines 241, 243 are divergently arranged with respect to each other and define an angle therebetween, the angle may be about 22.5°.

The first article retention structure RT1 comprises a plurality of first circumferential cut lines 251. Each of the plurality of first circumferential cut lines 251 is aligned with one of the radial cut lines 241, 243 such that said one of the radial cut lines 241, 243 or a notional extension thereof bisects a respective one of the plurality of first circumferential cut lines 251.

Each of the plurality of first circumferential cut lines 251 is spaced apart from said one of the radial cut lines 241, 243 bisecting it so as to define a connecting nick or bridge portion between a pair of adjacently disposed teeth 244, 246.

Each of the plurality of first circumferential cut lines 251 may be linear in shape.

The first article retention structure RT1 comprises a plurality of second circumferential cut lines 253. Each of the plurality of second circumferential cut lines 253 is disposed between a pair of the plurality of first circumferential cut lines 251 and is spaced apart therefrom so as to define a pair of connecting nick or bridge portions between each tooth 244, 246 and the main panel 212. The pair of connecting nick or bridge portions provide a hinged or foldable connection between each tooth 244, 246 and the main panel 212.

Each of the plurality of second circumferential cut lines 253 may be linear in shape.

In alternative embodiments, each of the plurality of first circumferential cut lines 251 may be arcuate or curved. The first circumferential cut lines 251 may comprise a radius of curvature which is equal to half the diameter of the article receiving openings. The first circumferential cut lines 251 may comprise a radius of curvature which is greater than half the diameter of the apertures A7.

In alternative embodiments, each of the plurality of second circumferential cut lines 253 may be arcuate or curved. The second circumferential cut lines 253 may comprise a radius of curvature which is equal to half the diameter of the article receiving openings. The second circumferential cut lines 253 may comprise a radius of curvature which is greater than half the diameter of the aperture A7.

The first and second circumferential cut lines 251, 253 when linear may be considered to define portions of a circle of infinite radius.

In the illustrated embodiment, the radius of curvature of each of the plurality of second circumferential cut lines 253 is equal to the radius of curvature of each of the plurality of first circumferential cut lines 251 however in other embodiments it may be different.

Optionally, the plurality of teeth 244, 246 is interrupted by a first recess or cutaway C2. The first recess C2 lies upon a first notional line y-y. First notional line y-y extends radially from the centre C of the apertures A7, A8 and passes through the centre of the first recess C2. The first notional line y-y may extend across the grain of the first blank 210A. The first notional line y-y is oriented perpendicularly with respect to the grain direction. The first notional line y-y extends longitudinally of the first blank 210A.

Optionally, the plurality of teeth 244, 246 is interrupted by a second recess or cutaway C3. The second recess C3 lies upon a second notional line x-x. Second notional line x-x extends radially from the centre C of the apertures A7, A8 and passes through the centre of the second recess C3. The second notional line x-x may extend along the grain of the first blank 210A. The notional line x-x is oriented parallel with respect to the grain direction. The notional line x-x extends transversely, or laterally, of the first blank 210A.

Optionally, the plurality of teeth 244, 246 is interrupted by a third recess or cutaway C4. The third recess C4 lies upon the second notional line x-x.

The first recess C2 is dimensioned so as to occupy a first arc defined by a first minor sector. The first minor sector is defined in part by a first sector notional line extending radially from the centre C of the notional circle and passing through a side edge of a first partial tooth 246 disposed adjacent a first side of the first recess C2 and in part by a second sector notional line extending radially from the centre C of the notional circle and passing through a side edge of a second partial tooth 246 disposed adjacent a second, opposing, side of the first recess C2. The first and second sector notional lines define a second angle therebetween. The second angle may be in the range 35° to 50°, and may be around 45°.

The second recess C3 is dimensioned so as to occupy a second arc defined by a second minor sector. The second minor sector is defined in part by a third sector notional line extending radially from the centre C of the notional circle and passing through a side edge of a third partial tooth 246 disposed adjacent a first side of the second recess C3 and in part by a fourth sector notional line extending radially from the centre C of the notional circle and passing through a side edge of a fourth partial tooth 246 disposed adjacent a second, opposing, side of the second recess C3. The third and fourth sector notional lines define a third angle therebetween. The third angle may be in the range 35° to 50°, and may be around 45°.

The third recess C4 is dimensioned so as to occupy a third arc defined by a third minor sector. The third minor sector is defined in part by a fifth sector notional line extending radially from the centre C of the notional circle and passing through a side edge of a fifth partial tooth 246 disposed adjacent a first side of the third recess C4 and in part by a sixth sector notional line extending radially from the centre C of the notional circle and passing through a side edge of a sixth partial tooth 246 disposed adjacent a second, opposing, side of the third recess C4. The third and fourth sector notional lines define a third angle therebetween. The third angle may be in the range 35° to 50°, and may be around 45°.

The second and third recesses C3, C4 are diametrically opposed to each other.

The third and fifth sector notional lines define a major or first toothed sector, the first toothed sector defines a fourth arc; the fourth arc is occupied by teeth 244, 246. That is to say teeth 244, 246 are disposed about the third arc, in a perimeter region of the first aperture A7.

The first and fourth sector notional lines define a fourth minor sector or second toothed sector, the second toothed sector defines a fifth arc; the fifth arc is occupied by teeth 244, 246. That is to say teeth 244, 246 are disposed about the fifth arc, in a perimeter region of the first aperture A7.

The second and sixth sector notional lines define a fifth minor sector or third toothed sector, the third toothed sector defines a sixth arc; the sixth arc is occupied by teeth 244, 246. That is to say teeth 244, 246 are disposed about the sixth arc, in a perimeter region of the first aperture A7.

The first article retention structure RT1 comprises a first engaging tab 248 opposing the first recess C2.

The first engaging tab 248 is disposed proximate the first or second upper end panel 214A, 216A. The first engaging tab 248 is integral with the main panel 212, that is to say the first and second circumferential cut lines 251, 253 have been omitted. The first engaging tab 248 is proximate to the fold line 213A, 215A hinging the main panel to the respective upper end panel 214A, 216A.

Figure 10:
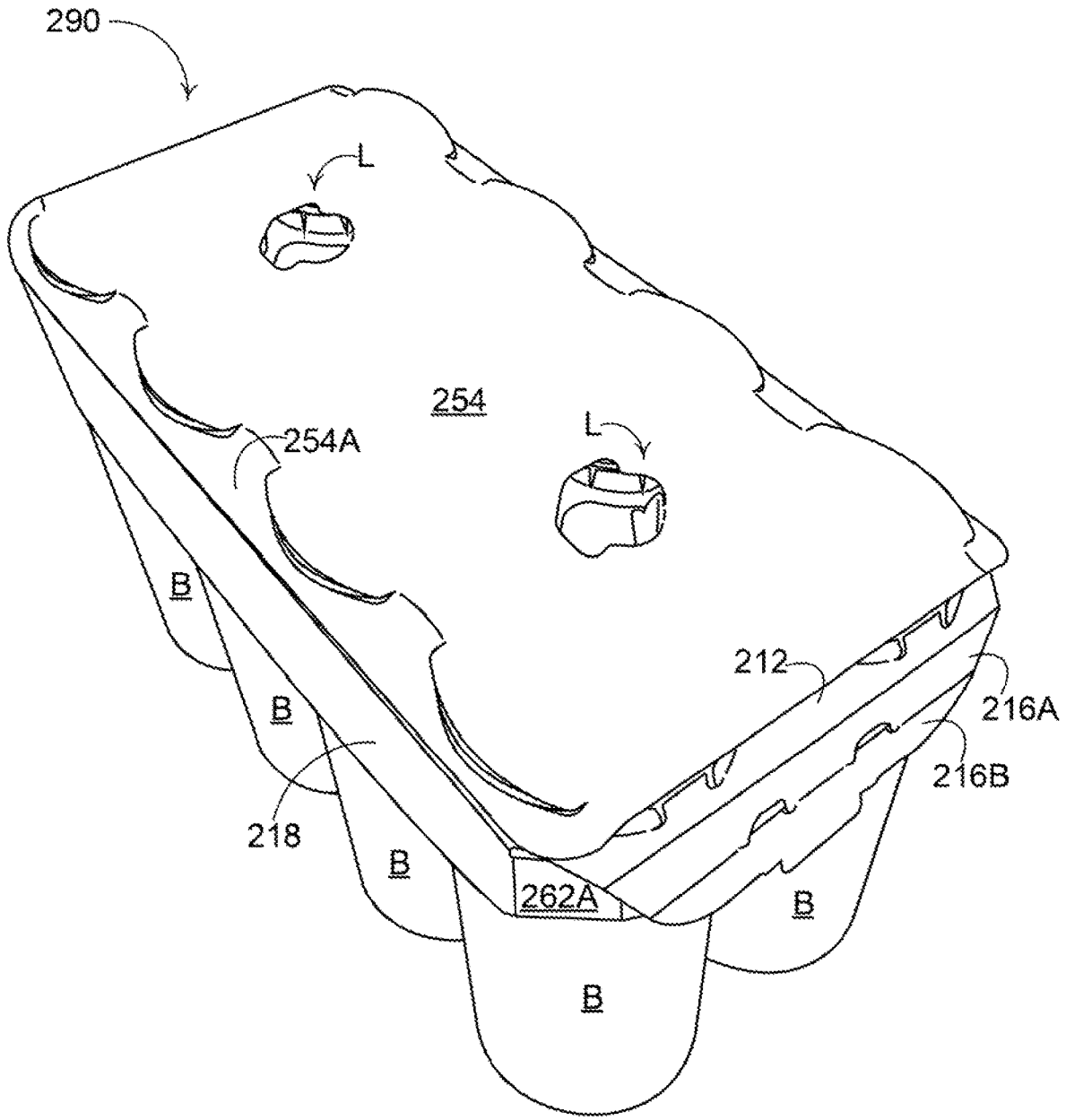
FIG. 10 is a perspective view from above of a carrier formed from the blanks of FIGS. 6 and 7.

Each of the second article retention structures RT2 is substantially similar in construction and will therefore be described in detail with reference to a first one of the second article retention structures RT2 located adjacent to the first one of the first article retention structures RT1 as shown in FIG. 10.

The second article retention structure RT2 comprises an article receiving opening defined in part by a second aperture A8.

The second article retention structure RT2 comprises a plurality of teeth 244, 246 disposed about the second aperture A8. The plurality of teeth 244, 246, or at least free edges thereof, may define, or approximate, a second notional circle.

The plurality of teeth 244, 246 are hinged to the main panel 212 by a fold line. The fold line may be defined by a plurality of cut lines 251, 253. The plurality of cut lines 251, 253 may define or approximate a circle.

The second article retention structure RT2 is substantially similar in construction to the first article retention structure RT1, albeit the first engaging tab 248 has been replaced with a fourth recess C1. The first and fourth recesses C2, C1 are diametrically opposed to each other.

The second and third recesses C3, C4 are diametrically opposed to each other.

The second and third recesses C3, C4 are oriented or disposed substantially orthogonally to the first and fourth recesses C2, C1.

The centre of the first and fourth recesses C2, C1 of the second article retention structure RT2 are collinear with the centre of the first recess C2 of the first article retention structure RT1.

The fourth recess C1 of the second article retention structure RT2 is disposed proximate to the first recess C1 of the first article retention structure RT1 and is oriented in opposition thereto.

Each of the second recesses C3 of the second article retention structures RT2 is disposed proximate to a second recess C3 of an adjacently disposed second article retention structures RT2, and is oriented in opposition thereto.

Each of the second recesses C3 of the first article retention structures RT1 is disposed proximate to a second recess C3 of an adjacently disposed first article retention structures RT1, and is oriented in opposition thereto.

The grain of the material forming the first blank 210A may be arranged to be tangential to the centre of the first and fourth recesses C2, C1 of the second article retention structure RT2. The grain of the material forming the first blank 210A may be arranged to be tangential to the centre of the first recess C2 of the first article retention structure RT1. In this way in order for a tear to propagate between the first aperture A7 and the second aperture A8 the tear must propagate across the grain of the first blank 210A. In this way the first blank 210A is arranged to provide maximum resistance to tear propagation between the first and second apertures A7, A8.

Removal of the teeth 244, by providing recesses C1, C2, C3, at locations where two adjacent apertures A7, A8 are disposed in close proximity, may be advantageous, for example when packaging articles B of the sleek or slim design, and has been found to reduce the likelihood of tear propagation. Slim design articles B are those which are substantially of the same diameter over their entire height. In some embodiments the variation in diameter between a top closure of the article B and the main body of the article B may be less than 7 mm, may be less than 5 mm and optionally is less than 4 mm. This beneficial advantage may be a result of removal of the radial cut lines 241, 246 in regions of the first blank 210A where the apertures A7, A8 are in close proximity.

The main panel 212 comprises a handle structure. The handle structure may comprise at least one handle opening A2. In the illustrated embodiment, the blank 210A comprises two handle openings A2. Each handle opening A2 is defined in or struck from a region of the main panel 212 disposed centrally between four aperture A7, A8 arranged as two adjacent pairs of apertures A7, A8. A first one of the handle openings A2 is disposed between a first pair of endmost apertures A7 and an adjacent pair of intermediate apertures A8. A second one of the handle openings A2 is disposed between a second pair of endmost apertures A7 and an adjacent pair of intermediate apertures A8. The second pair of endmost apertures A7 being disposed at an opposing end of the main panel 212 to the first pair of endmost apertures A7.

The end structures are folded to secure the first and second side panels 218, 220 about sides of a group of articles B. The blank 210A can be applied to the group of articles B in a flat form and folded thereabout.

The main panel 212 is lowered with respect to a group of articles B. The first and second side panels 218, 220 are folded about opposing sides of the group of articles B. The corner panels 260A, 260B, 262A, 262B are folded about the corners of the group of articles B and the securing panels 264A, 264B, 266A, 266B are folded about ends of the group of articles B.

The first and second upper end panels 214A, 216A are folded downwards about a respective end of the group of articles B. The first and second lower end panels 214B, 116B are folded upwardly with respect to the first and second upper end panels 214A, 216A such that the detents D2 can be inserted into the apertures A9. The first and second lower end panels 214B, 216B are folded downwardly to return to a substantially coplanar relationship with the respective one of the first and second upper end panels 214A, 216A to which they are hinged.

The first and second flaps 272, 276 are folded internally, the wing portions 274A, 274B, 278A, 278B are folded with respect to the central portion so as to pass the side walls of adjacently disposed articles B.

The cut lines V1, V2 form an opening in which the locking tab D1 of each securing panel 264A, 264B, 266A, 266B is received.

The wing portions 274A, 274B, 278A, 278B are folded into coplanar relationship with the central portion of the respective tab 272, 276; in this way the tabs 272, 276 are held in position by the adjacently disposed articles B.

The tabs 272, 276 are held in the folded condition by the articles B and thus inhibit disengagement of the locking tabs D1 from the receiver.

The tabs 272, 276 in the folded condition are in face to face relationship with the portions of the detents D2 received in the apertures A9; and may inhibit disengagement of detents D2 from the apertures A9.

The tabs P1, P2 may conceal or protect the locking tabs D1 so as to improve security of the locking tabs D1 in the receiver.

An article carrier 292 formed from the first blank 210A is shown in FIG. 8.

The third illustrated embodiment comprises a second blank 210B for forming a top cover. Second blank 210B comprises a cover panel 254 having opposed marginal regions 254A, 254B.

A first marginal region is defined at least in part by a first fold line 213A. A second marginal region 213B is defined by a second fold line 257B.

The first fold line 213A is interrupted by a plurality of article receiving structures in the form of slits or cut lines 256A. The slits 256A may be curvilinear in shape and may be substantially 'U' shaped.

The second fold line 213B is interrupted by a plurality of article receiving structures in the form of slits or cut lines 256B. The slits 256B may be curvilinear in shape and may be substantially 'U' shaped.

When the first and second marginal regions 254A, 254B are folded about the first and second fold lines 257A, 257B respectively the slits 256A, 256B open to form an article receiving slot or aperture. An edge of the first and second marginal regions 254A, 254B defined by the slits 256A, 256B provides an engaging edge which engage below a flange, chime or other projection or undercut provided by an article B received in the article receiving slot or aperture formed when the marginal regions 254A, 254B are folded with respect to a medial portion of the cover panel 254.

The cover panel 254 comprises at least one with a locking structure for locking the cover panel 254 to the main panel 212. A locking element L cooperates with the handle openings A2 in the main panel 212 to secure the cover panel 254 thereto.

The handle openings A2 in the main panel 212 form receivers. The illustrated embodiment comprises two receivers.

The locking structure comprises at least one locking element L for being received in the receiver. The locking element L comprises a tab 280 struck from the cover panel 254, the illustrated embodiment comprises two tabs 280 each arranged to be engageable with one of the handle openings A2. Each tab 280 is hinged to the cover panel 254 by a hinged connection 281. Each tab 280 may comprise at least one fold line 283, 285. In the illustrated embodiment, the tab 280 comprises a pair of fold lines 283, 285. The pair of fold lines 283, 285 may be divergently arranged with respect to each other. Each of the pair of fold lines 283, 285 may be non-linear in shape for example but not limited to arcuate or curvilinear in shape.

The nonlinear fold lines 283, 285 may encourage the tab 280 to return to a planar arrangement to increase security of the tab 280 when folded to be received within the receiver.

The tab 280 may be substantially 'arrow head' shaped so as to define a pair of opposing shoulders or detents S (see FIG. 11) for securely engaging the handle opening A2.

Figure 9:
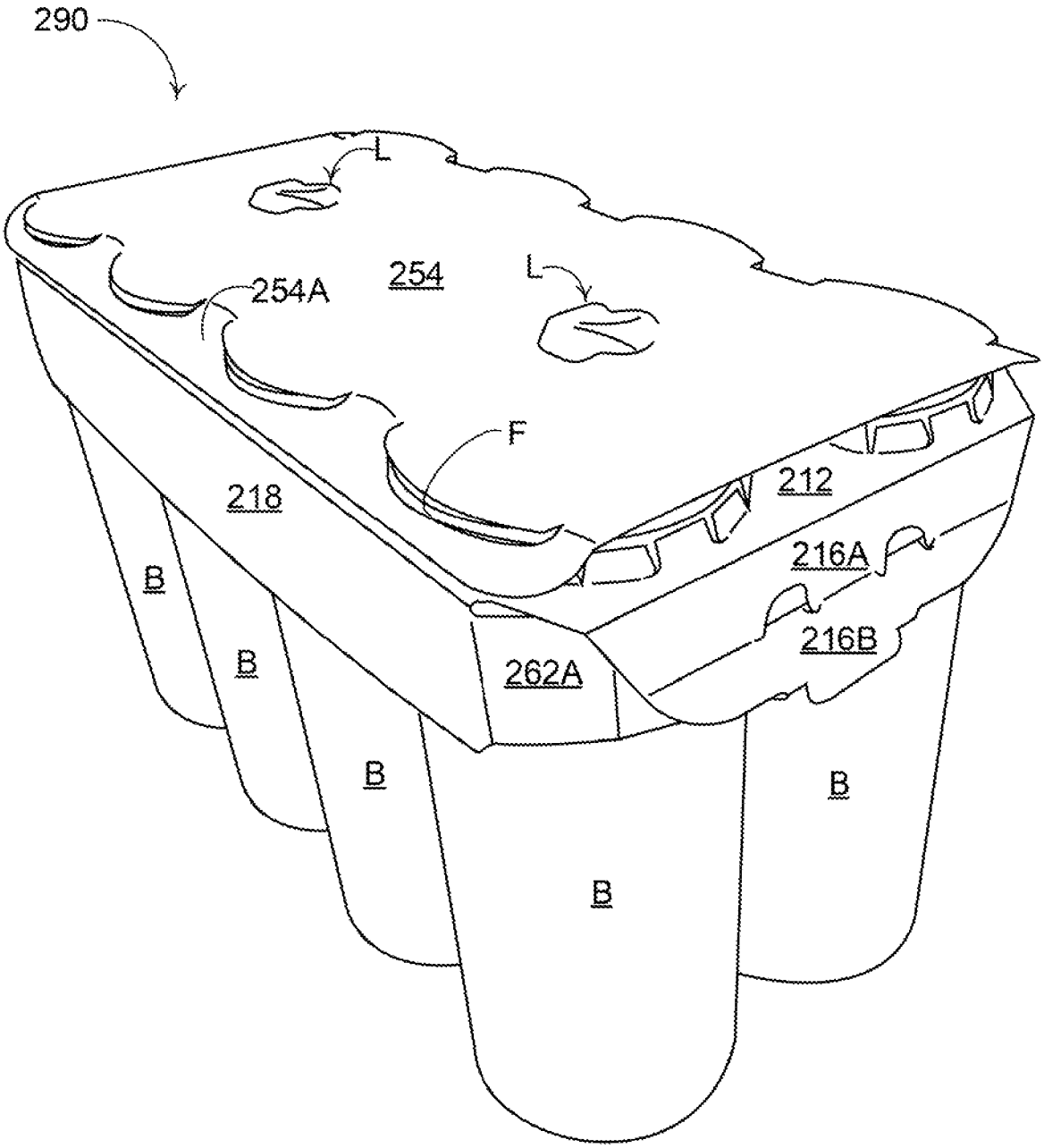

In order to form the package 290 illustrated in FIG. 9 the second blank 210B is lowered over the article carrier 292 shown in FIG. 8. The marginal regions 254A, 254B are folded downwardly about shoulders or necks of the articles B, the slits 256A, 256B open and receive a flange or lip of a respective article B as shown in FIG. 9.

Figure 11:
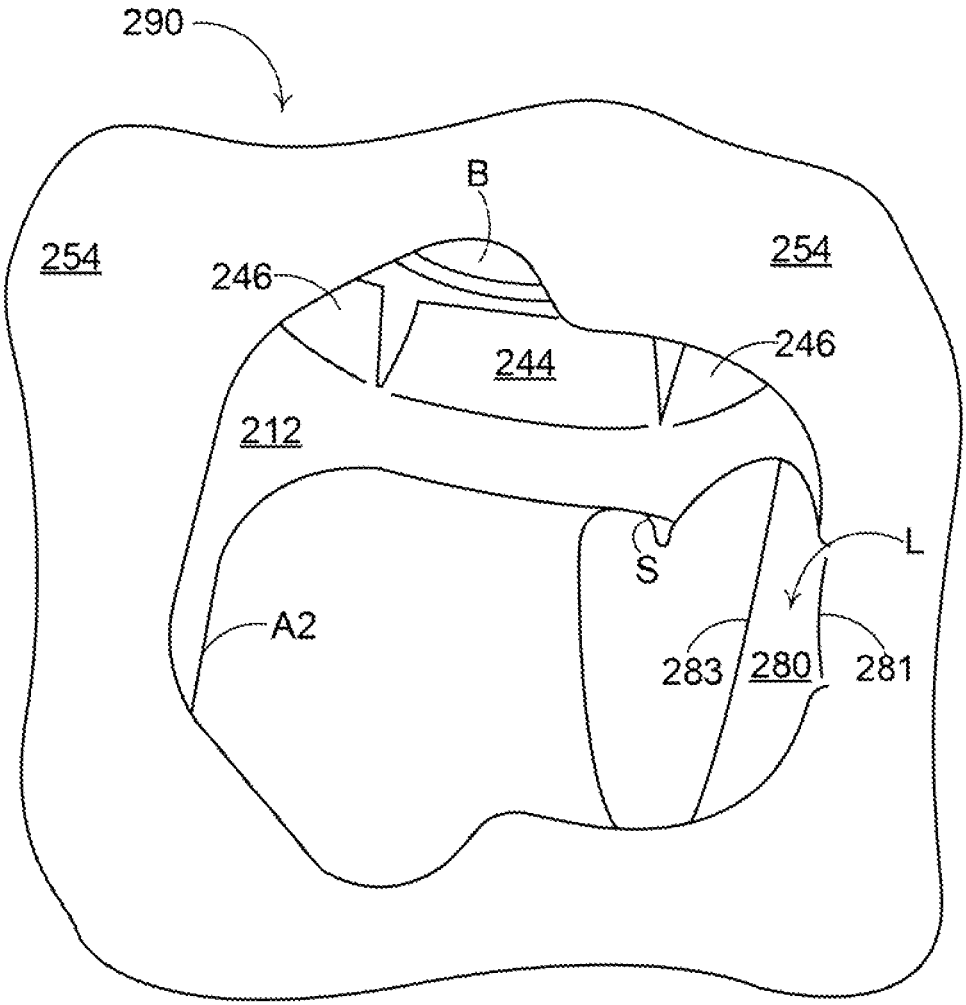
FIG. 11 is a perspective view from above of a portion of the carrier of FIG. 10.

The cover panel 254 is secured to the article carrier 292 by engaging the locking elements L in the receiver provided by the handle opening A2 in the main panel 212, as shown in FIG. 10. FIG. 11 shows enlarged view of the tab 280 engaging the main panel 212 disposed therebelow. The tab 280 extends across a gap or void between the cover panel 254 and the main panel 212. The articles B maintain the cover panel 254 in a spaced apart relationship from the main panel 212. The upper portions of the articles B which pass through the main panel 212 prevent, or at least inhibit, the cover panel 254 from adopting a face contacting relationship with the main panel 212.

Referring now to FIGS. 12A to 20 there are shown further alternative embodiments of the present disclosure. In the fourth and fifth illustrated embodiments, like numerals have, where possible, been used to denote like parts, albeit with the addition of the prefix "300", "400" to indicate that these features belong to the fourth and fifth embodiments. The alternative embodiments share many common features with the embodiments of FIGS. 1 to 11, therefore only the differences from the embodiments illustrated in FIGS. 1 to 11 will be described in any greater detail.

Figure 12A:
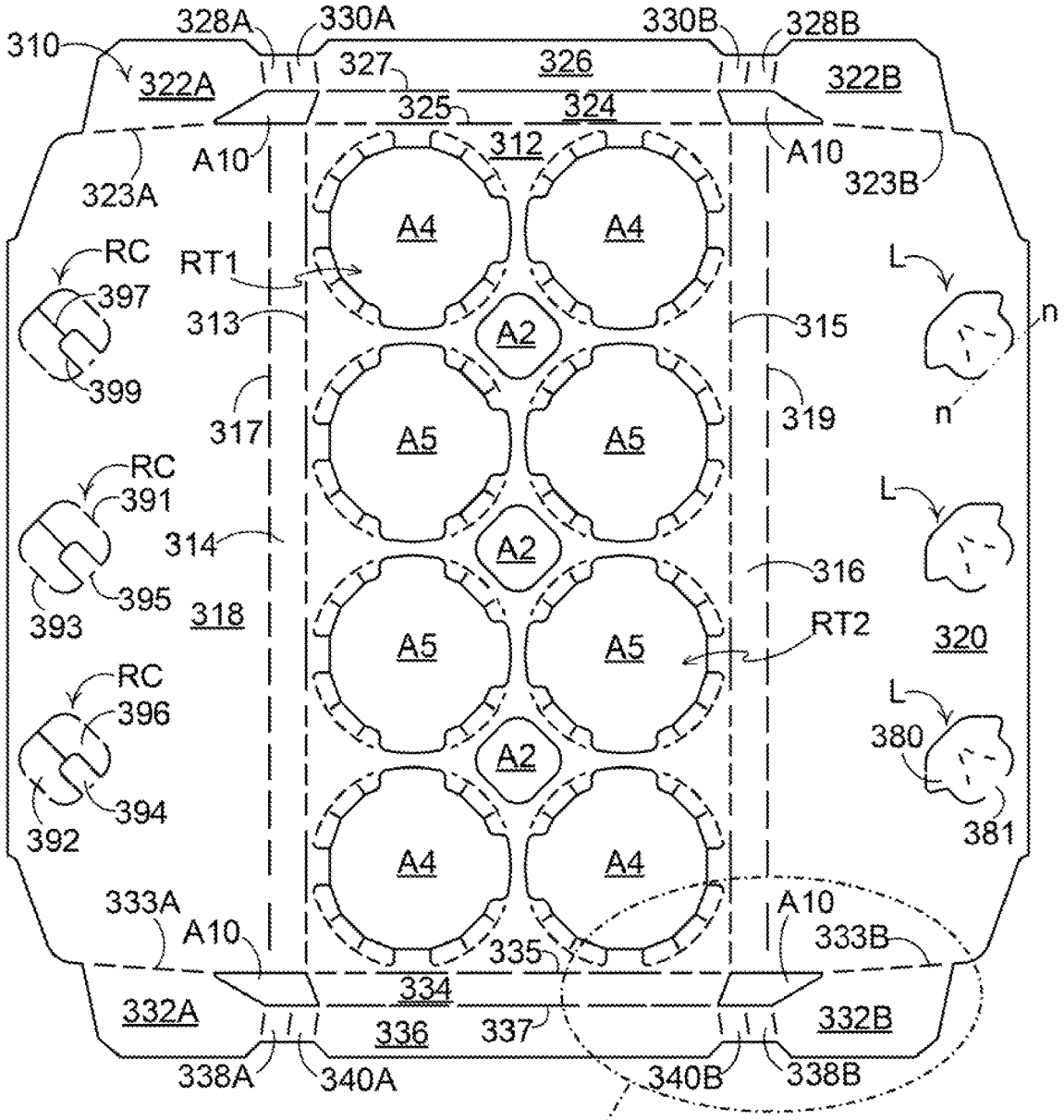
FIG. 12A is a plan view from above of a blank for forming a carrier according to a fourth embodiment.
Figure 18:
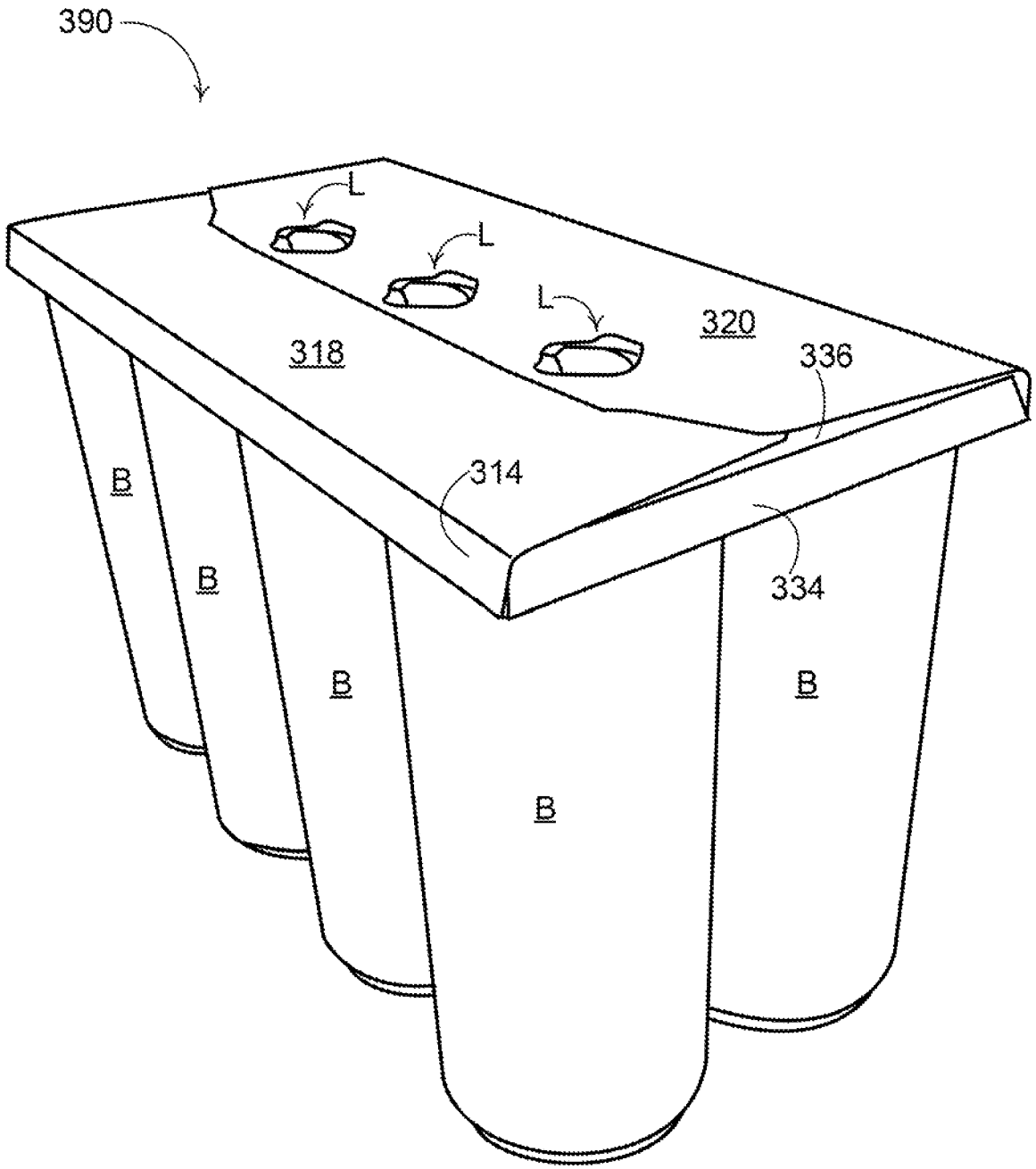
FIG. 18 is a perspective view from above of a carrier formed from the blank of FIG. 12A.

Referring to FIG. 12A there is shown a blank 310 comprising a plurality of panels 312, 314, 316, 318, 320, including a main panel (or lower/engaging panel) 312 for forming a lower wall or engaging panel of a carrier 390 (see FIG. 18).

A first side panel 314 is hingedly connected to a first side of the main panel 312 by a hinged connection in the form of a fold line 313. A first top or cover panel 318 is hingedly connected to the first side panel 314 by a hinged connection in the form of a fold line 317.

A second side panel 316 is hingedly connected to a second side of the main panel 312 by a hinged connection in the form of a fold line 315. A second top or cover panel 320 is hingedly connected to the second side panel 316 by a hinged connection in the form of a fold line 319.

The main panel 312 of the blank 310 includes at least one article retention structure RT1, RT2. The main panel 312 comprises a plurality of article retention structures RT1, RT2, specifically eight article retention structures RT1, RT2 arranged in 2×4 matrix or array. Each of the article retention structures RT1, RT2 comprises an opening or aperture A4, A5. The article retention structures RT1, RT2 are substantially similar to those shown in FIGS. 5A, 5B and 5C and will not be described in further detail.

The main panel 312 comprises a handle structure. The handle structure may comprise at least one handle opening A2. In the illustrated embodiment, the blank 310 comprises three handle openings A2. Each handle opening A2 is defined in or struck from a region of the main panel 312 disposed centrally between four apertures A4, A5 arranged as two adjacent pairs of apertures A4, A5.

The first and second top panels 318, 320 are arranged to be disposed in at least partially overlapping relationship with each other. The overlapping portions of the first and second top panels 318, 320 are provided with a locking structure for locking the first and second top panels 318, 320. The locking structure cooperates with the handle openings in the main panel 312 to secure the first and second top panels 318, 320 to the main panel 312.

The locking structure comprises at least one receiver RC in the form of an opening in the first top panel 318. The first top panel 318 comprises a plurality of openings, more specifically three openings, although in other embodiments one, two or more than three openings may be provided. Each of the openings is arranged to be in vertical registry or alignment with a handle opening A2 provided in the main panel 312. The openings may be defined by at least one tab 392, 394, 396 (also referred to herein as female tabs or receiver tabs). In the illustrated embodiment, the openings are defined by three tabs 392, 394, 396. The openings may be substantially square or diamond shaped, In the illustrated embodiment, the corners of the opening are rounded or filleted. A first tab 396 is hinged to the first top panel 318 by a first hinged connection in the form of a first fold line 391. A second tab 392 is hinged to the first top panel 318 by a second hinged connection in the form of a second fold line 393. The second tab 392 is hinged to the first top panel 318 in opposition to the first tab 396. The first tab 396 is separated in part from the second tab 392 by a first severance line or cut line 397 and in part by a third tab 394. The third tab 394 is defined by a second severance line or cut line 399. The second cut line 399 is substantially 'U' shaped. The third tab 394 is hinged to the first top panel 318 by a third hinged connection in the form of a third fold line 395. The third hinged connection is disposed adjacent to the first and/or second hinged connection, and may be substantially orthogonal thereto. The third tab 394 defines a cutout or recess in each of the first and second tabs 396, 392. The cutout or recess is struck from a free end edge opposing the first and second hinged connections respectively.

The locking structure comprises at least one locking element L for being received in the receiver RC. The locking element L comprises a tab 380 struck from the second top panel 320, the illustrated embodiment comprises three tabs 380 each arranged to be engageable with one of the receiver openings and a respective one of the handle openings A2. Each tab 380 is hinged to the second top panel 320 by a hinged connection 381. Each tab 380 may comprise at least one fold line substantially similar to those of the embodiment of FIG. 1A.

The tab 380 may be substantially 'arrow head' shaped so as to define a pair of opposing shoulders or detents S (see FIG. 19) for securely engaging the handle opening A2 and/or receiver RC.

The first top panel 318, second top panel 320, first and second side panels 314, 316 and main panel 312 form a tubular structure. Each end of the tubular structure is closed by an end closure structure. A first end closure structure comprises a first end panel 324 hingedly connected to a first end of the main panel 312 by a hinged connection in the form of a fold line 325. A first top end flap 326 is hingedly connected to the first end panel 324 by a hinged connection in the form of a fold line 327.

A first anchor flap 322A is hingedly connected to a first end of the first side panel 318 by a hinged connection in the form of a fold line 323A. The first anchor flap 322A is hingedly connected to the first top end flap 326 by a pair of hinged panels 328A, 330A. The pair of hinged panels 328A, 330A form a gusset. A first connecting panel 328A is hingedly connected to the first anchor flap 322A by a hinged connection in the form of a fold line. A second connecting panel 330A is hingedly connected to the first connecting panel 328A by a hinged connection in the form of a fold line. The second connecting panel 330A is hingedly connected to the first top end flap 326 by a hinged connection in the form of a fold line.

A second anchor flap 322B is hingedly connected to a first end of the second side panel 320 by a hinged connection in the form of a fold line 323B. The second anchor flap 322B is hingedly connected to the first top end flap 326 by a pair of hinged panels 328B, 330B forming a second gusset. A third connecting panel 328B is hingedly connected to the second anchor flap 322B by a hinged connection in the form of a fold line. A fourth connecting panel 330B is hingedly connected to the third connecting panel 328B by a hinged connection in the form of a fold line. The fourth connecting panel 330B is hingedly connected to the first top end flap 326 by a hinged connection in the form of a fold line.

The first end panel 324 is separated from each of the first and second anchor flaps 322A, 322B by an aperture A10. The apertures A10 separate each of the pair of hinged panels 328A/330A, 328B/330B from the respective one of the first and second side panels 314, 316.

A second end closure structure comprises a second end panel 334 hingedly connected to a second end of the main panel 312 by a hinged connection in the form of a fold line 335. A second top end flap 336 is hingedly connected to the second end panel 334 by a hinged connection in the form of a fold line 337.

A third anchor flap 332A is hingedly connected to a second end of the first side panel 318 by a hinged connection in the form of a fold line 333A. The third anchor flap 332A is hingedly connected to the second top end flap 336 by a pair of hinged panels 338A, 340A forming a third gusset. A fifth connecting panel 338A is hingedly connected to the third anchor flap 332A by a hinged connection in the form of a fold line. A sixth connecting panel 340A is hingedly connected to the fifth connecting panel 338A by a hinged connection in the form of a fold line. The sixth connecting panel 340A is hingedly connected to the second top end flap 336 by a hinged connection in the form of a fold line.

A fourth anchor flap 332B is hingedly connected to a second end of the second side panel 320 by a hinged connection in the form of a fold line 333B. The fourth anchor flap 332B is hingedly connected to the second top end flap 336 by a pair of hinged panels 338B, 340B forming a fourth gusset. A seventh connecting panel 338B is hingedly connected to the fourth anchor flap 332B by a hinged connection in the form of a fold line 339B (see FIG. 12B). An eighth connecting panel 340B is hingedly connected to the seventh connecting panel 338B by a hinged connection in the form of a fold line 355B. The eighth connecting panel 340B is hingedly connected to the second top end flap 336 by a hinged connection in the form of a fold line 359B.

The second end panel 334 is separated from each of the third and fourth anchor flaps 332A, 332B by an aperture A10. The apertures A10 separate each of the pair of hinged panels 338A/340A, 338B/340B from the respective one of the first and second side panels 314, 316.

Turning to the construction of the carrier 390 from the blank 310, the blank 310 may be formed into an assembled carrier 390, as shown in FIG. 18.

Figure 13:
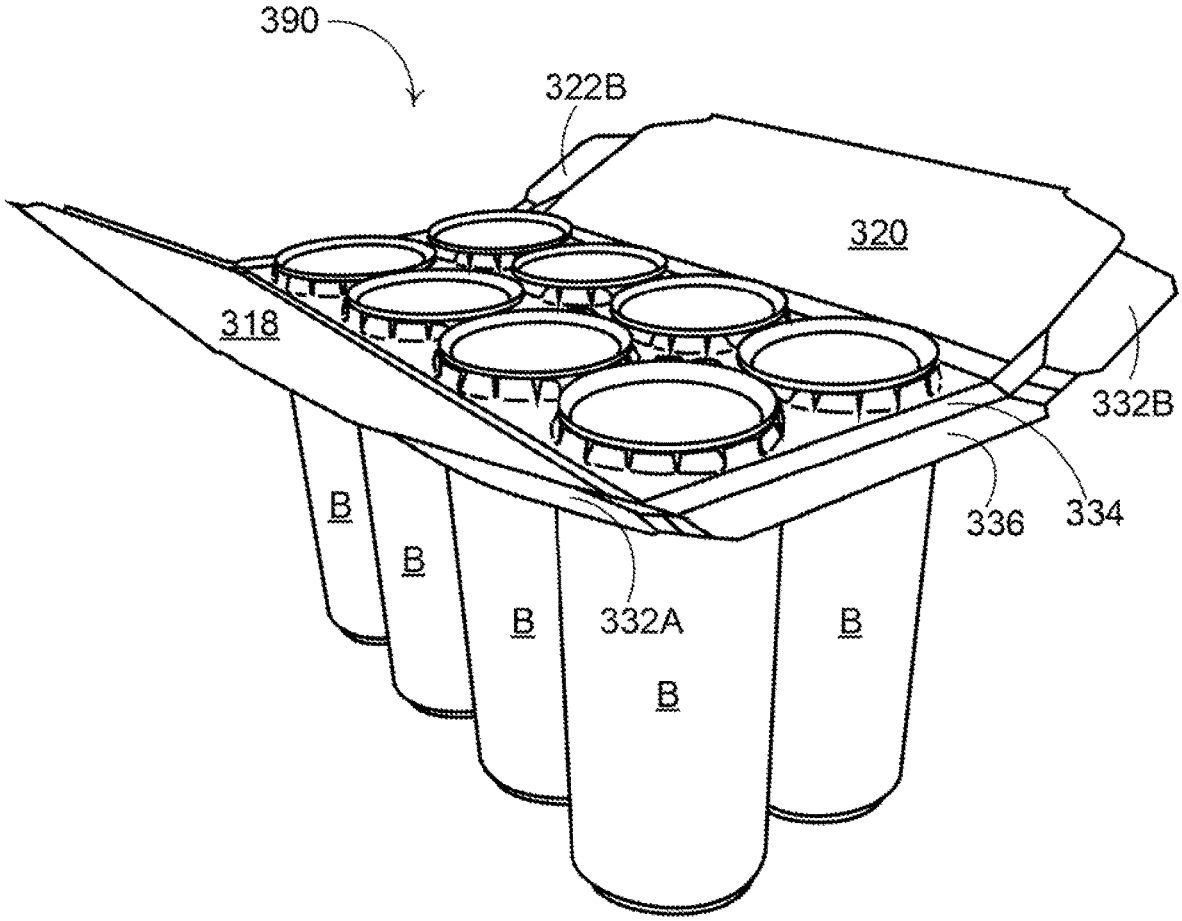
FIGS. 13 to 17 illustrate stages of construction of a carrier from the blank of FIG. 12A.
Figure 14:
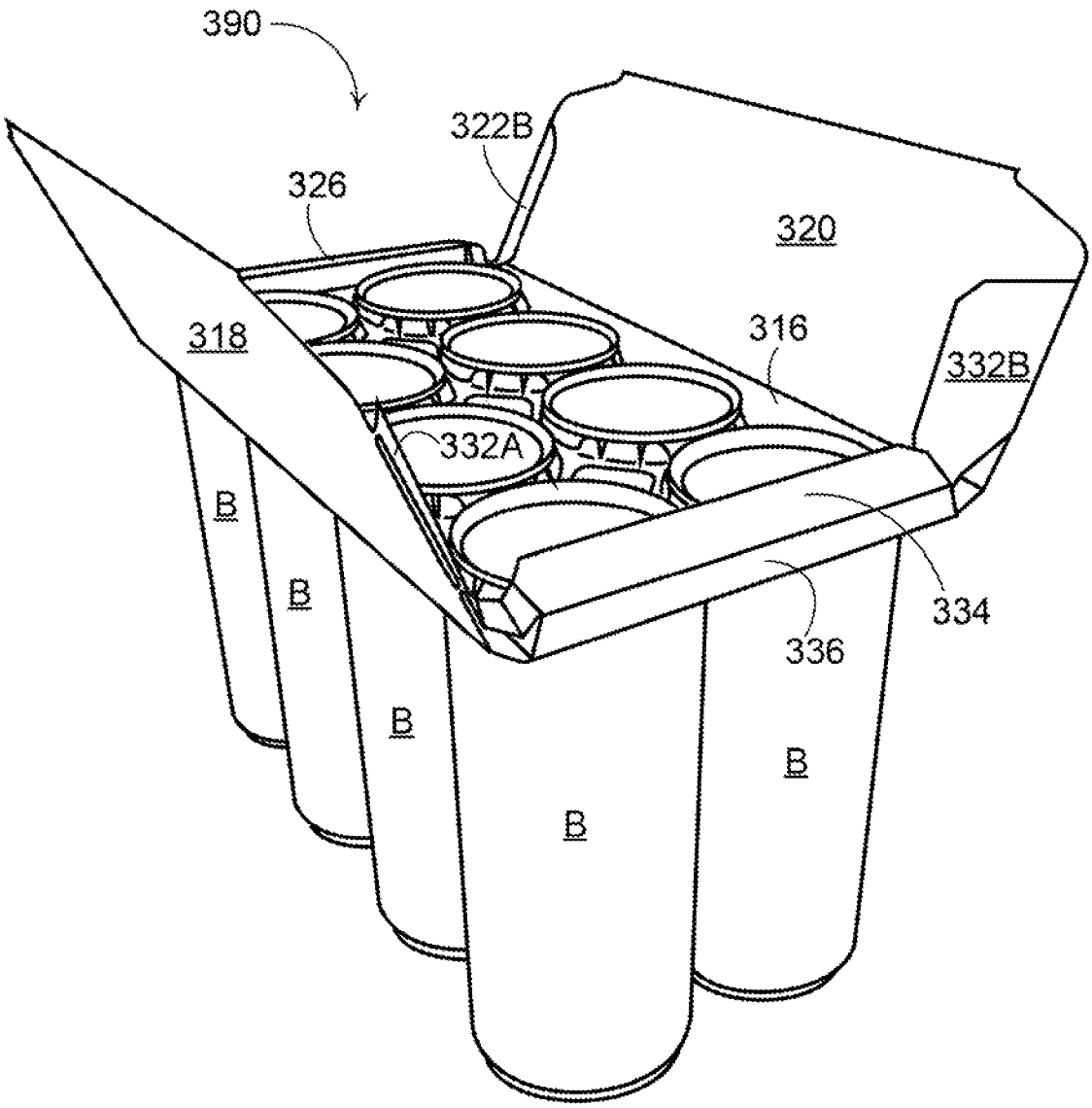
Figure 15:
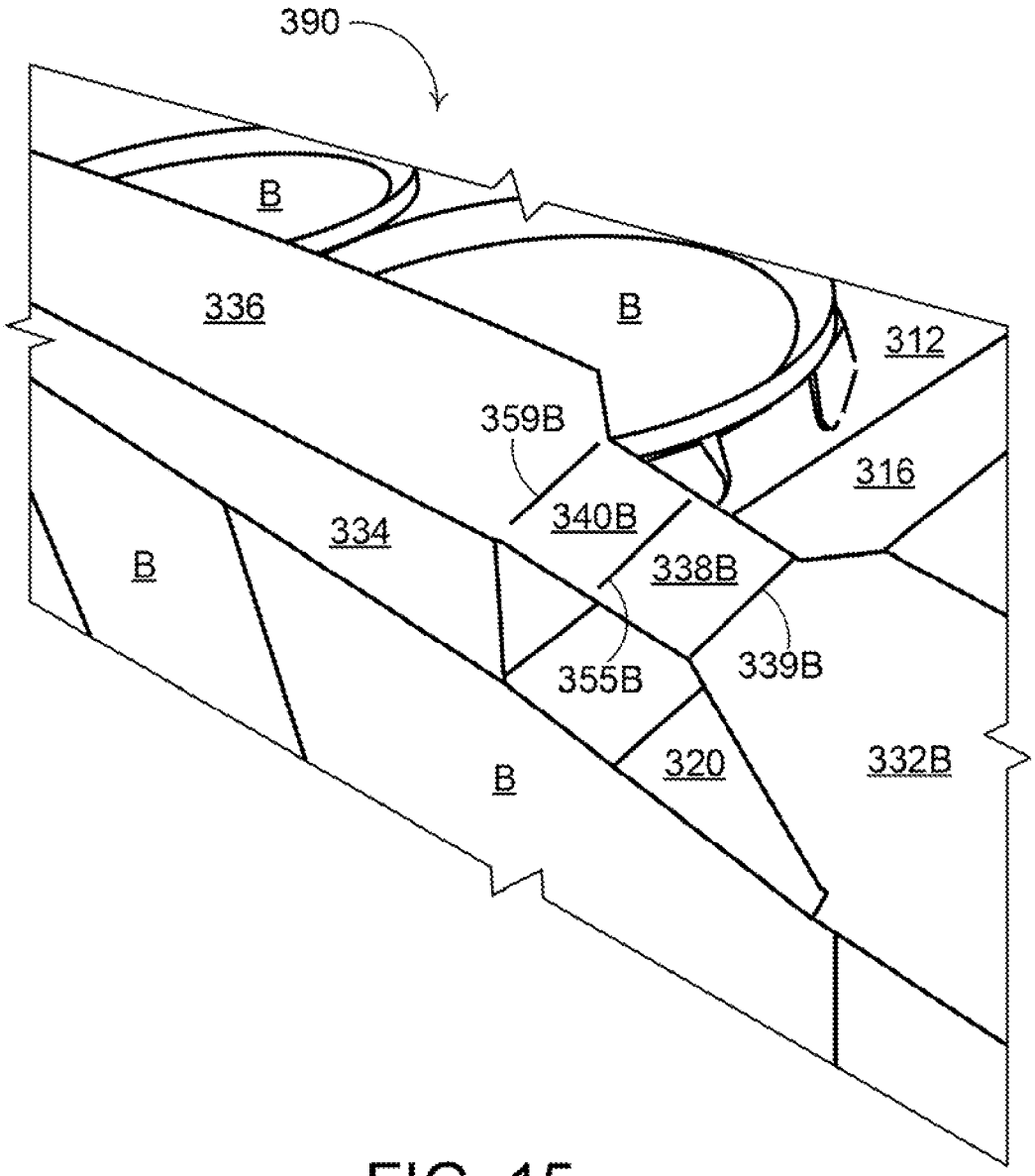
Figure 16:
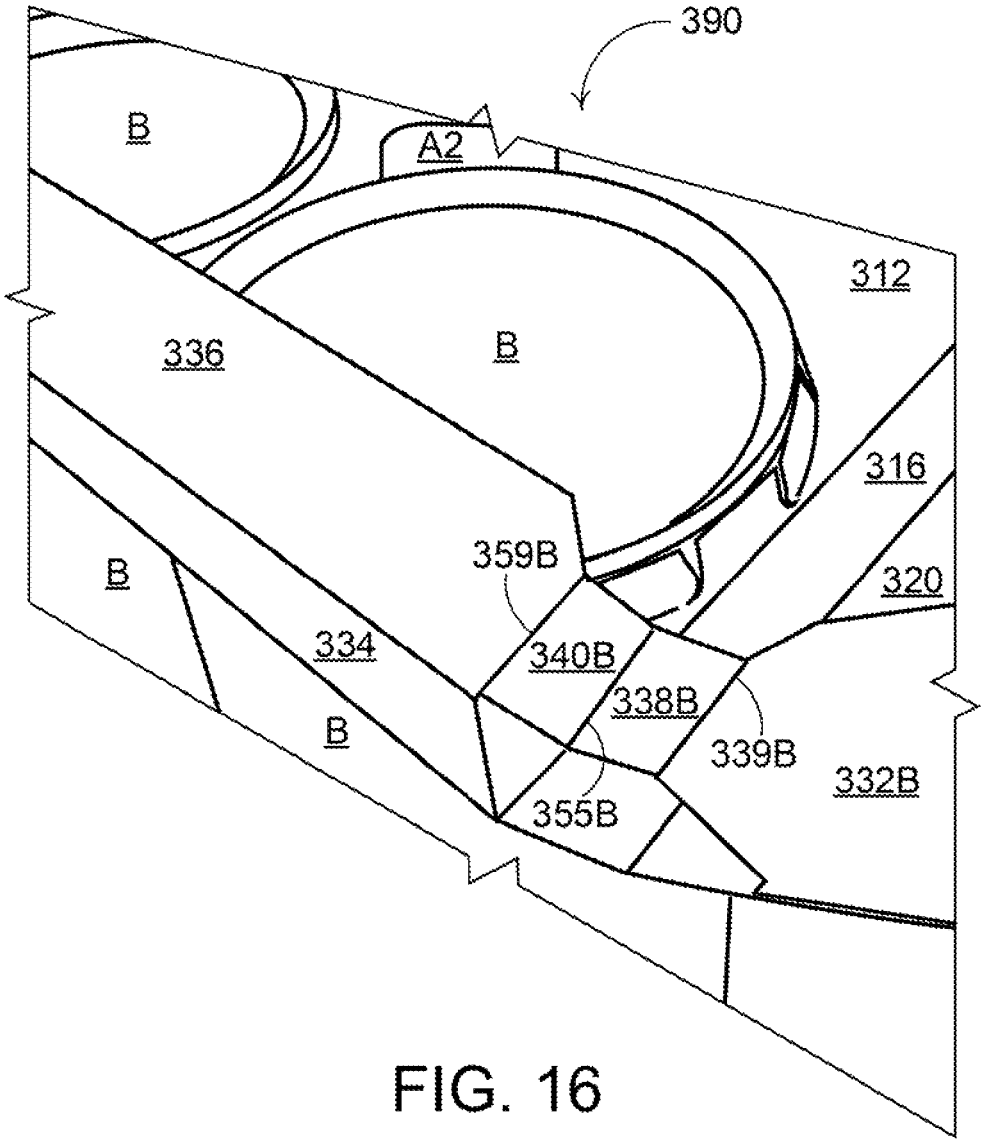
Figure 17:
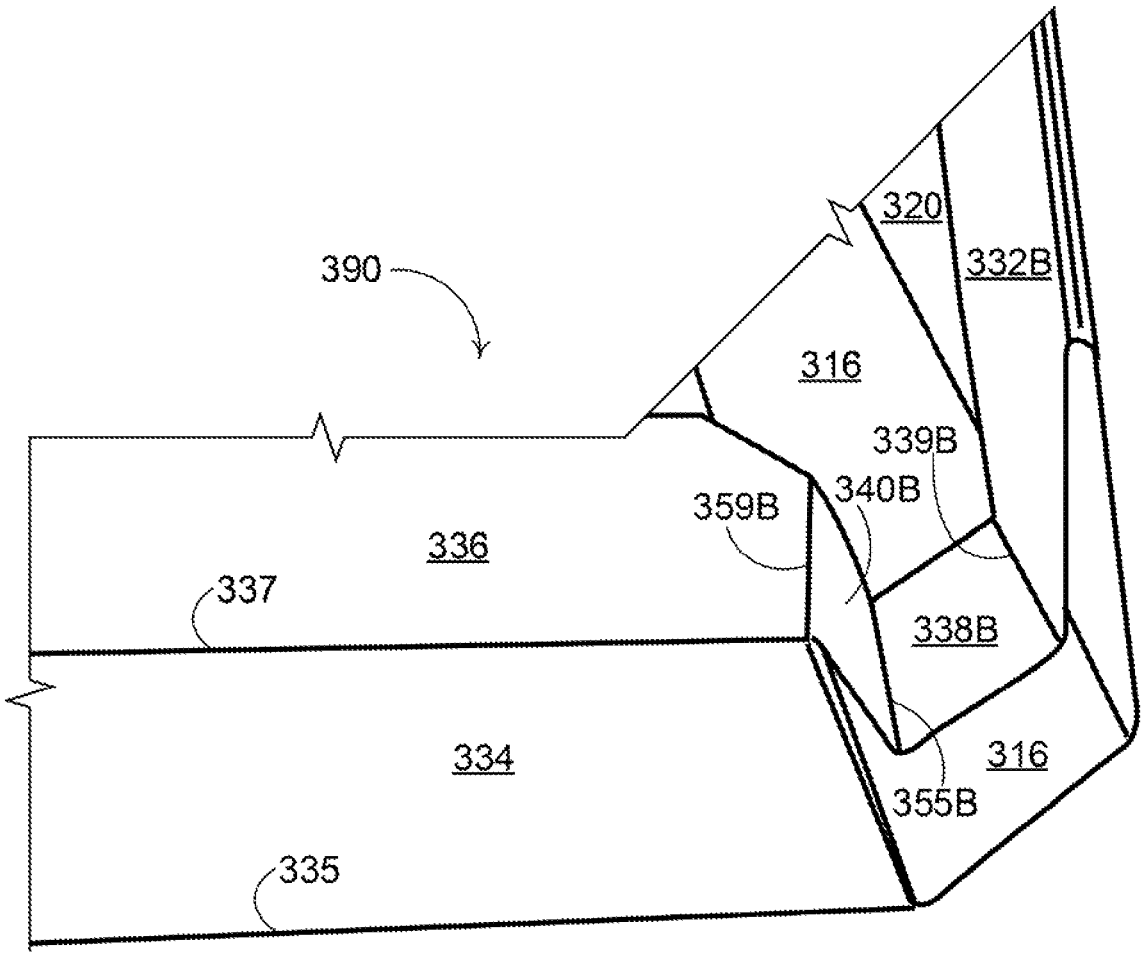

The blank 310 is applied to a group of articles B, as shown in FIG. 13. The blank 310 is lowered with respect to a group of articles B. Each of the article retention structures RT1, RT2 of the blank 310 is aligned with a respective article B in the group. Portions of the articles B pass through the main panel 312. The toothed regions of the main panel 312 about each of the article retention structures RT1, RT2 may be folded out of the plane of the main panel 312.

Each toothed region of the main panel 312 may be folded about one of the articles B received in the respective one of the article retention structures RT1, RT2. The main panel 312 may deform about the article B for example but not limited to a shoulder portion of the article B, where the article B is a can the shoulder portion may be provide by the neck-in, as shown in FIG. 13.

The blank 310 may be partially folded about fold lines 313, 315 to bring the first and second side panels 314, 316 into non-coplanar relationship with the main panel 312, as shown in FIG. 13.

The blank 310 is folded about fold lines 323A, 323B, 333A, 333B to fold the first, second, third and fourth anchor flaps 322A, 322B, 332A, 332B into substantially face to face relationship with the first or second side panels 314, 316 to which they are hinged.

The blank 310 is folded about fold lines 325, 335 to fold the first and second end panels 324, 334 into substantially at least perpendicular relationship with the main panel 312. In some embodiments the first and second end panels 324, 334 may be folded through an angle greater than 90° so as to be inclined.

The blank 310 is folded about fold lines 327, 337 to fold the first and second top end flaps 326, 336 with respect to the respective one of the first and second end panels 324, 334 to which they are hinged.

The first and second top end flaps 326, 336 may be folded over an upper end of an article B or articles B disposed adjacent to the first and second ends of the main panel 312.

The first and second top end flaps 326, 336 may be folded to be substantially parallel to the main panel 312.

The first and second end panels 324, 334 and first and second top end flaps 326, 336 may be folded automatically in response to folding the first, second, third and fourth anchor flaps 322A, 322B, 332A, 332B into substantially face contacting relationship with the respective one of the first and second side panels 314, 316.

The blank 310 is folded about fold lines 313, 315 to bring the first and second side panels 314, 316 into substantially perpendicular relationship with the main panel 312.

The blank 310 is folded about fold line 317 to fold the first top panel 318 over the tops of the articles B. The blank 310 is folded about fold line 319 to fold the second top panel 320 over the tops of the articles B and into overlapping relationship with the first top panel 318 to form a composite top panel 318/320.

The locking tabs 380 are displaced out of the plane of the second top panel 320, downwardly so as to pass through a respective one of the receiver openings. The receiver tabs 392, 394, 396 displaced out of the plane of the first top panel 318 as a consequence.

Figure 19:
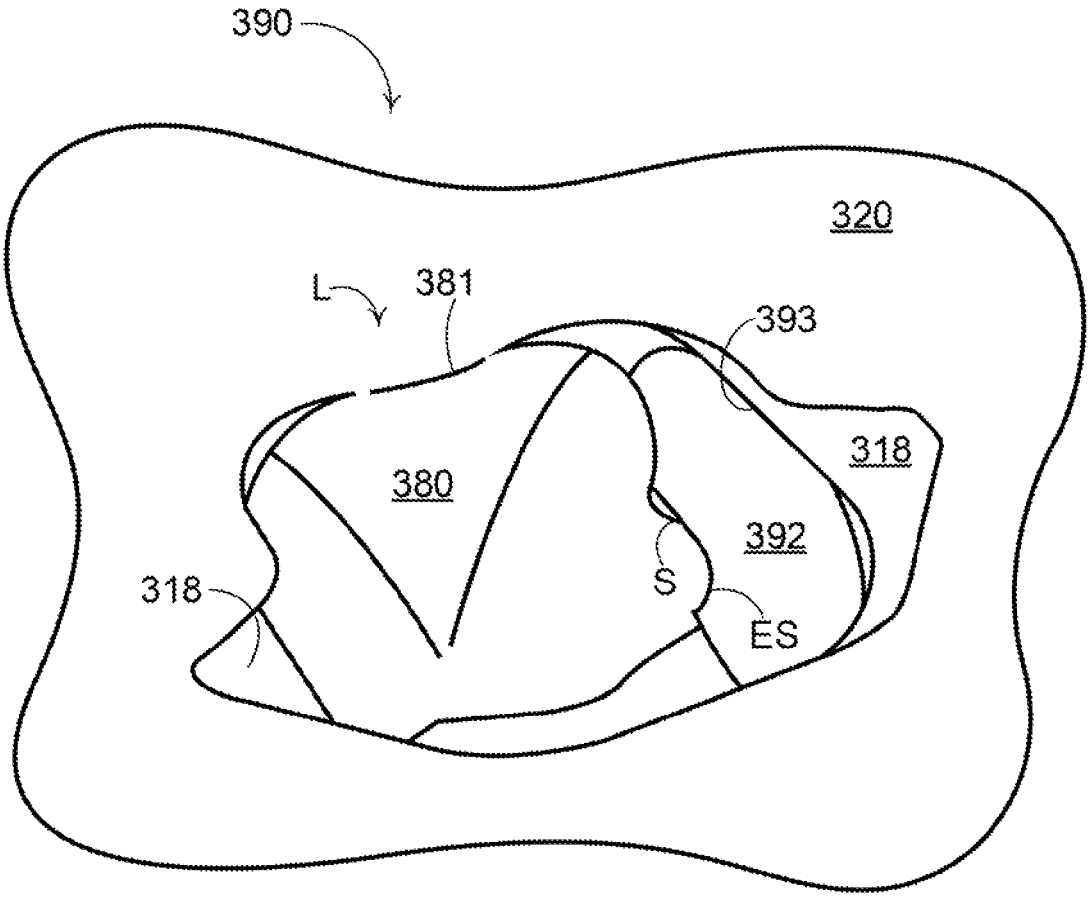
FIG. 19 is a perspective view from above of a portion of the carrier of FIG. 18.

The locking tabs 380 are engaged with the first and second receiver tabs 396, 392, best shown in FIG. 19. Shoulders S of the locking tab 380 may engage not only with the perimeter of the respective handle opening A2 but also with an edge of each of the first and second receiver tabs 396, 392. The shoulders S of the locking tab 380 engage with an edge of each of the first and second receiver tabs 396, 392 defined by a cutaway or recess in the free edge opposing their hinged connections 391, 393 to the first top panel 318.

The recessed edges of the first and second receiver tabs 396, 392 prevent or inhibit disengagement of the locking tabs 380 from the locked condition with the first and second receiver tabs 396, 392.

The locking tabs 380 and the receiver tabs 396, 392 may also serve to function as a spacer between the composite top panel 318/320 and the main panel 312. The locking tabs 380 may engage the main panel 312 along the perimeters of the handle openings A2 and/or the lower surface of the main panel 312 and may thereby serve as tension members for maintaining a spacing between the main panel 312 and the composite top panel 318/320 so as to prevent the spacing from increasing. Additionally, the receiver tabs 396, 392 and/or the locking tabs 380 may engage or abut with the inside or upper surface of the main panel 312 and may thereby brace between the composite top panel 318/320 and the main panel 312 to maintain a spacing therebetween so as to assist in preventing the spacing from decreasing. Thus, at least a portion of the locking tab 380 and/or at least a portion of one or more of the receiver tabs 396, 392 may be disposed between the first top panel 318 and the main panel 312 to maintain a spacing therebetween.

The locking tab 380 may also provide a cushioning tab improving comfort when the package 390 is carried by inserting one or more fingers into the openings in the composite top panel 318/320 and the main panel 312.

The first and second receiver tabs 396, 392 when folded may extend through the handle openings A2.

The locking tabs 380 may also engage with the main panel 312, passing through a respective one of the handle openings A2. The shoulders S of the locking tab 380 may engage with an underside of the main panel 312; the underside being a second side of the main panel 312 opposing a first side through which the locking tab 380 was received.

The third tab 394 may provide a biasing mechanism. The third tab 394 has natural or inherent tendency to return to the unfolded condition. This may provide, or supplement, the resilient bias of the locking tab 380 to return to an unfolded condition. The third tab 394 encourages the locking tabs 380 towards an end stop ES defined by the recessed edge of the first and second receiver tabs 396, 392. The end stop ES inhibit or prevents the locking tab 380 from returning to the unfolded condition.

Figure 20:
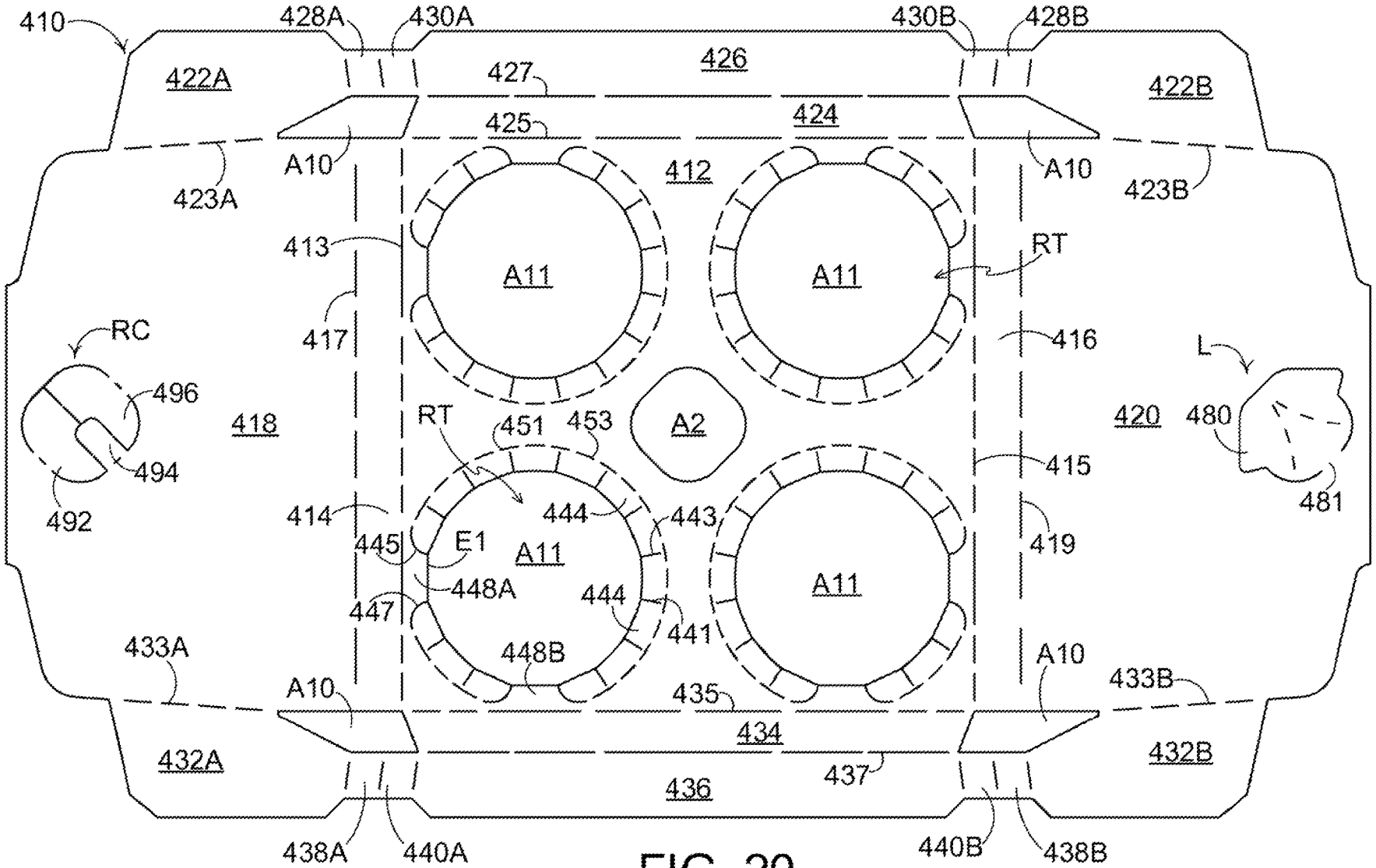
FIG. 20 is a plan view from above of a blank for forming a carrier according to a fifth embodiment.

FIG. 20 illustrates a blank 410 according to a fifth embodiment, the blank 410 comprises a plurality of panels 412, 414, 416, 318, 420, including a main panel (or lower/engaging panel) 412 for forming a lower wall or engaging panel of a carrier (not shown).

The blank 410 is substantially similar in construction to the blank 310 of FIG. 12, albeit adapted to accommodate four articles B rather than eight articles B.

The blank 410 comprises an alternative article retention structure RT. The article retention structures RT each comprise an opening or aperture A11.

The article retention structures RT of the embodiment of FIG. 20 takes the form of a plurality of teeth or tabs 444, 448 arranged in an annular series about an aperture A11 to form part of an article receiving opening. In other embodiments the article retention structures RT may take a different form, for example but not limited to a pair of spaced apart opposing cuts which define a displaceable region forming a cover over an article and providing a pair of opposed engaging edges for engaging opposing sides of an article below a flange, chime or other projection.

The plurality of teeth 444, 448 are provided by the main panel 412. Each of the teeth 444, 448 is hingedly connected to the main panel 412, by a hinged connection. The hinged connection may be defined by a plurality of cut lines 451, 453. The plurality of cut lines 451, 453 may be arranged as an annular series of cuts about the apertures A11.

The plurality of cut lines 451, 453 may define or approximate a portion of circle.

Each of the plurality of teeth 444, 448 comprises an engaging edge opposing a hinged edge. The engaging edges are defined by a linear portion of a cut line defining the first or second aperture A11. Each engaging edge may define a part of a polygon. The illustrated embodiment comprises sixteen teeth 444, 448 together defining a hexadecagon. Each tooth 444, 448 comprises a pair of side edges, the side edges are defined by cuts 441, 443, 445, 447 extending radially outward from respective vertices of the hexadecagon, that is to say, from a respective vertex between a pair of adjacent linear portions of the cut defining the portion of a hexadecagon. The cuts 441, 443 are divergently arranged with respect to each other and define an angle therebetween, the angle may be about 22.5°.

Each of the plurality of cut lines 451, 453 may be linear in shape.

In alternative embodiments, each of the plurality of cut lines 451, 453 may be arcuate or curved. The cut lines 451, 453 may comprise a radius of curvature which is equal to half the diameter of the article receiving openings. The cut lines 451, 453 may comprise a radius of curvature which is greater than half the diameter of article receiving openings.

The plurality of teeth 444, 448 may comprise a first tab 448A which is disposed proximate the hinged connection between the engaging panel 412 and a respective one of a first or second side panel 414, 416.

The plurality of teeth 444, 448 may comprise a second tab 448B which is disposed proximate the hinged connection between the engaging panel 412 and a respective one of a first or second end panel 424, 434.

The first and second tabs 448A, 448B may be integral with the engaging panel 412; that is to say it is free from any cut lines 451, 453 or hinged connection to the engaging panel 412.

The first tabs 448A are each in sufficiently close proximity to one of the fold lines 413, 415 hinging the first and second side panels 414, 416 to the engaging panel 412 that said one of the fold lines 413, 415 effectively serves as a hinged connection to the first tabs 448A.

The second tabs 448B are each in sufficiently close proximity to one of the fold lines 425, 435 hinging the first and second end panels 424, 434 to the engaging panel 412 that said one of the fold lines 425, 435 effectively serves as a hinged connection to the second tabs 448B.

Each of the first and second tabs 448A, 448B may be defined by a pair of arcuate cuts 445, 447 which terminate upon a notional circle defined by the plurality of cut lines 451, 453.

Each of the first and second tabs 448A, 448B may be a pair of arcuate cuts 445, 447 each of which has a first end on the distal end edge E1 of the tabs 448A, 448B. Side edges of the first and second tabs 448A, 448B, defined by the arcuate cuts 445, 447, extend from their respective first ends toward the one of the fold lines 413, 415, 425, 435 hinging the side or end panels 414, 416, 424, 434 to the main panel 412. The side edges of each of the first and second tabs 448A, 448B then turn or diverge away from each other, while maintaining a space from said one of the fold lines 413, 415, 425, 435. The side edges of each of the first and second tabs 448A, 448B terminate at their respective second ends which second ends are spaced apart from said one of the fold lines 413, 415, 425, 435.

The arcuate cuts 445, 447 are spaced apart from said one of the fold lines 413, 415, 425, 435 and the arcuate cuts 445, 447 may turn through an angle sufficient that a portion of the arcuate cuts 445, 447 is parallel to said one of the fold lines 413, 415, 425, 435; the arcuate cuts 445, 447 may turn through an angle sufficient that it returns towards the aperture A11 or at least away from said one of the fold lines 413, 415, 425, 435. In this way tearing or shearing forces in the main panel 412 may be directed away from said one of the fold lines 413, 415, 425, 435 when the tabs 448A, 448B are folded out of the plane of the main panel 412 to engage an article B.

In the embodiment illustrated in FIG. 20 each of the article retention structures RT comprise two tabs 448A, 448B, in other embodiments the carrier may be configured to accommodate more than four articles B, for example, but not limited to six or eight articles B, in such embodiments only the article retention structures RT proximate both a side panel 414, 416 and an end panel 424, 434, a corner or endmost article retention structures RT, comprises two tabs 448A, 448B, the other article retention structures RT adjacent to one of the side and end panels 414, 416, 424, 434 may comprise a single tab 448A, 448B proximate to said one of the side and end panels 414, 416, 424, 434.

The blanks 310, 410 form a carrier 390 having a beam structure at each end of the carrier 390. The beam structure reinforces ends of the carrier 390 when transported and may reduce deformation of the panels 312, 314, 316, 318, 320; 412, 414, 416, 418, 420 when the carriers 390 are shrink wrapped or palletized.

The beam structure may increase lateral strength, reducing bending of the carrier and thereby reducing blousing or spreading apart of the articles B.

The beam structure is held in place by the anchor panels 322A, 322B, 332A, 332B, 422A, 422B, 432A, 432B which are secured between the composite top panel 318/320, 418/420 and the top end flaps 326, 336; 426, 436. The top end flaps 326, 336; 426, 436 and the anchor panels 322A, 322B, 332A, 332B, 422A, 422B, 432A, 432B are secured between the composite top panel 318/320, 418/420 and upper ends of the articles B. In this way the carrier 390 does not require adhesive during assembly.

Each of the anchor panels 322A, 322B, 332A, 332B, 422A, 422B, 432A, 432B is coupled to the beam structures by a pair of hinged panels 328A/330A, 328B/330B, 338A/340A, 338B/340B, 428A/430A, 428B/430B, 438A/440A, 438B/440B. The pair of hinged panels 328A/330A, 328B/330B, 338A/340A, 338B/340B, 428A/430A, 428B/430B, 438A/440A, 438B/440B are folded into face to face relationship with each other in a setup carrier 390. An outermost one 328A, 328B, 338A, 338B, 428A, 428B, 438A, 438B of the pair of hinged panels 328A/330A, 328B/330B, 338A/340A, 338B/340B, 428A/430A, 428B/430B, 438A/440A, 438B/440B may be disposed in face-to-face relationship with a respective one of the first and second side panels 314, 316; 414, 416.

The beam structure comprises a first portion provided by the first or second top end flap 326, 336; 426, 436. The beam structure comprises a second portion provided by the first or second end panel 324, 334; 424, 434. The anchor panels 322A, 322B, 332A, 332B, 422A, 422B, 432A, 432B are disposed in face to face relationship with the first portion of the beam structure. The pair of hinged panels 328A/330A, 328B/330B, 338A/340A, 338B/340B, 428A/430A, 428B/430B, 438A/440A, 438B/440B form a gusset between the first portion of the beam structure and one of the anchor panels 322A, 322B, 332A, 332B, 422A, 422B, 432A, 432B.

Referring now to FIGS. 21 to 25 there is shown an alternative embodiment of the present disclosure. In the sixth illustrated embodiment, like numerals have, where possible, been used to denote like parts, albeit with the addition of the prefix "500" to indicate that these features belong to the sixth embodiment. The alternative embodiment shares many common features with the embodiments of FIGS. 1 to 20, therefore only the differences from the embodiments illustrated in FIGS. 1 to 20 will be described in any greater detail.

Figure 21:
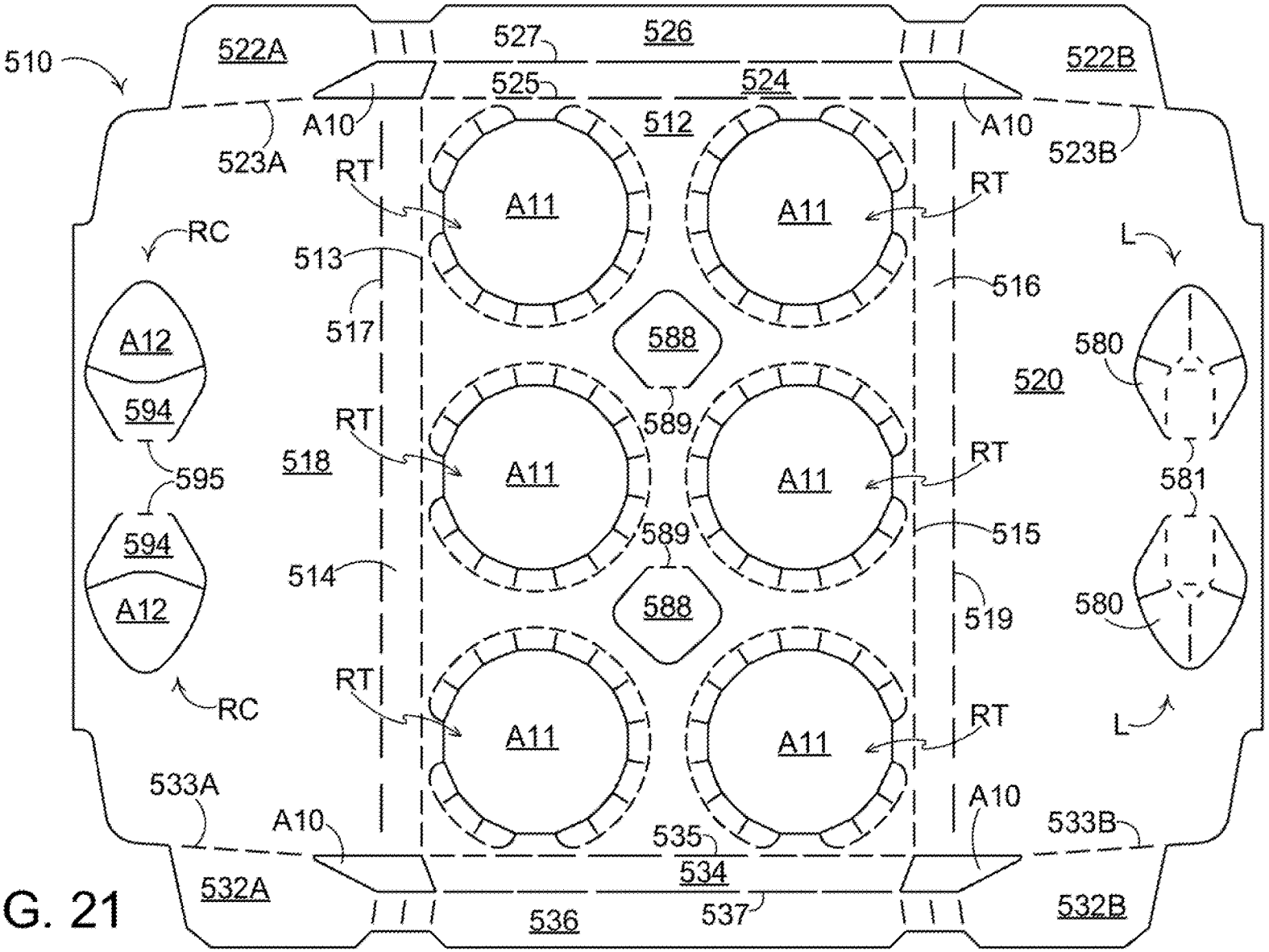
FIG. 21 is a plan view from above of a blank for forming a carrier according to a sixth embodiment.
Figure 22:
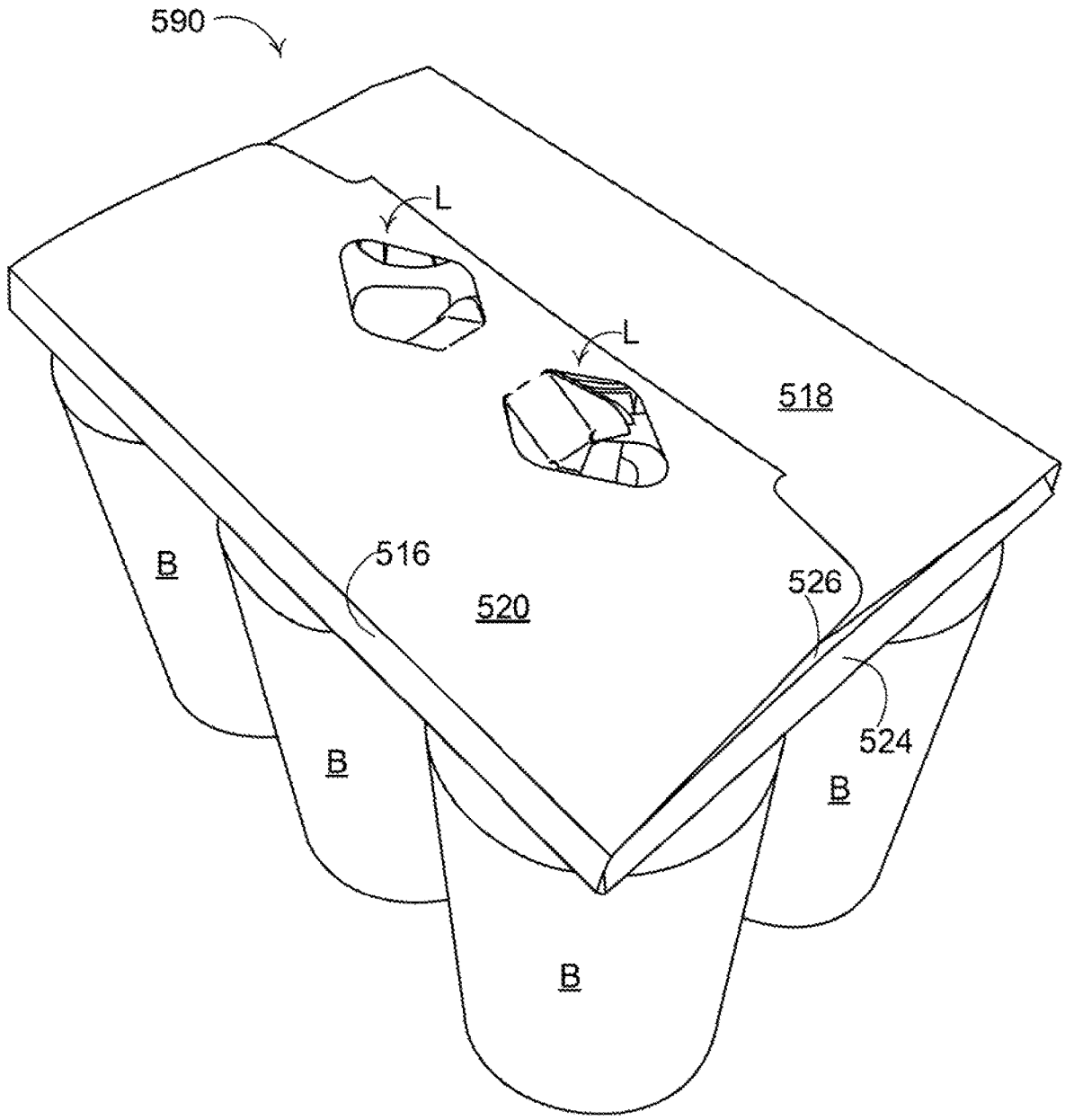
FIG. 22 is a perspective view from above of a carrier formed from the blank of FIG. 21.

FIG. 21 illustrates a blank 510 for forming a carrier 590 as shown in FIG. 22. The blank 510 is substantially similar in construction to the blanks 310, 410 of FIGS. 12A, 20, albeit adapted to accommodate six articles B rather than eight or four articles B.

The blank 510 comprises the alternative article retention structure RT of the embodiment of FIG. 20, although in other embodiments, other article retention structures may be employed.

The main, lower or engaging panel 512 comprises a handle structure. The handle structure may comprise at least one handle opening. In the illustrated embodiment, the blank 510 comprises two handle openings. Each handle opening is defined in, or struck from, a region of the main panel 512 disposed centrally between four apertures A11 arranged as two adjacent pairs of apertures A11. Each handle opening may be defined, at least in part, by a handle flap 588 struck from the main panel 512 and hingedly connected thereto by a hinged connection in the form of a fold line 589. The handle opening may be substantially square, kite or diamond shaped, although in other embodiments other shapes may be employed.

The first and second top panels 518, 520 are arranged to be disposed in at least partial overlapping relationship with each other. The overlapping portions of the first and second top panels 518, 520 are provided with a locking structure for locking the first and second top panels 518, 520. The locking structure cooperates with the handle openings in the main panel 512 to secure the first and second top panels 518, 520 to the main panel 512.

The locking structure comprises at least one receiver RC in the form of an opening in the first top panel 518. The first top panel 518 comprises a plurality of openings, more specifically two openings, although in other embodiments one, two or more than three openings may be provided. Each of the openings is arranged to be in vertical registry or alignment with one of the handle openings in the main panel 512 defined by a respective one of the handle flaps 588 provided therein.

Each receiver opening may be defined, at least in part, by at least one tab 594 (also referred to herein as female tabs or receiver tabs). In the illustrated embodiment, the openings are partially defined by a single tab 594, hingedly connected to the first top panel 518 by a fold line 592, and by a receiver aperture A12. The openings may be substantially rhombus or kite shaped, albeit truncated along fold line 592; in the illustrated embodiment, the corners of the opening are rounded or filleted.

A free end edge of the tab 594, opposing a hinged edge defined by fold line 592, may be concave in shape.

Figure 23:
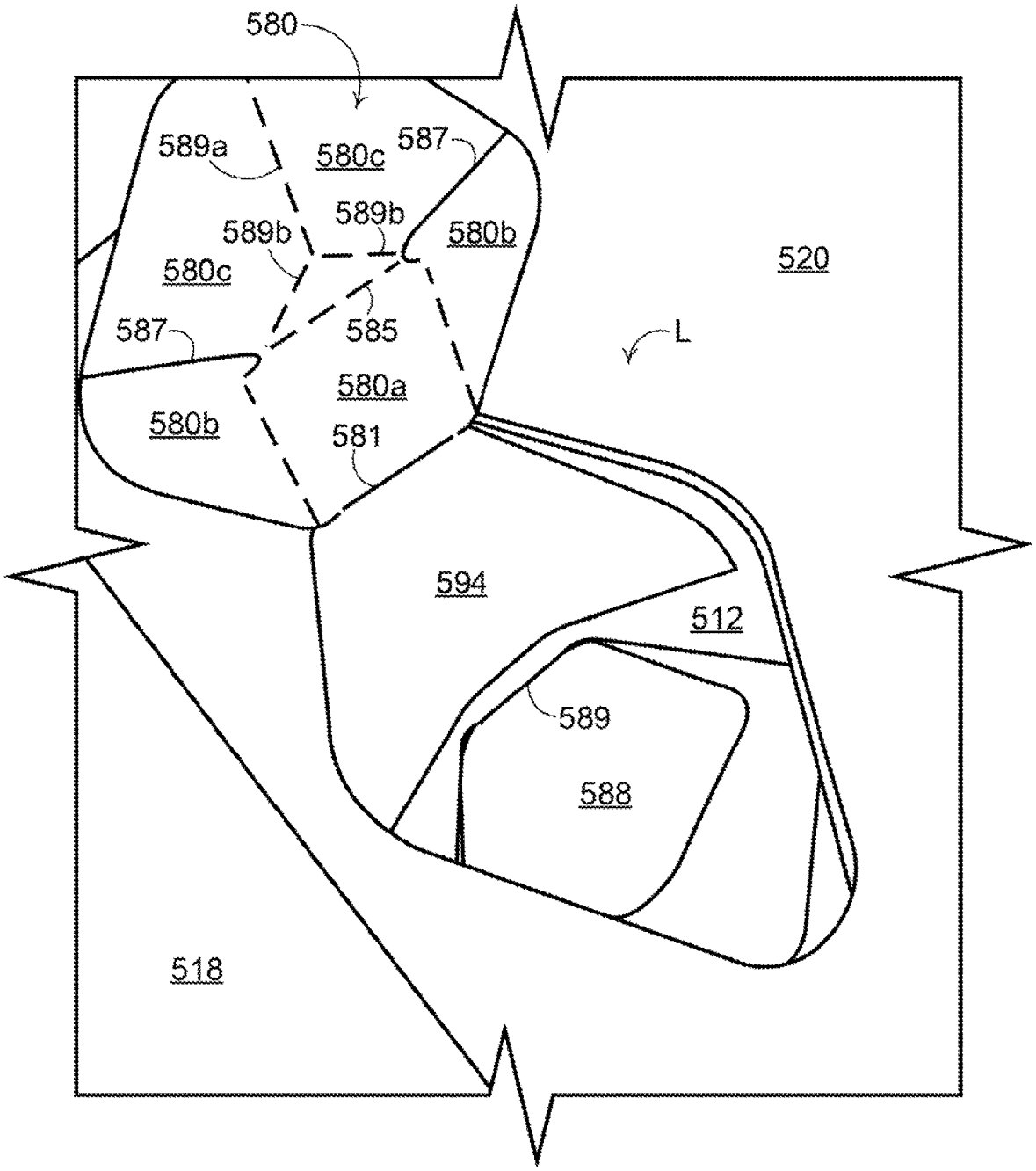
FIG. 23 is an enlarged perspective view from above of a portion of the carrier of FIG. 22 in which a locking tab has been unlocked and folded outwardly for illustrative purposes.
Figure 24:
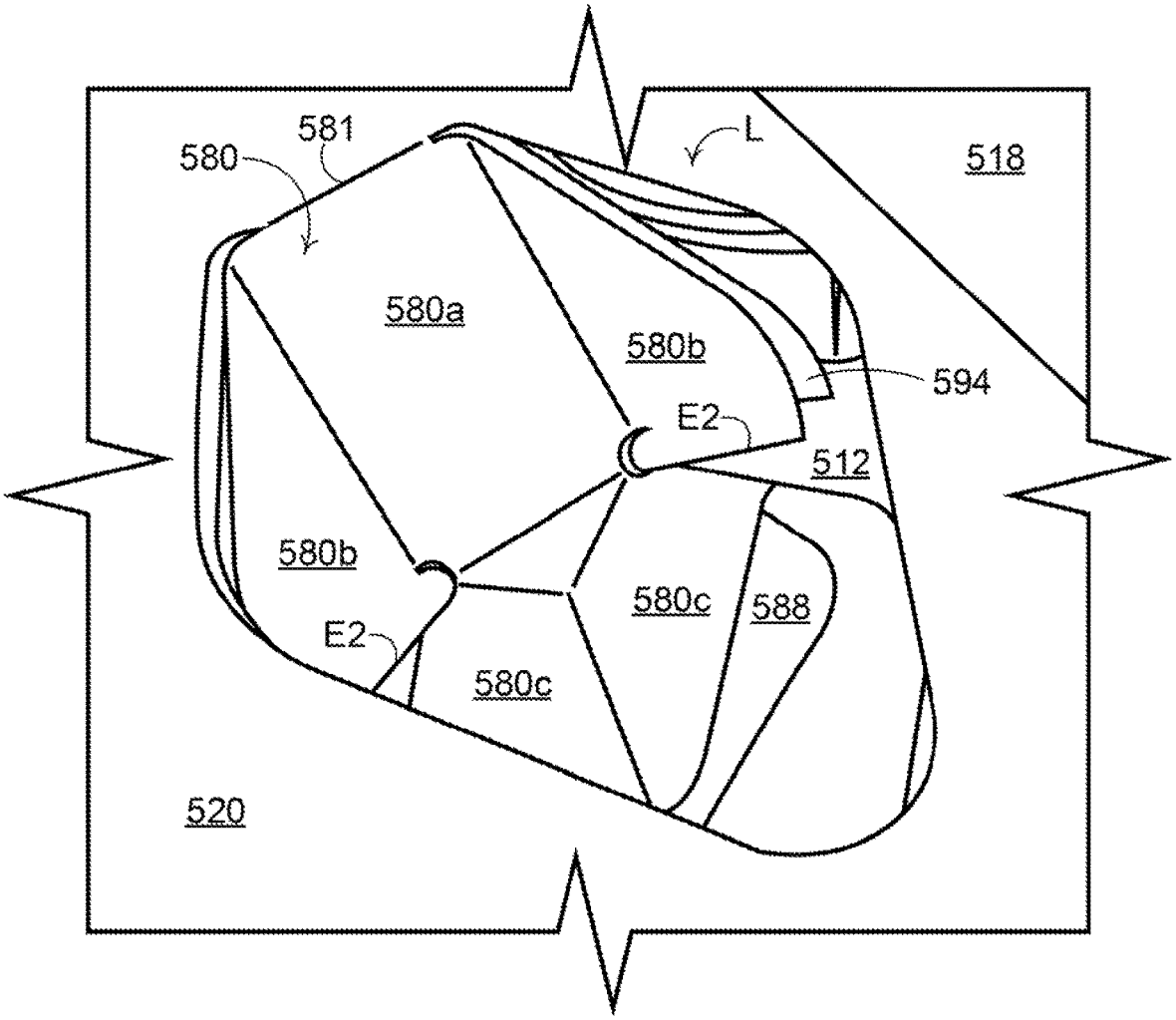
FIG. 24 is an enlarged perspective view from above of a portion of the carrier of FIG. 22.
Figure 25:
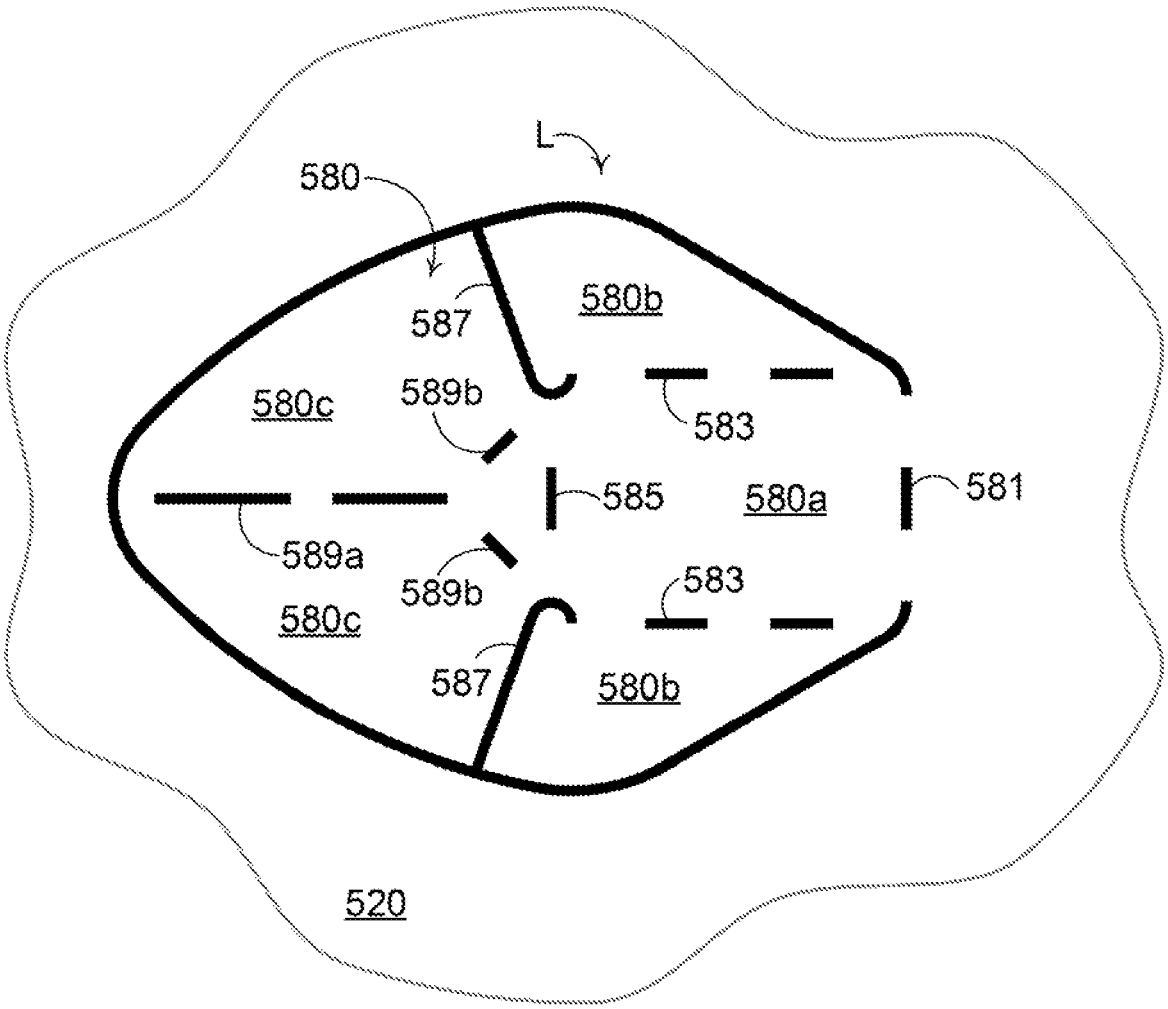
FIG. 25 is an enlarged plan view from above of a portion of the blank of FIG. 21.

The free end edge of the tab 594, or a portion thereof, may be folded into contact with an upper surface of the main panel 512, best illustrated in FIG. 23. The concave shape of the free end edge of the tab 594 may encourage the tab 594 to adopt a nonplanar shape, outer regions deform or fold with respect to a central or medial region that is hinged to the first top panel 518.

The locking structure comprises at least one locking element L for being received in the receiver RC. The locking element L comprises a tab 580 (also referred to herein as a male tab or lock tab) struck from the second top panel 520. The illustrated embodiment comprises a pair of tabs 580 each arranged to be engageable with one of the receiver openings and with a respective one of the handle openings.

Each tab 580 is hinged to the second top panel 520 by a hinged connection in the form of a fold line 581. Each tab 580 comprises a first portion 580*a* which is hingedly connected to the second top panel 520. Each tab 580 comprises a pair of wing portions 580*b* hingedly connected to opposing sides of the first portion 580*a* by a respective fold line 583. A pair of engaging portions 580*c* are hingedly connected to an end of the first portion 580*a* by at least one fold line 585. The end of the first portion 580*a*, to which the pair of engaging portions 580*c* are hinged, opposes the hinged connection between the first portion 580*a* and the second top panel 520. Each engaging portion 580*c* is separated, by a separation element, from a respective one of the wing portions 580*b* disposed adjacent thereto. The separation element takes the form of a cut line 587 or severable line, in other embodiments the separation elements may take a different form for example, but not limited to, a slot, slit, recess, or aperture.

A first one of the pair of engaging portions 580*c* may be hingedly connected to a second one of the pair of engaging portions 580*c* by a hinged connection in the form of a fold line 589*a*.

In the illustrated embodiment, each of the engaging portions 580*c* comprises an oblique fold line 589*a* extending substantially between the fold line 589*a*, hinging the pair of engaging portions 580*c* together, and a respective one of the cut lines 587. The oblique fold lines 589*b* and the fold line 585 define a triangular region between the first portion 580*a* and the pair of engaging portions 580*c*.

The oblique fold lines 589*a* may encourage the pair of engaging portions 580*c* to adopt a non-coplanar relationship with each other in a setup condition. This may encourage sections of the engaging portions 580*c* to be disposed below the main panel 512 (see FIG. 24). The cut lines 587 define an engaging edge of the engaging portions 580*c* which engaging edge interacts with the main panel 512 to retain the first and second top panels 512, 520 in position over the main panel 512.

The first portion 580*a* in a setup condition extends between the second top panel 520 and the main panel 512. The first portion 580*a* may be obliquely oriented with respect to the second top panel 520 and/or the main panel 512. The first portion 580*a* and/or the wing portions 580*b* may be dimension so as to be longer in length, at least in part, than the distance between the first and second top panels 512, 520 and the main panel 512.

The receiver tab 594 may reinforce the lock tab 580 when the carrier 590 is carried by the handle structure.

The receiver tab 594 may provide a resilient bias (or additional resilient bias) to the lock tab 580, this may have the effect of encouraging the engaging portions 580*c* into engagement with the main panel 512.

The receiver tab 594 may also serve as a mandrel for facilitating separation of the cut lines 587 or for facilitating folding of the engaging portions 580*c* with respect to the first portion 580*a* and/or wing portions 580*b*.

The lock tab 580 and/or the receiver tab 594 provide a bridge between the first and second top panels 512, 520 and the main panel 512.

The engaging portions 580*b* of the tab 580 together define substantially 'arrow head' shaped region so as to define a pair of opposing shoulders or detents (defined by cut lines 587) for securely engaging the main panel 512. The arrow head shaped region comprises a "Y" shaped fold line 589*a*, 589*b*.

Additionally, the receiver tabs 594 and/or the lock tabs 580 may engage or abut with the inside or upper surface of the main panel 512 and may thereby brace between the composite top panel 518/520 and the main panel 512 to maintain a spacing therebetween so as to assist in preventing the spacing from decreasing. Thus, at least a portion of the locking tab 580 and/or at least a portion of one or more of the receiver tabs 594 may be disposed between the first top panel 518 and the main panel 512 to maintain a spacing therebetween.

The locking tab 580 may also provide a cushioning tab improving comfort when the package 590 is carried by inserting one or more fingers into the openings in the composite top panel 518/520 and the main panel 512.

Figure 26:
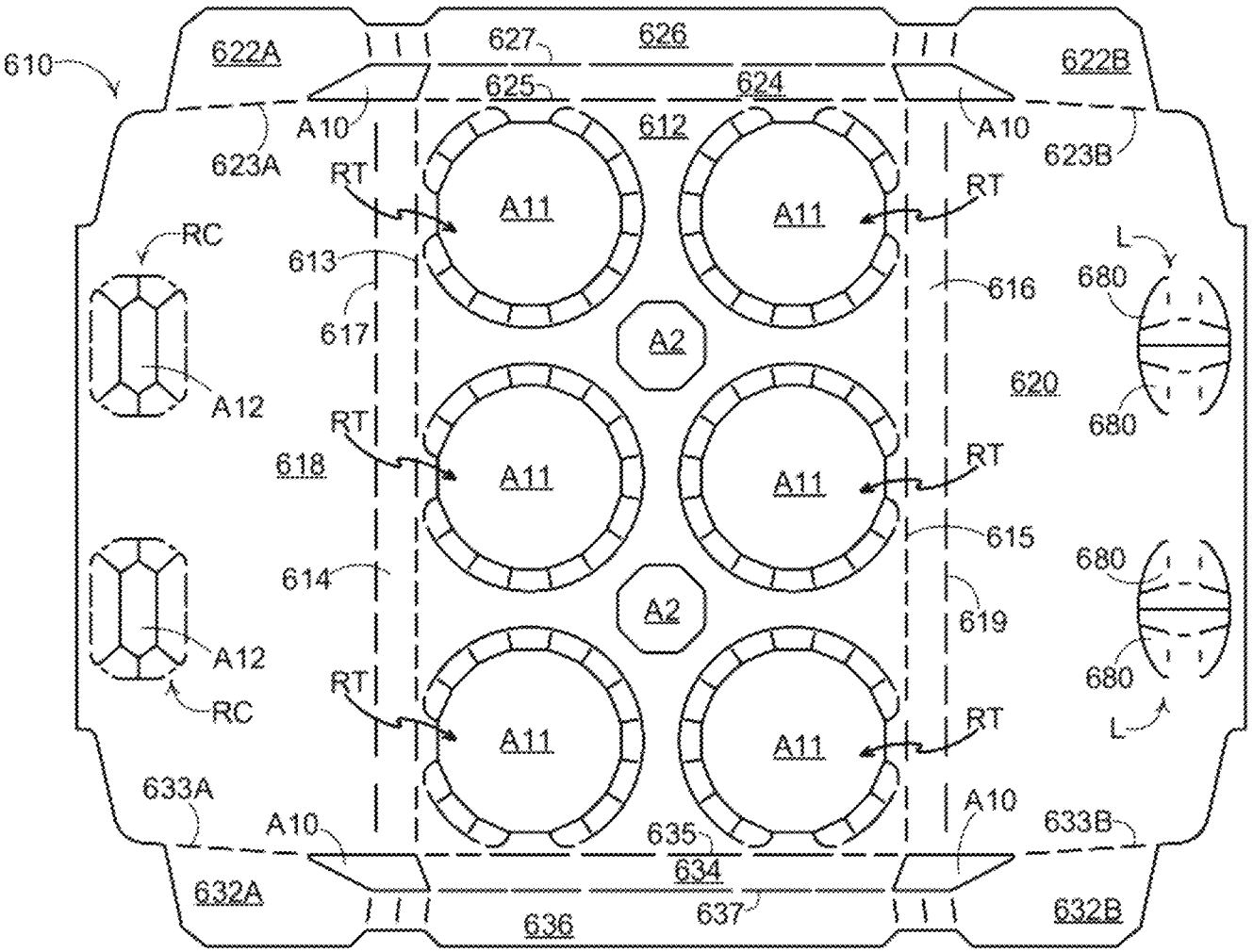
FIG. 26 is a plan view from above of a blank for forming a carrier according to a seventh embodiment.
Figure 27A:
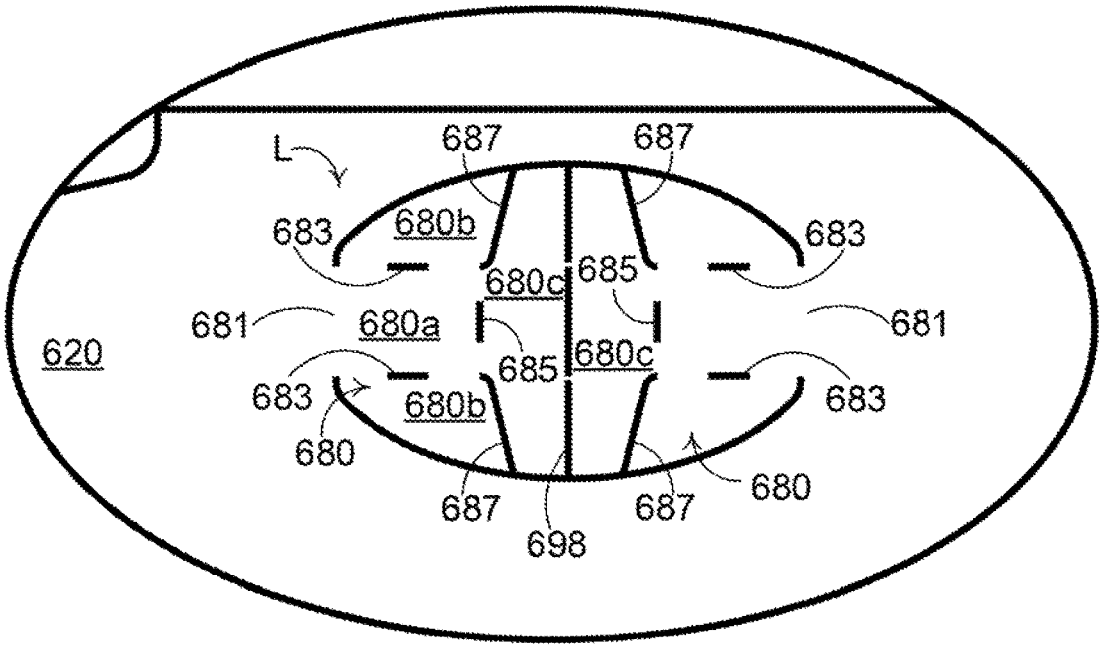
FIGS. 27A and 27B are an enlarged plan views from above of portions of the blank of FIG. 26.
Figure 27B:
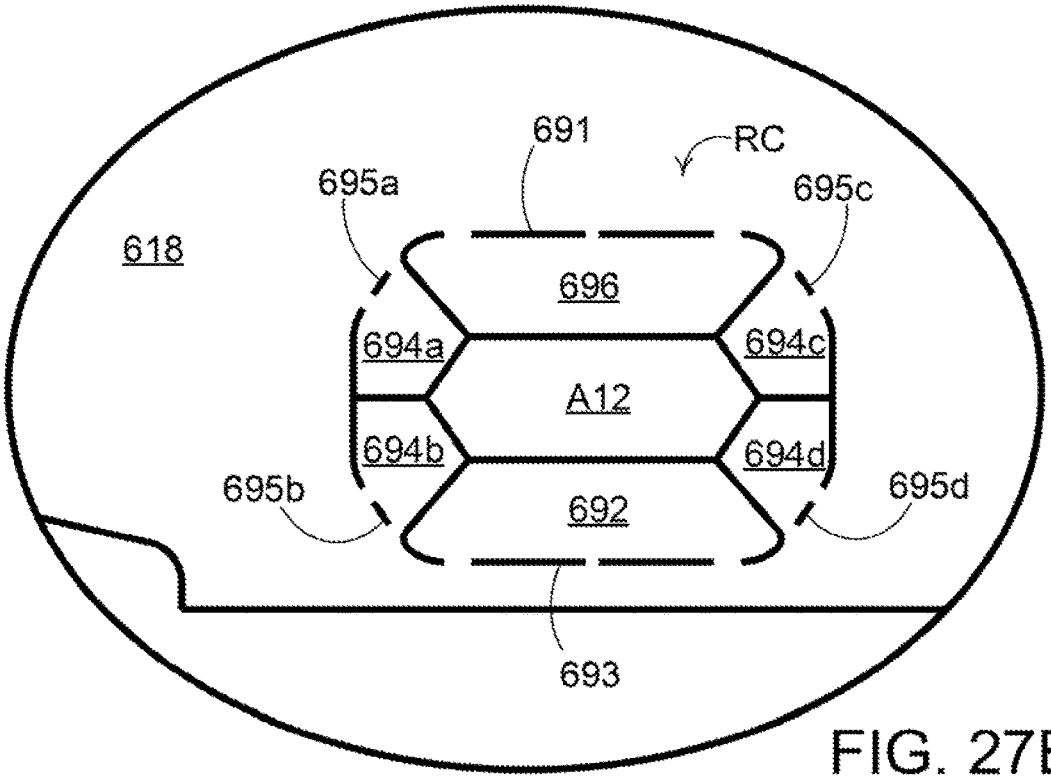

Referring now to FIGS. 26 to 28 there is shown an alternative embodiment of the present disclosure. In the seventh illustrated embodiment, like numerals have, where possible, been used to denote like parts, albeit with the addition of the prefix "600" to indicate that these features belong to the seventh embodiment. The alternative embodiment shares many common features with the embodiments of FIGS. 1 to 25, therefore only the differences from the embodiments illustrated in FIGS. 1 to 25 will be described in any greater detail.

FIG. 26 illustrates a blank 610 for forming a carrier. The blank 610 is substantially similar in construction to the blanks 310, 410, 510 of FIGS. 12A, 20, 21. The blank 610 is adapted to accommodate six articles B.

The blank 610 comprises the alternative article retention structure RT of the embodiment of FIGS. 20 and 21, although in other embodiments, other article retention structures may be employed.

The main lower or engaging panel 612 comprises a handle structure. The handle structure may comprise at least one handle opening. In the illustrated embodiment, the blank 610 comprises two handle openings A2. Each handle opening A2 is defined in, or struck from, a region of the main panel 612 disposed centrally between four apertures A11 arranged as two adjacent pairs of apertures A11. Each handle opening may be substantially octagonal in shape, although in other embodiments other shapes or configurations may be employed.

The first and second top panels 618, 620 are arranged to be disposed in at least partial overlapping relationship with each other. The overlapping portions of the first and second top panels 618, 620 are provided with a locking structure for locking the first and second top panels 618, 620. The locking structure cooperates with the handle openings in the main panel 612 to secure the first and second top panels 618, 620 to the main panel 612.

The locking structure comprises at least one receiver RC in the form of an opening in the first top panel 618. The first top panel 618 comprises a plurality of openings, more specifically two openings, although in other embodiments one, two or more than three openings may be provided. Each of the openings is arranged to be in vertical registry or alignment with one of the handle openings A2 in the main panel 612.

Each receiver opening may be defined, at least in part, by at least one tab 694 (also referred to herein as female tabs or receiver tabs). In the illustrated embodiment, the openings are partially defined by six tabs 692, 694*a*, 694*b*, 694*c*, 694*d*, 696 (see FIG. 27B), hingedly connected to the first top panel 618 by a respective fold line 693, 695*a*, 695*b*, 695*c*, 695*d*, 691, and by a receiver aperture A12. The openings may be substantially rectangular or octagonal. The opening, in the illustrated embodiment, comprises corners which are bevelled, chamfered or filleted. The receiver RC comprises a pair of opposed side tabs 692, 696 hinged to opposing sides of the opening. Each of the pair of opposed side tabs 692, 696 may be substantially trapezoidal in shape. The receiver RC comprises a pair of end tabs 694*a*/694*b*, 694*c*/694*d* at each end of the opening. The end tabs 694*a*, 694*b*, 694*c*, 694*d* may be hinged to the bevelled or chamfered corners of the opening. The end tabs 694*a*, 694*b*, 694*c*, 694*d* may be free from hinged connection to the end edges of the opening.

The receiver aperture A12 be may substantially hexagonal in shape. Free edges of the pair of end tabs 694*a*/694*b*, 694*c*/694*d* may define a nonlinear concave edge.

The locking structure comprises at least one locking element L for being received in the receiver RC. The illustrated embodiment comprises a pair of locking elements L. Each locking element L comprises a pair of tabs 680 (also referred to herein as a male tabs or lock tabs) struck from the second top panel 620. Each of the pair of tabs 680 is arranged to be engageable with one of the receiver openings and with a respective one of the handle openings.

Each tab 680 is hinged to the second top panel 520 by a hinged connection in the form of a fold line 581. Each tab 680 comprises a first portion 680*a* which is hingedly connected to the second top panel 620. Each tab 680 comprises a pair of wing portions 680*b* hingedly connected to opposing sides of the first portion 680*a* by a respective fold line 683. An engaging or securing portion 680*c* is hingedly connected to an end of the first portion 680*a* by a fold line 685. The end of the first portion 680*a* to which the securing portion 680*c* is hinged opposes the hinged connection between the first portion 680*a* and the second top panel 620. The engaging portion 680*c* is, at least partially, separated from a respective one of the wing portions 680*b* disposed adjacent thereto by a separation element. The separation element takes the form of a cut line 687 or severable line, in other embodiments the separation elements may take a different form for example, but not limited to, a slot, slit, recess, or aperture. The tab 680 may comprise a pair of separation elements or cut line 687 extending from, or defined in, opposing side edged of thereof.

Each cut line 687 defines an engaging edge of the securing portion 680*c* which engaging edge interacts with the main panel 612 to retain the first and second top panels 612, 620 in position over the main panel 612.

The engaging edges may be exposed by folding the wing portions 680*b*, about fold lines 683, with respect to the first portion 680*a* and/or by folding the securing portion 680*c*, about fold line 685, with respect to the first portion 680*a*.

The first portion 680*a*, in a setup condition, extends between the second top panel 620 and the main panel 612. The first portion 680*a* may be obliquely oriented with respect to the second top panel 620 and/or the main panel 612. The first portion 680*a* and/or the wing portions 680*b* may be dimensioned so as to be longer in length, at least in part, than the distance between the first and second top panels 612, 620 and the main panel 612.

Each pair of receiver end tabs 694*a*/694*b*, 694*c*/694*d* may provide a resilient bias (or additional resilient bias) to a respective one of the lock tabs 680, this may have the effect of encouraging the securing portion 680*c* of each tab 680 into engagement with the main panel 612.

Figure 28A:
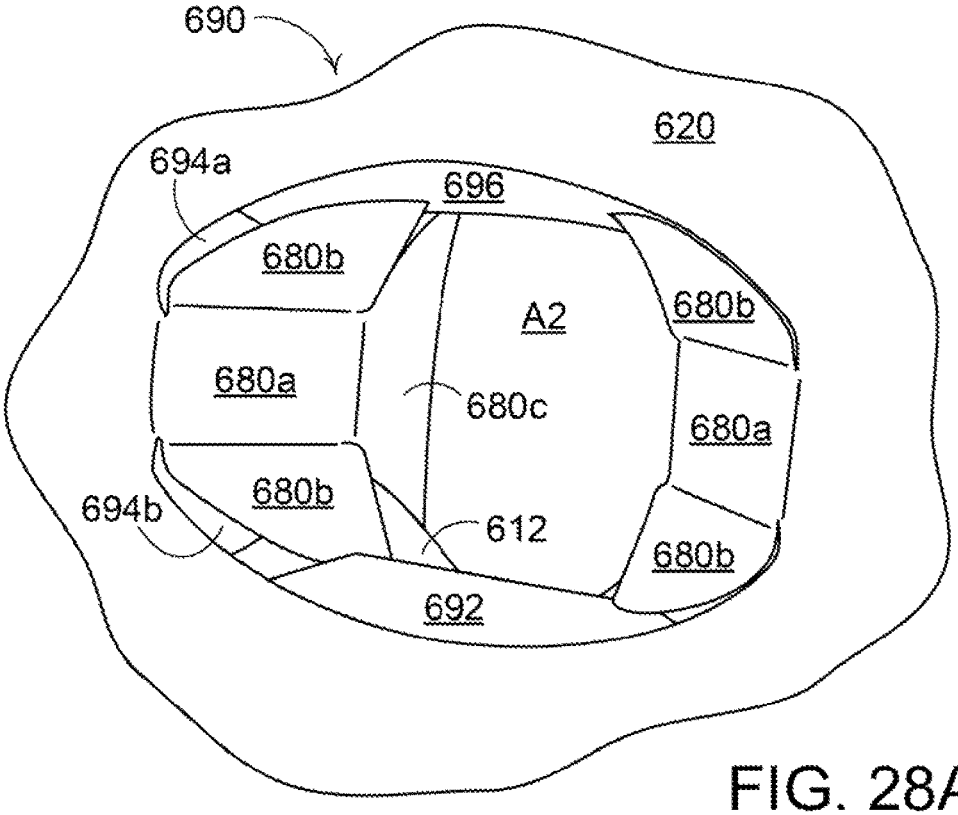
FIG. 28A is an enlarged perspective view from above of a portion of a carrier formed from the blank of FIG. 26.
Figure 28B:
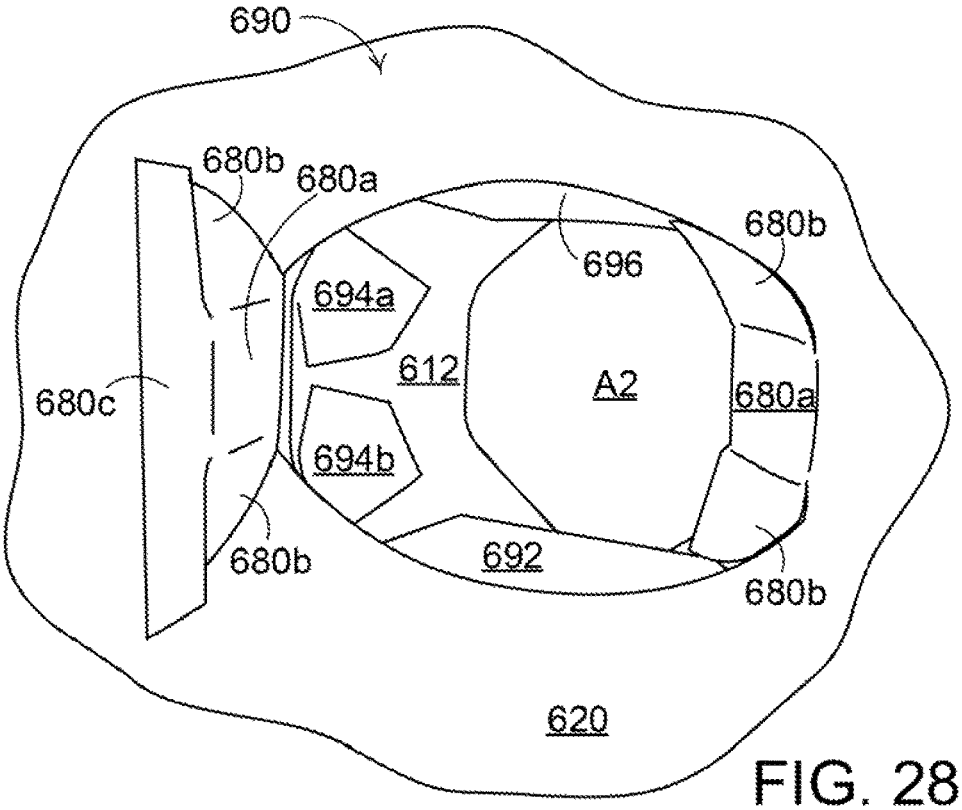
FIG. 28B is a perspective view from above of the portion of the carrier shown in FIG. 28A in which a locking tab has been unlocked and folded outwardly for illustrative purposes.

The receiver side tabs 692, 696 may encourage the wing portions 680*b* to fold with respect to the first portion 680*a*, about a respective one of the fold lines 683. Alternatively, the receiver side tabs 692, 696 interlock with the wing portions 680*b* so as to inhibit the lock tabs 680 from unfolding about fold lines 681. FIG. 28A illustrates the side lock tab 692 engaging, at a first end, with a lower side or surface of a wing portion 680*b* of a first one of the tabs 680. In this configuration, the side tab 692 encourages the wing portion 680*b* to fold with respect to the first portion 680*a*. FIG. 28A illustrates a second end of the side lock tab 692 engaging with an upper side or surface of a wing portion 680*b* of a second one of the tabs 680. In this configuration, the side tab 692 prevents or inhibits withdrawal of the second lock tab 680 through the opening in the first top panel 618.

Referring now to FIGS. 29 to 33 there is shown further alternative embodiments of the present disclosure. In the eighth and ninth illustrated embodiments, like numerals have, where possible, been used to denote like parts, albeit with the addition of the prefix "700"; "800" to indicate that these features belong to the eighth and ninth embodiments respectively. The embodiments share many common features with the embodiments of FIGS. 1 to 28, therefore only the differences from the embodiments illustrated in FIGS. 1 to 28 will be described in any greater detail.

Figure 29:
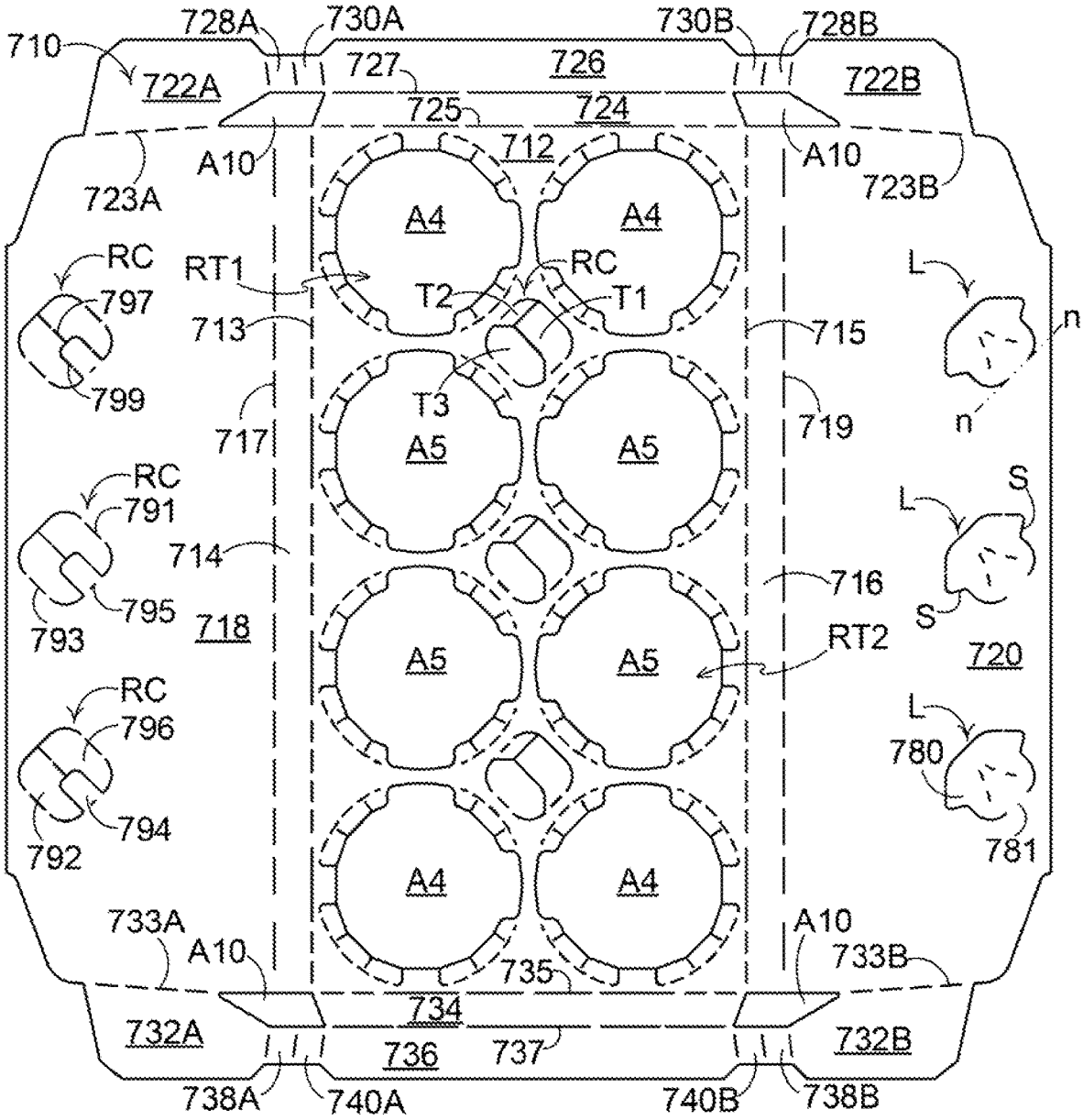
FIG. 29 is a plan view from above of a blank for forming a carrier according to an eighth embodiment.

Referring to FIG. 29 there is shown a blank 710 comprising a plurality of panels 712, 714, 716, 718, 720, including a main panel (or lower/engaging panel) 712 for forming a lower wall or engaging panel of a carrier 790 (see FIG. 18). The blank 710 is substantially similar in construction to the blank of FIG. 12A.

A first side panel 714 is hingedly connected to a first side of the main panel 712 by a hinged connection in the form of a fold line 713. A first top or cover panel 718 is hingedly connected to the first side panel 714 by a hinged connection in the form of a fold line 817.

A second side panel 716 is hingedly connected to a second side of the main panel 712 by a hinged connection in the form of a fold line 715. A second top or cover panel 720 is hingedly connected to the second side panel 716 by a hinged connection in the form of a fold line 719.

The main panel 712 of the blank 710 includes at least one article retention structure RT1, RT2. The main panel 712 comprises a plurality of article retention structures RT1, RT2, specifically eight article retention structures RT1, RT2 arranged in 2×4 matrix or array. Each of the article retention structures RT1, RT2 comprises an opening or aperture A4, A5. The article retention structures RT1, RT2 are substantially similar to those shown in FIGS. 5A, 5B and 5C and will not be described in further detail.

The main panel 712 comprises a handle structure. The handle structure may comprise at least one handle opening. In the illustrated embodiment, the blank 710 comprises three handle openings. Each handle opening is defined in or struck from a region of the main panel 712 disposed centrally between four apertures A4, A5 arranged as two adjacent pairs of apertures A4, A5.

The handle opening is defined by at least one tab T1, T2, T3 hingedly connected to the main panel 712 by a hinged connection in the form of a fold line. The illustrated embodiment comprises a plurality of tab T1, T2, T3, specifically, but not limited to three tabs tab T1, T2, T3.

The handle structure comprises a first tab T1 and a second tab T2 hinged in opposition to the first tab T1. The first and second tabs T1, T2 comprise an engaging edge for engaging with a shoulder or hook portion of a male or locking tab 780. The engaging edge may be obliquely oriented with respect to the hinged connection between the main panel 712 and the respective one of the first and second tabs T1, T2; the engaging edge may extend from or intersect with said hinged connection.

The first and second tabs T1, T2 may be asymmetrically arranged, that is to say the first tab T1 may extend across more than half of the width of the handle opening, where the width is defined between the hinged connections of the first and second tabs T1, T2.

The handle structure comprises a third tab T3 hinged to the main panel 712 adjacent to the first and second tabs T1, T2. The third tab T3 is arranged to be hinged sympathetically with the locking tab 780, that is to say the third tab T3 and the locking tab 780 fold generally in the same direction in a set up carrier (not shown). The third tab T3 may encourage the locking tab 780 into engagement with the first and second tabs T1, T2 or inhibit disengagement thereof.

The first and second top panels 718, 720 are arranged to be disposed in at least partially overlapping relationship with each other. The overlapping portions of the first and second top panels 718, 720 are provided with a locking structure for locking the first and second top panels 718, 720. The locking structure cooperates with the handle openings and the tabs T1, T2, T3 in the main panel 712 to secure the first and second top panels 718, 720 to the main panel 712.

The locking structure comprises at least one receiver RC in the form of an opening in the first top panel 718. The first top panel 718 comprises a plurality of openings, more specifically three openings, although in other embodiments one, two or more than three openings may be provided. Each of the openings is arranged to be in vertical registry or alignment with a handle opening A2 provided in the main panel 712. The opening is defined by at least one tab 792, 794, 796 (also referred to herein as female tabs or receiver tabs). In the illustrated embodiment, the openings are defined by three tabs 792, 794, 796 arranged substantially similarly to those of the embodiment of FIG. 12A.

The locking structure comprises at least one locking element L for being received in the receiver RC. The locking element L comprises a tab 780 struck from the second top panel 720, the illustrated embodiment comprises three tabs 780 each arranged to be engageable with one of the receiver openings and a respective one of the handle openings. Each tab 780 is hinged to the second top panel 720 by a hinged connection 781. Each tab 780 may comprise at least one fold line substantially similar to those of the embodiment of FIG. 12A.

The tab 780 may be substantially 'arrow head' shaped so as to define a pair of opposing shoulders or detents S for securely engaging the handle opening and/or receiver RC.

The blank 710 may be formed into an assembled carrier (not shown) in a manner substantially similar to that described above.

Figure 30A:
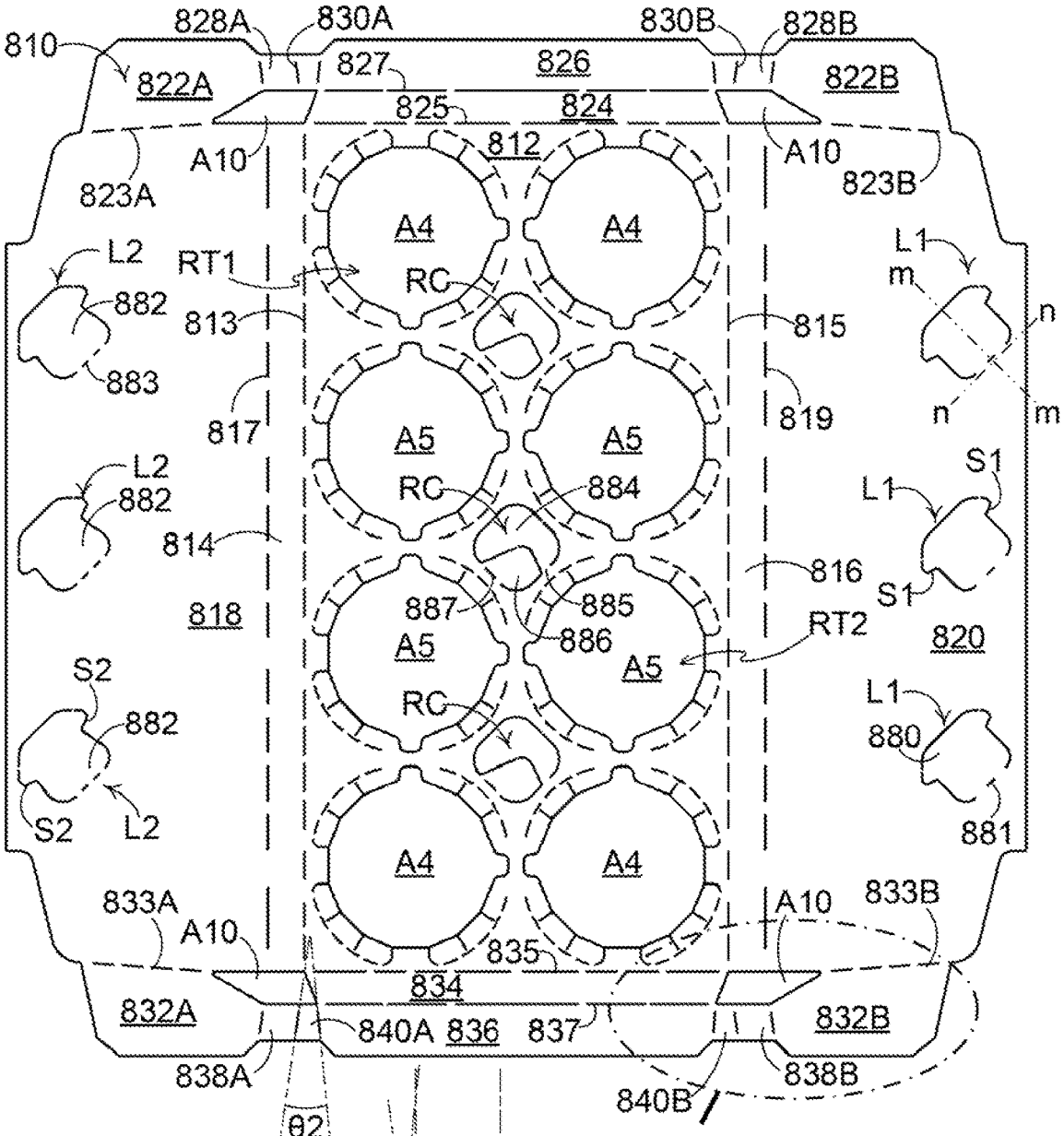
FIG. 30A is a plan view from above of a blank for forming a carrier according to a ninth embodiment.

Referring to FIG. 30A there is shown a blank 810 for forming a carrier 890, as shown in FIGS. 31A to 33. The blank 810 comprises a plurality of panels 812, 814, 816, 818, 820, including a main panel (or lower/engaging panel) 812 for forming a lower wall or engaging panel of a carrier 890 (see FIG. 32). The blank 810 is substantially similar in construction to the blanks of FIGS. 12A and 29.

In the embodiment of FIG. 30A the handle structure has been modified in that a handle opening in the main panel 812 is defined by a pair of tabs 884, 886. The pair of tabs 884, 886 includes a first tab 884 hinged to the main panel 812. The hinged connection between the first tab 884 and the main panel 812 defines a portion of a first edge of the handle opening. The pair of tabs 884, 886 includes a second tab 886 hinged to the main panel 812. The hinged connection between the second tab 886 and the main panel 812 defines a portion of a second, adjacent, edge of the handle opening. The second tab 886 is defined in part by a substantially "V" shaped cutline extending between the first and second edges of the handle opening. The first tab 884 may define at least a portion of at least three edges of the handle opening, and may define at least a portion of four edges of the handle opening. The handle opening may be substantially square or diamond shaped. The handle opening may provide a receiver element RC for receiving at least one locking tab 880, 882 of a locking mechanism. The "V" shaped cutline defines a recess or cutaway in the first tab 884 capable of receiving a portion of at least one male tab 884, 886.

The first and second top panels 818, 820 are arranged to be disposed in at least partially overlapping relationship with each other. The overlapping portions of the first and second top panels 818, 820 are provided with a locking structure for locking the first and second top panels 818, 820. The locking structure cooperates with the handle openings and the tabs 884, 886 in the main panel 812 to secure the first and second top panels 818, 820 to the main panel 812.

The locking structure comprises at least one first locking element L1 for being received in the receiver element RC. The first locking element L1 comprises a tab 880 struck from the second top panel 820, the illustrated embodiment comprises three tabs 880 each arranged to be engageable with one of the handle or receiver openings and pass through an opening in the first top panel 818. Each tab 880 is hinged to the second top panel 820 by a hinged connection in the form of first fold line 881 having a first fold strength or resistance. The first fold line 881 may be defined by a single perforation or weakening element disposed between ends of a cutline defining the tab 880. In some embodiments the perforation or weakening element may be omitted.

The locking structure comprises at least one second locking element L2 in the form of an opening in the first top panel 818. The second locking element L2 comprises a tab 882 struck from the first top panel 818, the illustrated embodiment comprises three tabs 882 each arranged to be engageable with one of the handle or receiver openings in the main panel 812. Each tab 882 is hinged to the first top panel 818 by a hinged connection in the form of second fold line 883 having a second fold strength or resistance, the second fold resistance is lower than the first fold resistance, that is to say the second tabs 882 are more easily folded. The second fold line 883 may be defined by a two or more perforations or weakening elements disposed between ends of a outline defining the tab 882. The second fold line 883 may comprise at least one more perforation than the first fold line 881, alternatively a greater proportion of the hinged connection between the main panel 818 and the second tabs 882 may be defined by, or comprise, a cut line, perforation or other weakening element than the hinged connection between the main panel 818 and the first tabs 880.

The second tab 882 should be at least equal in size to the first tab 880. The second tab 882 may be larger in dimension, in length and/or in width, than the first tab 880 so as to facilitate the first tab 880 readily passing through the first top panel 818. The first tab 880 comprises first shoulders or hook portions S1 for engaging with the main panel 812. The second tab 882 comprises second shoulders or hook portions S2 for engaging with the main panel 812. The second shoulders or hook portions S2 may be configured and arranged to be substantially aligned with the first shoulders or hook portions S1 when the lock tabs 880, 882 are in an engaged position.

The locking tabs 880, 883 may be asymmetric in shape about a notional line m-m bisecting the locking tabs 880, 883 and extending perpendicularly to a notional line n-n parallel or coincident with the fold line 881, 883.

The first top panel 818, second top panel 820, first and second side panels 814, 816 and main panel 812 form a tubular structure. Each end of the tubular structure is closed by an end closure structure. A first end closure structure comprises a first end panel 824 hingedly connected to a first end of the main panel 812 by a hinged connection in the form of a fold line 825. A first top end flap 826 is hingedly connected to the first end panel 824 by a hinged connection in the form of a fold line 827.

A first anchor flap 822A is hingedly connected to a first end of the first side panel 818 by a hinged connection in the form of a fold line 823A. The first anchor flap 822A is hingedly connected to the first top end flap 826 by a pair of hinged panels 828A, 830A. The pair of hinged panels 828A, 830A form a gusset. A first connecting panel 828A is hingedly connected to the first anchor flap 822A by a hinged connection in the form of a fold line. A second connecting panel 830A is hingedly connected to the first connecting panel 828A by a hinged connection in the form of a fold line. The second connecting panel 830A is hingedly connected to the first top end flap 826 by a hinged connection in the form of a fold line.

A second anchor flap 822B is hingedly connected to a first end of the second side panel 820 by a hinged connection in the form of a fold line 823B. The second anchor flap 822B is hingedly connected to the first top end flap 826 by a pair of hinged panels 828B, 830B forming a second gusset. A third connecting panel 828B is hingedly connected to the second anchor flap 822B by a hinged connection in the form of a fold line. A fourth connecting panel 830B is hingedly connected to the third connecting panel 828B by a hinged connection in the form of a fold line. The fourth connecting panel 830B is hingedly connected to the first top end flap 826 by a hinged connection in the form of a fold line.

The first end panel 824 is separated from each of the first and second anchor flaps 822A, 822B by an aperture A10. The apertures A10 separate each of the pair of hinged panels 828A/830A, 828B/830B from the respective one of the first and second side panels 814, 816.

A second end closure structure comprises a second end panel 834 hingedly connected to a second end of the main panel 812 by a hinged connection in the form of a fold line 835. A second top end flap 836 is hingedly connected to the second end panel 834 by a hinged connection in the form of a fold line 837.

A third anchor flap 832A is hingedly connected to a second end of the first side panel 818 by a hinged connection in the form of a fold line 833A. The third anchor flap 832A is hingedly connected to the second top end flap 836 by a pair of hinged panels 838A, 840A forming a third gusset. A fifth connecting panel 838A is hingedly connected to the third anchor flap 832A by a hinged connection in the form of a fold line. A sixth connecting panel 840A is hingedly connected to the fifth connecting panel 838A by a hinged connection in the form of a fold line. The sixth connecting panel 840A is hingedly connected to the second top end flap 836 by a hinged connection in the form of a fold line.

A fourth anchor flap 832B is hingedly connected to a second end of the second side panel 820 by a hinged connection in the form of a fold line 833B. The fourth anchor flap 832B is hingedly connected to the second top end flap 836 by a pair of hinged panels 838B, 840B forming a fourth gusset. A seventh connecting panel 838B is hingedly connected to the fourth anchor flap 832B by a hinged connection in the form of a fold line 839B (see FIG. 30B). An eighth connecting panel 840B is hingedly connected to the seventh connecting panel 838B by a hinged connection in the form of a fold line 855B. The eighth connecting panel 840B is hingedly connected to the second top end flap 836 by a hinged connection in the form of a fold line 859B.

The second end panel 834 is separated from each of the third and fourth anchor flaps 832A, 832B by an aperture A10. The apertures A10 separate each of the pair of hinged panels 838A/840A, 838B/840B from the respective one of the first and second side panels 814, 816.

Figure 30B:
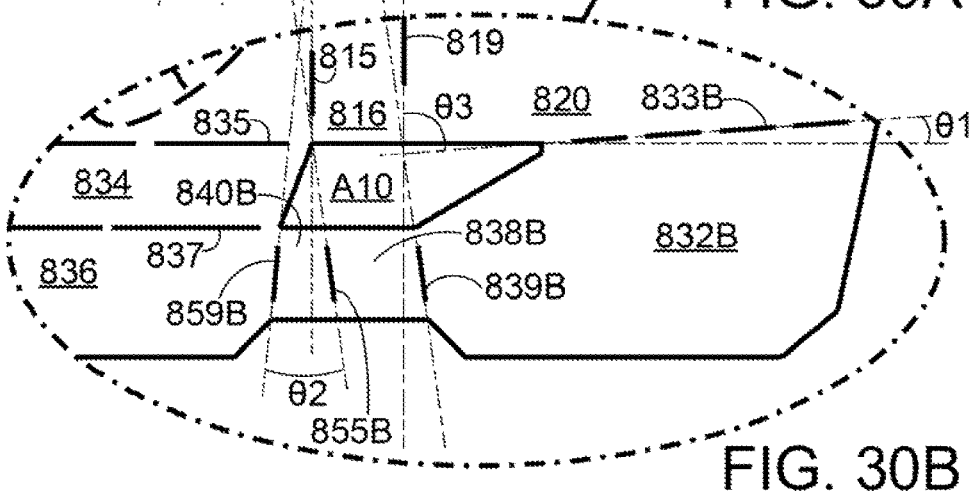
FIG. 30B is an enlarged plan view from above of a portion of the blank of FIG. 30A.
Figure 31A:
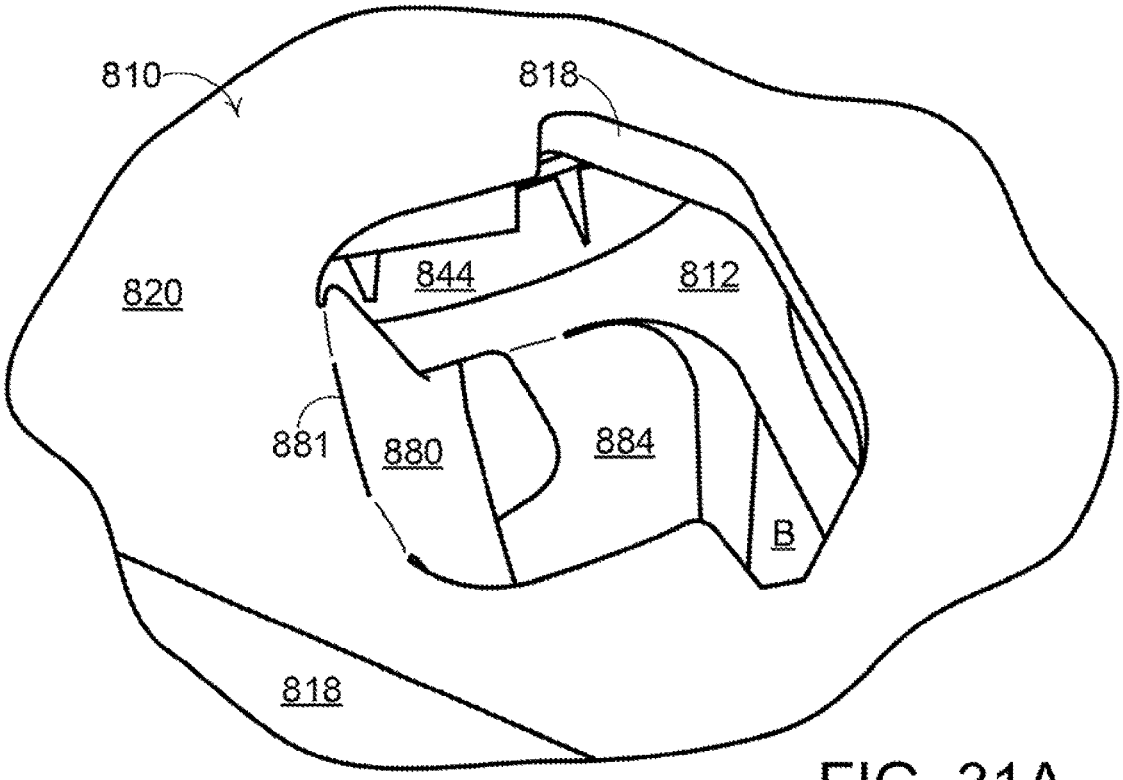
FIGS. 31A and 31B are perspective views of a lock mechanism in a carrier formed from the blank of FIG. 30A.
Figure 31B:
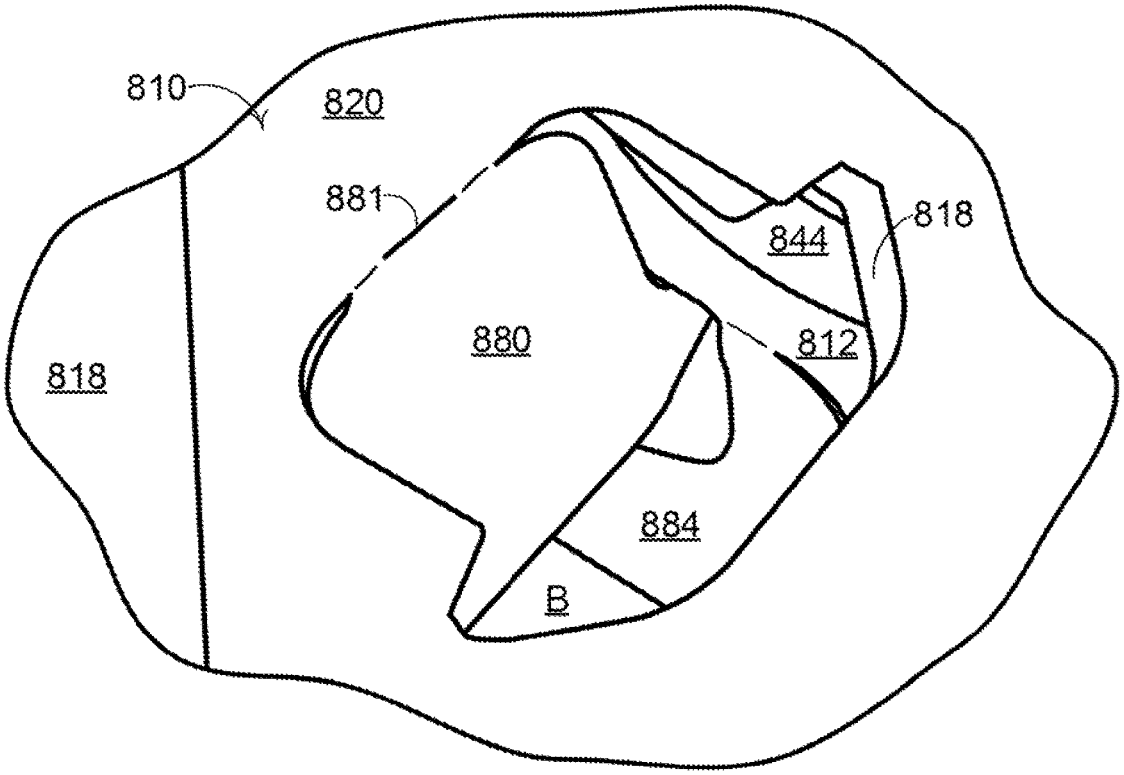
Figure 32:
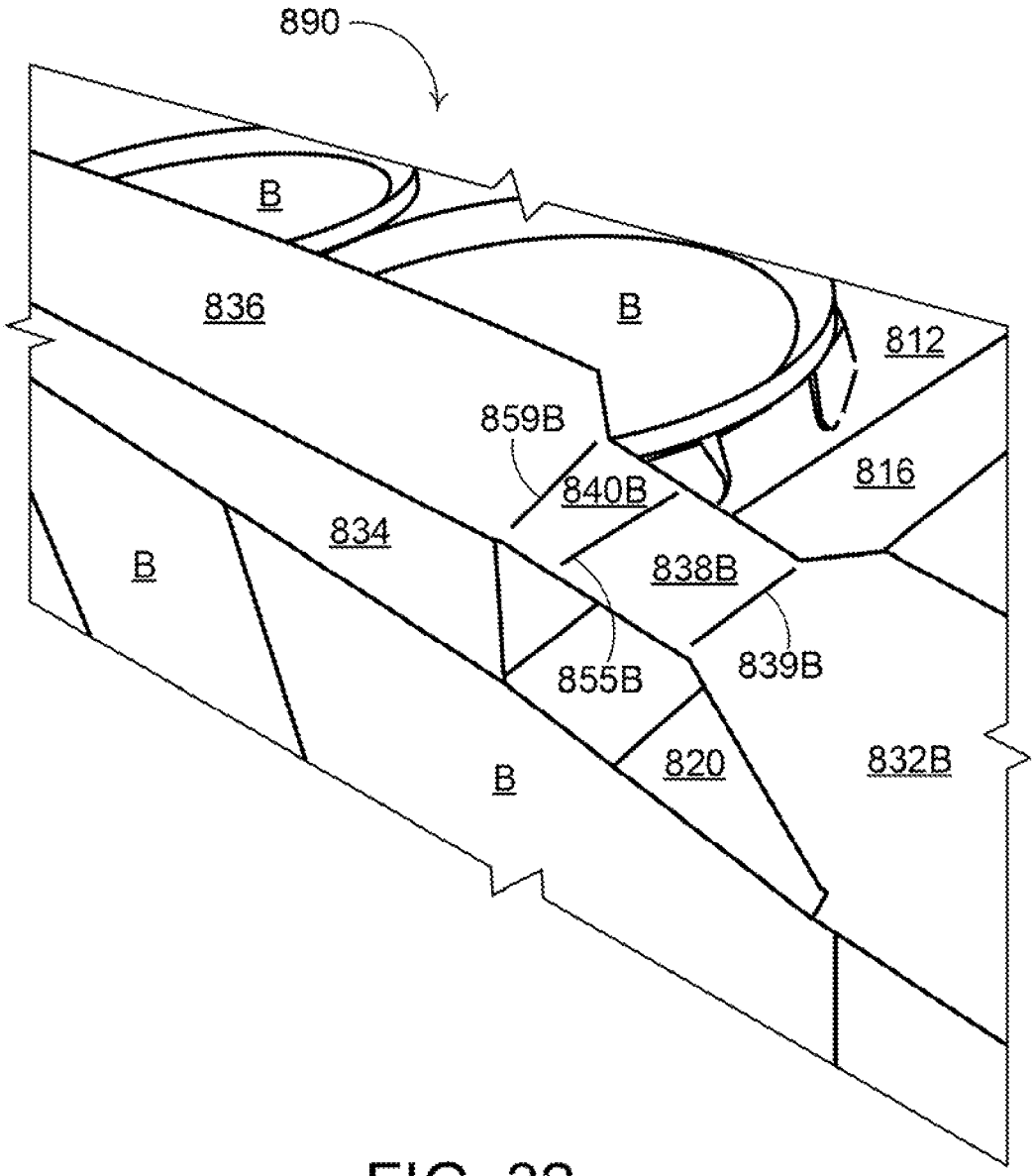
FIGS. 32 and 33 illustrate stages of construction of a carrier from the blank of FIG. 30A.
Figure 33:
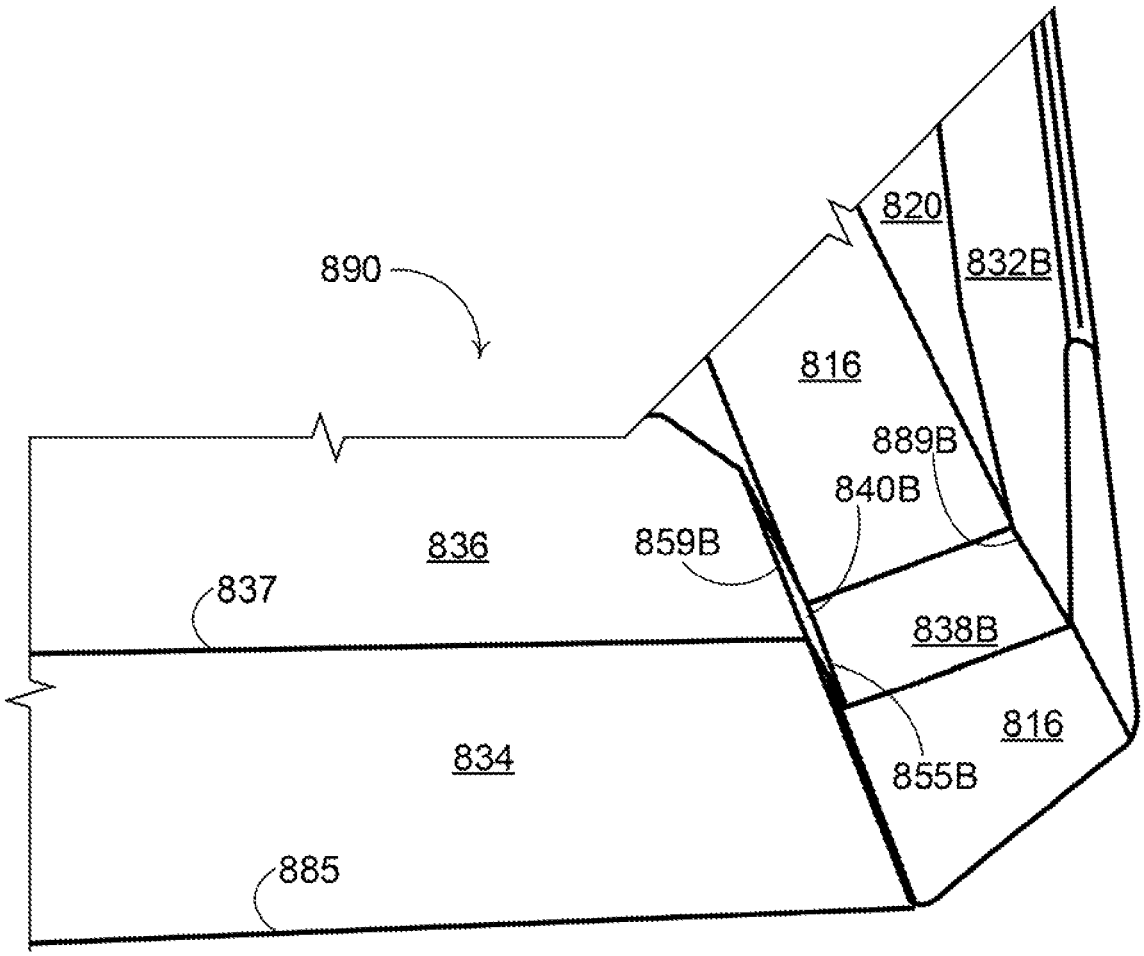

FIG. 30B shows the fourth anchor flap 832B and adjacent portions of the second end closure structure in greater detail, it will be appreciated that the first, second, and third anchor flaps 822*a*, 822B, 832A are similarly arranged.

The fold line 833B hinging the fourth anchor flap 832B to the second top panel 820 is divergently arranged with respect to the fold line 835 hinging the second end panel 834 to the main panel 812. The fold line 833B and the fold line 835 define an angle θ1 therebetween, the angle θ1 may in the range 5° to 30°, preferably in the range 5° to 10°.

The fold line 833B hinging the fourth anchor flap 832B to the second top panel 820 is obliquely oriented with respect to the fold line 819 hinging the second top panel 820 to the second side panel 816. The fold line 833B and the fold line 819 define an angle 83 therebetween.

The fold line 839B and the fold line 855B are arranged to be substantially parallel to each other and may be spaced apart from each other by a distance substantially equal to the space between fold line 815 and fold line 819.

The fold line 839B is divergently arranged, or obliquely oriented, with respect to the fold line 819 hinging the second top panel 820 to the second side panel 816. The fold line 839B and the fold line 819 define an obtuse angle between them.

The fold line 855B is divergently arranged, or obliquely oriented, with respect to the fold line 815 hinging the second side panel 816 to the main panel 812. The fold line 855B and the fold line 815 define an obtuse angle between them.

When the end closure structure is erected the fold line 839B is substantially in vertical alignment with the fold line 819 and the fold line 855B is substantially in vertical alignment with the fold line 815.

Figure 12B:
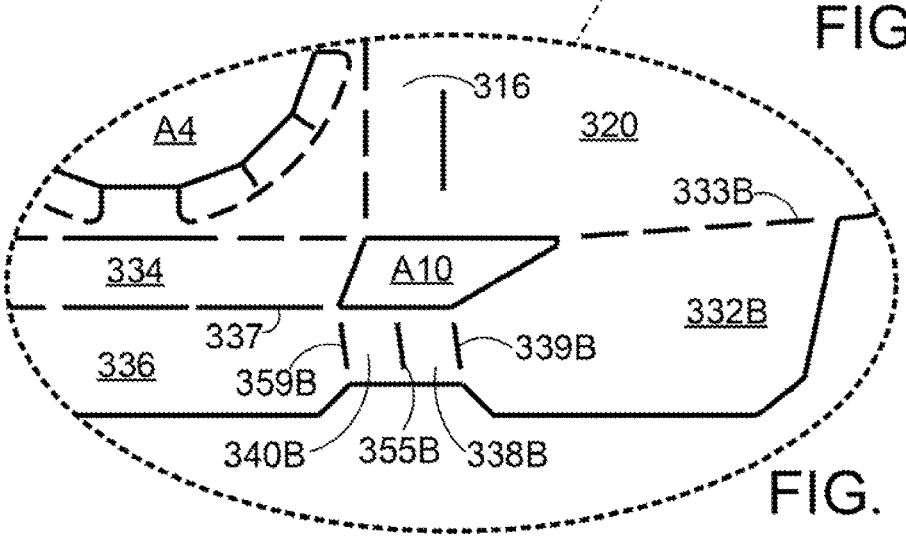
FIG. 12B is an enlarged view of an article retention device according to the fourth embodiment.

The spacing between the fold line 839B and the fold line 855B, in the embodiment of FIGS. 30A and 30B, is greater than the spacing between the fold line 339B and the fold line 355B, in the embodiment of FIGS. 12A and 12B.

The fold line 859B is convergently arranged with respect to the fold line 855B. The fold line 859B and the fold line 855B define an angle θ2 therebetween, the angle θ2 may in the range 5° to 30°. The fold line 859B is convergently arranged with respect to the fold line 815 such that a notional extension of the fold line 859B intersects or meets with the fold line 815.

A notional extension of the fold line 855B may intersects or meets with corner of the main panel 812, the corner being defined by the intersection of fold line 815 and fold line 835; said corner may also be coincident with a corner or vertex of the aperture A10.

The fold lines 839B, 855B, 859B are non-parallel to the fold lines 815, 819. The fold lines 839B, 855B, 859B are non-perpendicular to the fold lines 835, 837.

The fold line 833B is non-parallel to the fold lines 835, 837. The fold lines 833B are non-perpendicular to the fold lines 815, 819.

The blanks 10; 110; 210A, 210B, 310; 410; 510; 610; 710; 810 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulphate paperboard coated on one side, trade name PrintKote®) or CNK® board (Coated Natural Kraft®-an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210A, 210B, 310; 410; 510; 610; 710; 810 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier 90; 290; 390; 590; 690; 890 for engaging at least one article B. The article carrier 90; 290; 390; 590; 690 comprises spaced apart panels 12, 18/20; 112, 118/120; 212, 254; 312, 318/320; 412, 418/420; 512, 518/520; 612, 618/620; 712, 718/720; 812, 818/820 including an upper panel 18/20; 118/120; 254; 318/320; 418/420; 518/520; 618/620; 718/720; 818/820 and a lower panel 12; 112; 212; 312; 412; 512; 612; 712; 812. The article carrier 90; 290; 390; 590; 690; 890 comprises a locking tab 80; 180; 280; 380; 480; 580; 680; 780; 880 formed from the upper panel 18/20; 118/120; 254; 318/320; 418/420; 518/520; 618/620; 718/720; 818/820. The locking tab 80; 180; 280; 380; 480; 580; 680; 780; 880 provides a retaining device securing the upper panel 18/20; 118/120; 254; 318/320; 418/420; 518/520; 618/620; 718/720; 818/820 in position above the lower panel 12; 112; 212; 312; 412; 512; 612. At least a portion of the locking tab 80; 180; 280; 380; 480; 580; 680; 780; 880 is disposed between the upper panel 18/20; 118/120; 254; 318/320; 418/420; 518/520; 618/620; 718/720; 818/820 and the lower panel 12; 112; 212; 312; 412; 512; 612; 712; 812 to maintain a spacing therebetween.

The present disclosure also provides a carrier 90; 290; 390; 590; 690; 890 of the top engaging type having an engaging panel 12; 112; 212; 312; 412; 512; 612; 712; 812 comprising article retention structures or article top engaging devices RT, RT1, RT2 and a cover/upper panel 18/20; 118/120; 254; 318/320; 418/420; 518/520; 618/620; 718/720; 818/820 disposed over the engaging panel 12; 112; 212; 312; 412; 512; 612; 712; 812 and spaced apart therefrom.

The carrier 90; 290; 390; 590; 690; 890 may comprise at least one finger tab 80; 180; 280; 380; 480; 580; 680; 780; 880, 882 which serves as retaining device securing the cover panel 18/20; 118/120; 254; 318/320; 418/420; 518/520; 618/620; 718/720; 818/820 in position above the engaging panel 12; 112; 212; 312; 412; 512; 612; 712; 812. The at least one finger tab 80; 180; 280; 380; 480; 580; 680; 780; 880, 882 serves as a spacer device between the cover panel 18/20; 118/120; 254; 318/320; 418/420; 518/520; 618/620; 718/720; 818/820 and the engaging panel 12; 112; 212; 312; 412; 512; 612; 712; 812. The at least one finger tab 80; 180; 280; 380; 480; 580; 680; 780; 880, 882 may protrude downward through an opening in the engaging panel 12; 112; 212; 312; 412; 512; 612; 712; 812 such that each at least one finger tab 80; 180; 280; 380; 480; 580; 680; 780; 880, 882 may engage the perimeter of the respective opening in the engaging panel 12; 112; 212; 312; 412; 512; 612; 712; 812.

The carrier 90; 290; 390; 590; 690; 890 may comprise a composite cover panel 18/20; 118/120; 254; 318/320; 418/420; 518/520; 618/620; 718/720; 818/820 formed from two overlapping covering flaps, an upper covering flap comprising a finger tab 80; 180; 280; 380; 480; 580; 680; 780; 880 and a lower covering flap comprising an opening. The opening may be defined by one or more female tabs 392, 394, 396; 492, 494, 496; 594; 692, 694*a*, 694*b*, 694*c*, 694*d*, 696; 792, 794, 796. The finger tab 80; 180; 280; 380; 480; 580; 680; 780; 880 may engage with at least one, two or more of the female tabs 392, 394, 396; 492, 494, 496; 594; 692, 694*a*, 694*b*, 694*c*, 694*d*, 696; 792, 794, 796. The female tabs 392, 394, 396; 492, 494, 496; 594; 692, 694*a*, 694*b*, 694*c*, 694*d*, 696; 792, 794, 796 may protrude downward through an opening in the engaging panel 12; 112; 212; 312; 412; 512; 612; 712; 812. The finger tab 80; 180; 280; 380; 480; 580; 680; 780; 880 may engage the perimeter of the respective opening in the engaging panel 12; 112; 212; 312; 412; 512; 612; 712; 812 as well as recessed portions of a respective pair of female or retaining tabs 392, 394, 396; 492, 494, 496; 594; 692, 694*a*, 694*b*, 694*c*, 694*d*, 696; 792, 794, 796.

The carrier 90; 290; 390; 590; 690; 890 may comprise a gusseted end closure structure 322A, 328A, 330A, 324, 326, 330B, 328B, 322B, 422A, 428A, 430A, 424, 426, 430B, 428B, 422B, 522A, 528A, 530A, 524, 526, 530B, 528B, 522B, 622A, 628A, 630A, 624, 626, 630B, 628B, 622B, 722A, 728A, 730A, 724, 726, 730B, 728B, 722B, 822A, 828A, 830A, 824, 826, 830B, 828B, 822B for forming a rigid hinged connection along at least one of upper and lower end edges of at least one end of a tubular structure formed in part by a cover or upper panel 18/20; 118/120; 254; 318/320; 418/420; 518/520; 618/620; 718/720; 818/820 and an engaging panel 12; 112; 212; 312; 412; 512; 612; 712; 812 together with opposed side panels 314, 316; 414, 416; 514; 516; 614, 616; 714, 716; 814, 816.

The carrier 90; 290; 390; 590; 690; 890 may comprise a gusset provided by a pair of hinged panels 328A/330A, 328B/330B, 428A/430A, 428B/430B, 728A/730A, 728B/730B, 828A/830A, 828B/830B connecting between a first end flap 322A, 322B, 422A, 422B, 522A; 522B, 722A, 722B, 822A, 822B hingedly connected to an upper or cover panel 18/20; 118/120; 254; 318/320; 418/420; 518/520; 618/620; 718/720; 718/720 and second end flap 324/326; 424/426; 524/526; 724/726; 824/826 hingedly connected to a lower or engaging panel 12; 112; 212; 312; 412; 512; 612; 712; 720.

The pair of hinged panels 328A/330A, 328B/330B, 428A/430A, 428B/430B, 728A/730A, 7286/730B, 828A/830A, 828B/830B, 838A/840A, 838B/840B may be hingedly connected to a portion 326; 426; 526; 626; 726; 826 of the second end flap arranged to be substantially parallel to the upper or cover panel 18/20; 118/120; 254; 318/320; 418/420; 518/520; 618/620; 718/720; 818/820 and/or lower or engaging panel 12; 112; 212; 312; 412; 512; 612; 712; 812.

At least one of the pair of hinged panels 828A/830A, 828B/830B, 838A/840A, 838B/840B may be defined, at least in part, by a pair of divergently arranged fold lines 855B, 859B.

At least one of the pair of hinged panels 828A/830A, 828B/830B, 838A/840A, 838B/840B may be defined, at least in part, by a pair of parallel fold lines 839B, 855B.

The carrier 90; 290; 390; 590; 690; 890 may comprise an article retention structure RT, RT1, RT2 having an engaging tooth or tab 48; 148, 148B, 248; 448A, 448B located proximate a fold line 13, 15; 113, 115; 213A, 215A; 313, 315, 325, 335; 413, 415, 425, 435; 513, 515, 525, 535; 713, 715, 725, 735; 813, 815, 825, 835 between a main or engaging panel 12; 112; 212; 312; 412; 512; 612; 712; 812 and a side or end panel 14, 16; 114, 116; 214A, 216A; 314, 316, 324, 334; 414, 416, 424, 434; 514, 516, 524, 534; 614, 616, 624, 634; 714, 716, 724, 734; 814, 816, 824, 834. The tooth or tab 48; 148, 148B, 248; 448A, 448B is defined by a pair of non-linear side edges each having a first end on a distal end edge E1 of the tooth or tab 48; 148, 148B, 248; 448A, 448B. The side edges are defined by cuts 45, 47; 145, 147; 445, 447 which extend from their respective first ends toward the fold line 13, 15; 113, 115; 213A, 215A; 313, 315, 325, 335; 413, 415, 425, 435; 513, 515, 525, 535; 613, 615, 625, 635; 713, 715, 725, 735; 813, 815, 825, 835 and then turn away from each other, while maintaining a space from the fold line 13, 15; 113, 115; 213A, 215A; 313, 315, 325, 335; 413, 415, 425, 435; 513, 515, 525, 535; 613, 615, 625, 635; 713, 715, 725, 735; 813, 815, 825, 835. The cuts 45, 47; 145, 147; 445, 447 terminate at their respective second ends spaced apart from the fold line 13, 15; 113, 115; 213A, 215A; 313, 315, 325, 335; 413, 415, 425, 435; 513, 515, 525, 535; 613, 615, 625, 635; 713, 715, 725, 735; 813, 815, 825, 835.

The article carrier 90; 290; 390; 590; 690; 890 may comprise a cover panel 18/20; 118/120; 254; 318/320; 418/420; 518/520; 618/620; 718/720; 818/820 and engaging 12; 112; 212; 312; 412; 512; 612; 712; 812 spaced panels. The article carrier 90; 290; 390; 590; 690; 890 may comprise a male locking tab 80; 180; 280; 380; 480; 580; 680; 780; 880, 882 formed from the cover panel 18/20; 118/120; 254; 318/320; 418/420; 518/520; 618/620; 718/720; 818/820 for connecting the cover panel 18/20; 118/120; 254; 318/320; 418/420; 518/520; 618/620; 718/720; 818/820 with the engaging panel 12; 112; 212; 312; 412; 512; 612; 712; 812. The locking tab 80; 180; 280; 380; 480; 580; 680; 780; 880, 882 is hingedly connected to the cover panel 18/20; 118/120; 254 along a notional fold line n-n which extends obliquely with respect to at least one of an end edge M1, M2 and a side edge 19; 119; 319; 419; 519; 619; 719; 819 of the cover panel 18/20; 118/120; 254; 318/320; 418/420; 518/520; 618/620; 718/720; 818/820. The cover panel 18/20; 118/120; 254; 318/320; 418/420; 518/520; 618/620; 718/720; 818/820 forms an upper panel 18/20; 118/120; 254; 318/320; 418/420; 518/520; 618/620; 718/720; 818/820 and the engaging panel 12; 112; 212; 312; 412; 512; 612; 712; 812 forms a lower panel 12; 112; 212; 312; 412; 512; 612; 712; 812.

This may be advantageous when only a small space is available at the centre of four top-engaging apertures to provide a finger hole, in particular in embodiment adapted to accommodate articles of a sleek of slim design in which there is little variation in diameter of the articles over their height.

The present disclosure also provides an article carrier 290 comprising an engaging panel 212 having engaging apertures A7, A8 for receiving upper portions of articles B, a cover panel 254 disposed at a position spaced above the engaging panel 212, and a connecting structure A2, 260, 256A, 256B for connecting the cover panel 254 with the engaging panel 212. The engaging panel 212 and the cover panel 254 are formed from separate blanks 210A, 210B respectively.

The article carrier 290 may further comprising an article stabilizing structure 214A, 216A, 218, 220 extending downward from the engaging panel 212. The article stabilizing structure 214A, 216A, 218, 220 encircles a group of articles B being packaged.

The locking tab 80; 180; 280; 380; 480; 580; 680; 780; 880, 882 comprises shoulders or detents S, S1, S2 spaced apart from the hinged connection between the locking tab 80; 180; 280; 380; 480; 580; 680; 780; 880, 882 and the panel 20; 120, 254; 320; 420; 520; 620; 720; 818, 820 to which it is hinged, in this way the shoulders or detents S engage a second panel 12; 112; 212; 312; 412; 512; 612; 712; 812 spaced apart from said panel 20; 120, 254; 320; 420; 520; 620; 720; 818, 820.

The locking tab 580; 680 may comprise one or more separation elements 587, 687 defining engaging edges of an engaging or securing portion 580*c*, 680*c*. The engaging edge being arranged to engage a first or lower surface of the second panel 12; 112; 212; 312; 412; 512; 612; 712; 812.

The separation elements 587, 687 may define a support or bracing edge of a wing or lateral portion 580*b*, 680*b* of the locking tab 580, 680. The bracing edge being arranged to engage a second or upper surface of the second panel 12; 112; 212; 312; 412; 512; 612; 712; 812. The second surface of the second panel 12; 112; 212; 312; 412; 512; 612; 712; 812 opposes the first surface of the second panel 12; 112; 212; 312; 412; 512; 612; 712; 812.

The separation elements 587, 687 may be provided by a cut line 587, 687, slot, or slit. The cut line 587, 687, slot, or slit may be obliquely oriented with respect to the hinged connection between locking tab 580; 680 and the panel 20; 120, 254; 320; 420; 520; 620; 720; 820 to which it is hinged.

The locking tab 80; 180; 280; 380; 480; 580; 680; 780; 880, 882 forms a cushioning flap of a handle structure for enabling the carrier 90; 290; 390; 590; 690; 890 to be carried by a user.

The locking tab 80; 180; 280; 380; 480; 580; 680; 780; 880, 882 defines a first opening, in the panel 20; 120, 254; 320; 420; 520; 620; 720; 820, 818 to which it is hinged, that is disposed in registry with a second or handle opening A2 defined in the second panel 12; 112; 212; 312; 412; 512; 612; 712; 812. The first and second openings together define a passage through the pair of spaced apart panels 18/20, 12; 118/120, 112; 254, 212; 312, 318/320; 412, 418/420; 512, 518/520; 612, 618/620; 712, 718/720; 812, 818/820.

The second panel 12; 112; 212; 312; 412; 512; 612; 712; 812 limits travel or folding of the locking tab 80; 180; 280; 380; 480; 580; 680; 780; 880, 882. An edge of the second panel 12; 112; 212; 312; 412; 512; 612; 712; 812 provided by the second or handle opening A2 provides an end stop with which the locking tab 80; 180; 280; 380; 480; 580; 680; 780; 880, 882 may engage. The locking tab 80; 180; 280; 380; 480; 580; 680; 780; 880, 882 comprises a bridging region extending across a gap or void between the cover panel 18/20; 118/120; 254; 318/320; 418/420; 518/520; 618/620; 718/720; 818/820 and the engaging panel 12; 112; 212; 312; 412; 512; 612; 712; 812. The bridging region defined between the hinged connection or notional fold line n-n and the shoulders or detents S of the locking tab 80; 180; 280; 380; 480; 580; 680; 780; 880, 882.

The cover panel 254 may comprise marginal regions 254A, 254B folded about shoulders or sides of the articles B forming the article group being packaged.

The cover panel 18/20; 118/120; 318/320; 418/420; 518/520; 618/620; 718/720; 818/820 may comprise a pair of covering flaps 18, 20; 118, 120; 318, 320; 418, 420; 518, 520; 618, 620; 718, 720; 818, 820 each of which is hingedly connected to the engaging panel 12; 112; 212; 312; 412; 512; 612; 712; 812 by a respective side panel 14, 16; 114, 116; 314, 316; 414, 416; 514; 516; 614, 616; 714, 716; 814, 816.

The side panels 14, 16; 114, 116; 314, 316; 414, 416; 514; 516; 614, 616; 714, 716; 814, 816 may have a height dimension defined between a first hinged connection to the engaging panel 12; 112; 312; 412; 512; 612; 712; 812 and a second hinged connection to a respective one of a pair of covering flaps 18, 20; 118, 120; 318, 320; 418, 420; 518, 520; 618, 620; 718, 720; 818, 820. The height dimension may be substantially equal to the depth which the articles B penetrate or pass through article retention structures RT, RT1, RT2 provided in the engaging panel 12; 112; 312; 412; 512; 612; 712; 812.

The height dimension may be greater than the depth which the articles B penetrate or pass through article retention structures RT, RT1, RT2 provided in the engaging panel 12; 112; 312; 412; 512; 612; 712; 812 in such embodiments, the width of the cover panel 18/20; 118/120; 318/320; 418/420; 518/520; 618/620; 718/720; 818/820 may be less than the width of the engaging panel 12; 112; 312; 412; 512; 612; 712; 812. The side panels 14, 16; 114, 116; 314, 316; 414, 416; 514; 516; 614, 616; 714, 716; 814, 816 may be obliquely oriented with respect to the cover panel 18/20; 118/120; 318/320; 418/420; 518/520; 618/620; 718/720; 818/820 and/or the engaging panel 12; 112; 312; 412; 512; 612; 712; 812.

The present disclosure also provides an article carrier 90; 290; 390; 590; 690; 890 comprising a pair of spaced panels including a cover/upper panel 18/20; 118/120; 254; 318/320; 418/420; 518/520; 618/620; 718/720; 818/820 and an engaging panel 12; 112; 212; 312; 412; 512; 612; 712; 812. The article carrier 90; 290; 390; 590; 690; 890 may comprise a male locking tab 80; 180; 280; 380; 480; 580; 680; 780; 880, 882 formed from the cover panel 18/20; 118/120; 254; 318/320; 418/420; 518/520; 618/620; 718/720; 818/820 for connecting the cover panel 18/20; 118/120; 254; 318/320; 418/420; 518/520; 618/620; 718/720; 818/820 with the engaging panel 12; 112; 212; 312; 412; 512; 612; 712; 812. The locking tab 80; 180; 280; 380; 480; 580; 680; 780; 880, 882 is hingedly connected to the cover panel 18/20; 118/120; 254; 318/320; 418/420; 518/520; 618/620; 718/720; 818/820 along a fold line 81; 181; 281; 381; 481; 581, 681; 781; 881, 883. The fold line 81; 181; 281; 381; 481; 781; 881, 883 lies upon a notional line n-n which extends obliquely with respect to at least one of an end edge M1, M2 and a side edge 19; 119; 319; 419; 519; 619; 719; 819, 817 of the cover panel 18/20; 118/120; 254; 318/320; 418/420; 518/520; 618/620; 718/720; 818/820.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted outline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for engaging at least one article, the article carrier comprising spaced apart panels including an upper panel and a lower panel, the article carrier comprising a locking tab formed from the upper panel, the locking tab providing a retaining device securing the upper panel in a locked position above the lower panel, wherein at least a portion of the locking tab is disposed between the upper panel and the lower panel to maintain a spacing therebetween, wherein the locking tab comprises an edge portion configured to engage with an edge defined by an opening in the lower panel to retain the upper panel in the locked position.

2. An article carrier, according to claim 1, wherein the locking tab protrudes downward through the opening in the lower panel such that the edge portion of the locking tab engages the perimeter of the opening in the lower panel.

3. An article carrier, according to claim 1, wherein the upper panel comprises a composite cover panel formed from an upper covering flap and a lower covering flap, the upper covering flap and the lower covering flap at least partially overlapping, wherein the upper covering flap comprises the locking tab and the lower covering flap comprises an opening defined by one or more female tabs.

4. An article carrier, according to claim 3, wherein the locking tab engages with at least one of the female tabs.

5. An article carrier, according to claim 4, wherein at least one of the female tabs protrudes downward through an opening in the lower panel.

6. An article carrier, according to claim 4, wherein the locking tab engages a perimeter of an opening in the lower panel and engages a recessed portion of at least one of the female tabs.

7. An article carrier, according to claim 3, wherein at least a portion of the one or more female tabs is disposed between the upper panel and the lower panel to maintain a spacing therebetween.

8. An article carrier, according to claim 1, wherein the locking tab comprises one or more separation elements defining an engaging edge of the edge portion, the engaging edge being arranged to engage a first surface of the lower panel.

9. An article carrier, according to claim 8, wherein the one or more separation elements define a support edge of a wing portion, the support edge being arranged to engage a second surface of the lower panel, the second surface of the lower panel opposes the first surface of the lower panel.

10. An article carrier, according to claim 1, wherein the locking tab is obliquely oriented with respect to the upper and lower panels.

11. An article carrier, according to claim 1, wherein the upper panel comprises a composite cover panel formed from an upper covering flap and a lower covering flap, the upper covering flap and the lower covering flap at least partially overlapping, wherein the upper covering flap comprises a first male locking tab and the lower covering flap comprises an opening defined by a second male locking tab.

12. An article carrier for engaging at least one article, the article carrier comprising a tubular structure formed in part by a cover panel, an engaging panel, and opposed side panels, wherein the carrier comprises an end closure structure for forming a beam structure along at least one end of the tubular structure, wherein the end closure structure comprising end panel hingedly connected to the engaging panel, and an end flap hingedly connected to the end panel; at least one anchor flap hingedly connected to the cover panel and disposed in face contacting relationship with both the cover panel and the end flap.

13. An article carrier according to claim 12, wherein the cover panel comprises a first top panel and wherein the article carrier further comprises:

a first end flap hingedly connected to the first top panel and a second end flap hingedly connected to the engaging panel, and a gusset, provided by a pair of hinged panels, that connects between the first end flap and the second end flap.

14. An article carrier, according to claim 13, wherein the pair of hinged panels is hingedly connected to a first portion of the second end flap arranged substantially parallel to the first top panel.

15. An article carrier, according to claim 14, wherein the first portion of the second end flap is hingedly connected to a second portion of the second end flap, the second portion of the second end flap extending between the first top panel and the engaging panel.

16. An article carrier according to claim 1 wherein the spaced apart panels include a cover panel as the upper panel and an engaging panel as the lower panel, the locking tab comprising a male locking tab, formed from the cover panel, for connecting the cover panel with the engaging panel, wherein the locking tab is hingedly connected to the cover panel along a notional fold line which extends obliquely with respect to at least one of an end edge and a side edge of the cover panel.

17. A blank for forming an article carrier, the blank comprising a pair of panels arranged to be spaced apart in a setup carrier, the pair of panels including an upper panel and a lower panel, the blank comprising a locking tab formed from the upper panel, the locking tab providing a retaining device for securing the upper panel in position above the lower panel in a locked position, wherein at least a portion of the locking tab is disposed between the upper panel and the lower panel to maintain a spacing therebetween in the locked position, wherein the upper panel comprises a composite cover panel, the composite cover panel comprising a first cover panel and a second cover panel configured to at least partially overlap when formed, wherein the locking tab is formed in the first cover panel and the second cover panel comprises an opening formed therein and the opening is configured to receive the locking tab therethrough.

18. A blank according to claim 17, wherein the lower panel comprises an engaging panel arranged to be spaced apart from the upper panel in the setup carrier, wherein the locking tab is hingedly connected to the upper panel along a notional fold line which extends obliquely with respect to at least one of an end edge and a side edge of the upper panel.

19. A blank according to claim 17, wherein the locking tab is hingedly connected to the upper panel, and wherein the locking tab comprises an edge portion shaped to engage with at least one of an edge of an aperture formed in the lower panel and an edge of an aperture formed in a cover panel to retain the upper panel in the locked position.

20. An article carrier according to claim 1 further comprising a handle structure formed in part from the upper panel and in part from the lower panel, the handle structure comprising a cushioning flap, formed from the upper panel and folded into a gap between the upper and lower panels, wherein the cushioning flap provides the locking tab.

21. An article carrier according to claim 12 wherein the engaging panel having at least one aperture and the end flap is disposed over the at least one aperture.

* * * * *